US008857707B1

(12) United States Patent
Kovacs et al.

(10) Patent No.: US 8,857,707 B1
(45) Date of Patent: Oct. 14, 2014

(54) BANKING SYSTEM CONTROLLED RESPONSIVE TO DATA BEARING RECORDS

(75) Inventors: Douglas A. Kovacs, North Canton, OH (US); Terry E. Doll, Uniontown, OH (US); Timothy Stefanko, Rittman, OH (US); Richard J. Hanna, Massillion, OH (US)

(73) Assignee: Diebold Self-Service Systems division of Diebold, Incorporated, North Canton, OH (US)

( * ) Notice: Subject to any disclaimer, the term of this patent is extended or adjusted under 35 U.S.C. 154(b) by 317 days.

(21) Appl. No.: 13/398,246

(22) Filed: Feb. 16, 2012

Related U.S. Application Data

(63) Continuation-in-part of application No. 12/295,355, filed on Oct. 20, 2010, now Pat. No. 8,561,887.

(60) Provisional application No. 61/463,464, filed on Feb. 17, 2011, provisional application No. 61/279,534, filed on Oct. 21, 2009.

(51) Int. Cl.
*G07F 19/00* (2006.01)

(52) U.S. Cl.
USPC ..... 235/379

(58) Field of Classification Search
CPC ..... G07F 19/20; G07F 19/205; G07F 19/202; G07F 17/0042; G07F 17/12; G07F 19/201; G07F 7/00; G07F 19/00; G06K 5/00; E05G 1/00; E05G 1/024; E05G 1/08; G06Q 20/18
USPC ..... 235/375, 379, 380; 705/35, 39, 41–45; 902/8, 9, 12–15, 20, 30–35
See application file for complete search history.

(56) References Cited

U.S. PATENT DOCUMENTS

| | | | | |
|---|---|---|---|---|
| 4,813,475 | A * | 3/1989 | Couvrette | 165/223 |
| 4,835,983 | A * | 6/1989 | Chandler et al. | 62/259.1 |
| 7,938,317 | B1 * | 5/2011 | Lute et al. | 235/379 |
| 8,052,051 | B1 * | 11/2011 | Lute et al. | 235/379 |
| 2002/0194793 | A1 * | 12/2002 | Bowron | 52/36.1 |
| 2005/0029341 | A1 * | 2/2005 | Magee et al. | 235/379 |
| 2005/0156025 | A1 * | 7/2005 | Utz | 235/379 |
| 2007/0246524 | A1 * | 10/2007 | Booth et al. | 235/379 |

* cited by examiner

*Primary Examiner* — Thien M Le
*Assistant Examiner* — April Taylor
(74) *Attorney, Agent, or Firm* — Black, McCuskey, Souers & Arbaugh, LPA

(57) ABSTRACT

An apparatus operates to cause financial transfers responsive to data read from data bearing records. The apparatus includes a card reader that is operative to read card data from a user card. At least one computer in operative connection with the card reader is operative to cause a determination to be made that the read card data corresponds to an authorized financial account. The at least one computer is operative to cause a financial transfer to or from the account responsive to the determination and user inputs to at least one input device of the machine. The automated banking machine includes a housing. The housing is at least partially surrounded by an enclosure that operates to protect the housing and machine from environmental conditions.

20 Claims, 35 Drawing Sheets

BANKING SYSTEM CONTROLLED RESPONSIVE TO DATA BEARING RECORDS

CROSS REFERENCE TO RELATED APPLICATIONS

This application claims benefit pursuant to 35 U.S.C. §119 (e) of Provisional Application Ser. No. 61/463,464 filed Feb. 17, 2011, the disclosure of which is incorporated herein by reference in its entirety.

This application is also a continuation-in-part of application Ser. No. 12/925,355 filed Oct. 20, 2010 which claims benefit pursuant to 35 U.S.C. §119(e) of Provisional Application 61/279,534 filed Oct. 21, 2009. The disclosures of each of these applications are incorporated herein by reference in their entirety.

TECHNICAL FIELD

This invention relates to automated banking machines that operate responsive to data read from user cards and which may be classified in U.S. Class 235, Subclass 379.

BACKGROUND ART

Automated banking machines may include a card reader that operates to read data from a bearer record such as a user card. Automated banking machines may operate to cause the data read from the card to be compared with other computer stored data related to the bearer or their financial accounts. The machine operates in response to the comparison determining that the bearer record corresponds to an authorized user, to carry out at least one transaction which may be operative to transfer value to or from at least one account. A record of the transaction is often printed through operation of the automated banking machine and provided to the user. Automated banking machines may be used to carry out transactions such as dispensing cash, the making of deposits, the transfer of funds between accounts and account balance inquiries. The types of banking transactions that may be carried out are determined by the capabilities of the particular banking machine and system, as well as the programming of the institution operating the machine.

Other types of automated banking machines may be operated by merchants to carry out commercial transactions. These transactions may include, for example, the acceptance of deposit bags, the receipt of checks or other financial instruments, the dispensing of rolled coin, or other transactions required by merchants. Still other types of automated banking machines may be used by service providers in a transaction environment such as at a bank to carry out financial transactions. Such transactions may include for example, the counting and storage of currency notes or other financial instrument sheets, and other types of transactions. For purposes of this disclosure an automated banking machine, automated transaction machine or an automated teller machine (ATM) shall be deemed to include any machine that may be used to automatically carry out transactions involving transfers of value.

Automated banking machines may benefit from improvements.

OBJECTS OF EXEMPLARY EMBODIMENTS

It is an object of an exemplary embodiment to provide a banking system apparatus that is operated responsive to data bearing records.

It is an object of an exemplary embodiment to provide an automated banking machine.

It is a further object of an exemplary embodiment to provide an automated banking machine that has an attractive appearance.

It is a further object of an exemplary embodiment to provide an automated banking machine which is more readily serviced.

It is a further object of an exemplary embodiment to provide an automated banking machine which is more readily manufactured.

It is a further object of an exemplary embodiment to provide a method for more efficiently manufacturing an automated banking machine.

It is a further object of an exemplary embodiment to provide a method for servicing an automated banking machine which requires less space for servicing.

It is a further object of an exemplary embodiment to provide a method for servicing an automated banking machine which provides improved access for servicing of internal components.

It is a further object of an exemplary embodiment to provide a method for servicing an automated banking machine which provides more efficient servicing of internal components.

It is a further object of an exemplary embodiment to provide a method for easy removal and installation of an automated banking machine in an enclosure that helps protects the machine from the environment.

It is a further object of an exemplary embodiment to provide an apparatus that is configured to protect an automated banking machine and also enable air to adequately flow to the machine to sufficiently ventilate the machine.

It is a further object of an exemplary embodiment to provide a method for replacing a filter in an air duct of an enclosure that at least partially encloses an automated banking machine.

Further objects of exemplary embodiments will be made apparent in the following Detailed Description of Exemplary Embodiments and the appended claims.

The foregoing objects are accomplished in an exemplary embodiment by an automated banking machine which includes a top housing bounding an interior area. The automated banking machine includes a card reader that reads data from user cards. The data read from user cards is used to enable the machine to carry out financial transactions. The top housing defines a front opening to the interior area and may define a rear opening into the interior area. The top housing is mounted above a secure enclosure which is alternatively referred to herein as a chest or safe. The top housing may further include at least one wall, the at least one wall formed to include one or more housing vents operative to enable air to pass therethrough. Such housing vents enable the movement of air, for example, to assist in removing heat generated by components within the housing.

The top housing houses upper banking machine components which may include, for example, a display, the card reader, a receipt printer, a keypad, a camera, controllers, processors, including computer processors, actuators, sensors, and other devices. As used herein "keypad" means input keys whether arranged in a keypad arrangement, keyboard arrangement, or otherwise, and the designations are interchangeable unless expressly identified as being used in a restricted manner. The banking machine components may be further enclosed within a case. The case may be formed to include one or more component case vents operative to enable air to pass therethrough. The processor, for example, may be further enclosed in a processor case with processor case vents. Such processor case vents enable the movement of air, for example, to assist in removing heat generated by processor components. The chest houses lower banking machine components which may include, for example, a currency dispenser mechanism, a currency recycler, a secure deposit holding container and other devices.

The exemplary automated banking machine includes an upper fascia, preferably secured by a lock, moveably mounted in supporting connection with the top housing and adapted to selectively cover the front opening. In one embodiment, the upper fascia is operatively supported by the top housing through two horizontally disposed members. In one embodiment, the two horizontally disposed members are slidable. In one embodiment, the upper fascia includes a rearwardly extending projection which selectively overlies a forward region of the top housing adjacent the front opening to provide an attractive appearance to the machine. In one embodiment, the upper fascia is movable from a first position where the upper fascia covers the front opening, and a second position where the fascia is disposed away from the front opening.

In addition to the top housing including banking machine components, the upper fascia may have supported thereon, for example, banking machine components such as those exemplary components listed herein above.

The top housing may include, for example, a moveable rear panel, preferably secured by a lock, moveably mounted in supporting connection with the top housing and adapted to selectively cover a top housing rear opening. In one embodiment, the moveable rear panel is operatively supported by the top housing through two horizontally disposed members. In one embodiment, the two horizontally disposed members are slidable. In one embodiment, the moveable rear panel is movable from a first position where the rear panel covers the rear opening, and a second position where the rear panel is disposed away from the rear opening.

In a further exemplary embodiment, the moveable rear panel may have supported thereon, for example, banking machine components such as those exemplary components listed herein above.

A lower fascia is movably mounted in supporting connection with the chest. The lower fascia of an exemplary embodiment is selectively movable between a covering position where the lower fascia covers a closed chest door and an accessible position where the lower fascia is disposed away from the closed chest door.

The lower fascia includes first and second side extensions so that when the lower fascia is in the covering position the first and second side extensions respectively cover forward portions of the first and second side walls of the chest housing.

In one exemplary embodiment, a rollout tray is moveably mounted in supporting connection with the top housing. Several of the upper banking machine components may be supported on the rollout tray. Additionally, the upper fascia may be mounted to the rollout tray. The rollout tray is movable between a retractable position where the rollout tray is in the interior area and an extended position where the rollout tray extends from the front opening. When the rollout tray is in the retracted position, the upper fascia selectively covers the front opening. When the rollout tray is in the extended position, the banking components mounted thereon may be more readily serviced.

The chest of the exemplary embodiment includes a door selectively movable between a closed position and an open position. In one embodiment, when the lower fascia is in the accessible position and the chest door is in the open position, the lower fascia is adapted to engage the chest door to retain the door in the open position. The lower fascia is adapted for movement away from the chest door in order to release the door from engagement with the lower fascia.

In one exemplary embodiment, the chest housing includes a first opening at a first end thereof and a second opening at a second end thereof. Thus, a master machine chest housing may be used in either front-load or rear-load machine. A first chest door is an operable door and is adapted for selectively closing the first opening. A locking bolt mechanism is carried on the operable chest door.

A second chest door, not generally used during regular operation of the automated transaction machine, can be adapted to semi-permanently close the second opening. An alternate securing mechanism, such as bolts or other fasteners, may be used to semi-permanently engage the second chest door with the housing. As a result, the functional uses of the first and second chest doors can be selected so that the second chest door becomes the operational door, and the other door is securely mounted in a fixed position.

In one exemplary embodiment, a processor case housing the primary processor for the automated transaction machine, is rotationally mounted in supporting connection with the chest. The processor case is adapted for rotational movement between an operational position and a service position. In the operational position, a first functional side of the processor case faces a side wall of the top housing. In the service position, the first functional side of the processor case faces a front opening of the top housing.

In one embodiment, a rollout tray, supporting several upper banking machine components, is movable from a retracted position to an extended position to allow the processor case to rotate into the service position. In the service position, cables, connections, and other components, including one or more processors, are accessible for servicing.

In another exemplary embodiment, a top housing cover is mounted in slidable supporting relationship with the chest housing. Several upper banking machine components may be supported on a mounting tray equipped with side flanges. The top housing cover may include channel members for slidable engagement with the side flanges. The upper banking machine components may be accessed for servicing by rearwardly sliding the top housing cover. A plurality of fasteners and/or locking mechanisms may be employed to secure the top housing cover in an operational position. Alternately, the mounting tray may include channel members for slidable engagement with flange members carried on the top housing cover.

In another embodiment, a duct is operatively mounted between at least one component case vent and at least one housing vent. The duct is operative to enable air to pass therethrough. In another embodiment, a duct frame is operatively mounted to the duct. In another embodiment, the frame is secured to the duct with adhesive. In another embodiment, the frame is operatively mounted to the component case. In another embodiment, the frame includes at least one hook and the component case includes at least one slot and the hook cooperates with the slot to secure the duct to the component case. In another embodiment, the frame includes at least one tab and the component case includes at least one fastener hole. At least one fastener is in operative connection with the tab and cooperates with the hole to secure the duct to the component case.

In another embodiment, the duct comprises a deformable material and is operatively mounted to the component case with adhesive. In another embodiment, the adhesive is releasable, resealable, or a combination thereof. In another embodiment, the frame is secured to the duct with adhesive and the duct is secured to the component case, the frame held between the duct and the case.

In another embodiment, a method is provided comprising moving a fascia from a position adjacent an opening to an interior of a housing of an automated banking machine to a position away from the opening, wherein the fascia is in operatively-supported connection with the housing, and wherein the automated banking machine includes a card reader operative to read indicia corresponding to financial accounts on user cards, a printer operative to print information corresponding to financial accounts and financial transactions, a cash dispenser, at least one housing wall, the at least one housing wall including at least one housing vent operative to enable air to pass therethrough, a component case in operatively-supported connection with the housing, the component case including at least one component case vent formed therein, the at least one component case vent operative to enable air to pass therethrough, and a duct assembly disposed between the at least one component case vent and the at least one housing vent, the duct assembly operative to enable air to pass therethrough. The duct assembly is at least partially secured to the component case with a releasable resealable adhesive. The method further comprises moving the component case from a position within the interior of the housing to a position at least partially extending through the opening, releasing the duct assembly from the component case, servicing a component at least partially contained within the component case, adhering the duct assembly to the component case, moving the component case from the position at least partially extending through the opening to the position within the interior of the housing, and moving the fascia from the position away from the opening to the position adjacent to the opening. In a further embodiment, the duct is deformable with releasable resealable adhesive secured thereto and the duct is deformed against the component case, whereby the duct adheres to the case. In a further embodiment, the duct assembly further comprises a duct frame having at least one hook and the component case further comprises at least one slot and the at least one hook is mated with the at least one slot. In a further embodiment, the duct assembly further comprises a duct frame having at least one tab and at least one fastener capable of being placed in operative connection with the tab and the component case further includes at least one fastener hole and the duct assembly is secured to the component case by mating the at least one fastener with the at least one fastener hole.

In another embodiment, a method is provided comprising mounting a housing in supporting connection with a chest adapted for use in an automated banking machine, wherein the housing includes an interior area, at least one opening into the interior area, and at least one wall, the at least one wall including at least one housing vent formed therein, the at least one housing vent operative to enable air to pass therethrough. The method further includes installing a card reader in operative-supported connection with the housing, wherein the card reader is operative to read indicia on user cards corresponding to financial accounts, installing a display in operatively-supported connection with the housing, installing a cash dispenser in operatively-supported connection with the housing, installing a component case in operatively-supported connection with the housing, the component case including at least one component case vent formed therein, the at least one component case vent operative to enable air to pass therethrough, and adhering a duct assembly to the component case, the duct assembly including a duct operative to enable air to pass therethrough. In a further embodiment, the duct assembly further includes a frame, the frame including at least one hook and the component case further includes at least one slot, the at least one slot adapted to accept the at least one hook, the method further comprising adhering the frame to the duct. In a further embodiment, the duct assembly further includes a frame, the frame including at least one tab, and a fastener capable of being placed in operative connection with the tab, and the component case further includes at least one fastener hole, the method further comprising securing the duct assembly to the component case with the fastener cooperating with the fastener hole.

In another exemplary embodiment, a method is provided including removing a filter operatively covering an air duct of an enclosure that at least partially encloses an automated banking machine. The automated banking machine is operative to cause financial transfers responsive at least in part to data read from data bearing records. The automated banking machine includes at least one card reader, wherein the card reader is operative to read card data usable to identify at least one of a user of the machine and a financial account. The machine also includes a housing removably positioned in the enclosure. At least one computer is associated with the machine. The computer is in operative connection with the card reader and is operative to cause card data to be read through operation of the card reader and to cause a user account to be assessed a value associated with a financial transaction. The method further includes installing at least one of the filter and another filter in operatively covering relation of the duct of the enclosure.

In another exemplary embodiment, a method is provided including opening a door of a chest of an automated banking machine to gain access to an interior area bounded by the chest. The automated banking machine is operative to cause financial transfers responsive at least in part to data read from data bearing records. The automated banking machine includes a card reader that is operative to read card data usable to identify at least one of a user of the machine and a financial account. The machine also includes a banking machine housing including a chest that bounds an interior area. The chest includes a base portion at a lower end thereof. The machine further includes a currency dispenser that is selectively operable to make currency stored in the chest accessible from outside the machine. At least a portion of the currency dispenser extends within the interior area of the chest. The machine also includes at least one leveling leg in operative connection with the base portion that is operative to support at least a portion of the machine. The leveling leg includes a threaded shaft portion and the base portion includes at least one threaded opening. A respective shaft portion extends in a respective threaded opening, and rotation of the respective shaft portion is operative to axially move the shaft portion within the respective opening. Rotational movement of the shaft portion is operative to vertically position the machine. At least one computer which is alternatively referred to herein as a processor, is associated with the machine and is in operative connection with the card reader. The computer is operative to cause a financial account corresponding to read card data to be assessed a value associated with cash dispensed through operation of the cash dispenser. The housing of the automated banking machine is positioned in an enclosure. The enclosure at least partially surrounds the automated banking machine and includes an access opening that is sized to allow the automated banking machine to move into and out of the enclosure. The enclosure includes an enclosure base portion at a lower end of the enclosure. The enclosure base portion includes at least one recess, wherein in an installed position of the automated banking machine in enclosure, a respective leveling leg extends into a respective recess.

The method further includes operatively engaging the shaft portion of a leveling leg in the interior area of the chest with a tool, and rotating the shaft portion of the leveling leg engaged with the tool in a first direction to cause the at least one leveling leg to move axially downward in the at least one opening and cause the chest base portion to move axially upward away from the enclosure base portion at a predetermined distance from each other. The method then includes positioning a support having a thickness that is less than the distance between the base portion of the chest and the enclosure base portion, and rotating the shaft portion of the leveling leg engaged with the tool in the second direction opposite the first direction to cause the leveling leg to move vertically out of the respective recess. The automated banking machine housing is operatively supported by the support. The method then includes moving the automated banking machine housing to extend in the access opening of the enclosure while operatively supported by the support.

In another exemplary embodiment, a method is provided including moving an automated banking machine inward into an enclosure. The automated banking machine is operative to cause financial transfers responsive at least in part to data read from data bearing records. The automated banking machine includes a card reader that is operative to read card data usable to identify at least one of a user of the machine and a financial account. The machine also includes a banking machine housing including a chest, wherein the chest bounds an interior area. The chest includes a chest base portion at a lower end thereof. A currency dispenser that is selectively operable to make currency stored in the chest accessible from outside the machine. At least a portion of the currency dispenser extends in the interior area of the chest. At least one leg is in operative connection with the chest base portion and extends below the chest base portion. At least one computer is associated with the machine and is in operative connection with the card reader. The computer is operative to cause a financial account corresponding to read card data be assessed a value associated with the cash dispensed through operation of the cash dispenser. The enclosure includes an enclosure base portion at a lower end of the enclosure. The enclosure base portion includes at least one recess. The method further includes engaging a leg of the automated banking machine with a respective recess of the enclosure base portion, whereby further inward or outward movement of the machine relative to the enclosure is prevented.

In another embodiment, an apparatus is provided that includes an enclosure that is configured to at least partially enclose an automated banking machine. The automated banking machine is operative to cause financial transfers responsive at least in part to read user data. At least one computer is associated with the machine. The automated banking machine includes at least one card reader that is operative to read card data usable to identify at least one of a user of the machine and a financial account. The machine includes a housing that is configured to be removably positioned in the enclosure, wherein the housing includes a vent that is operative to enable air to pass therethrough. The computer is in operative connection with the card reader and is operative to cause card data to be read through operation of the card reader and to cause a user account to be assessed a value associated with a financial transaction. The enclosure includes an air duct, wherein the duct is operative to enable air to flow through the at least one vent. The apparatus further includes a filter that operatively covers the duct. The filter is operative to filter air flowing through the duct.

The above-described exemplary embodiments allow ready access to the banking machine components for servicing, as well as simplifying the manufacturing and/or assembly process. The principles described may be applied to numerous automated banking machine configurations.

DETAILED DESCRIPTION OF EXEMPLARY EMBODIMENTS

Figure 1:
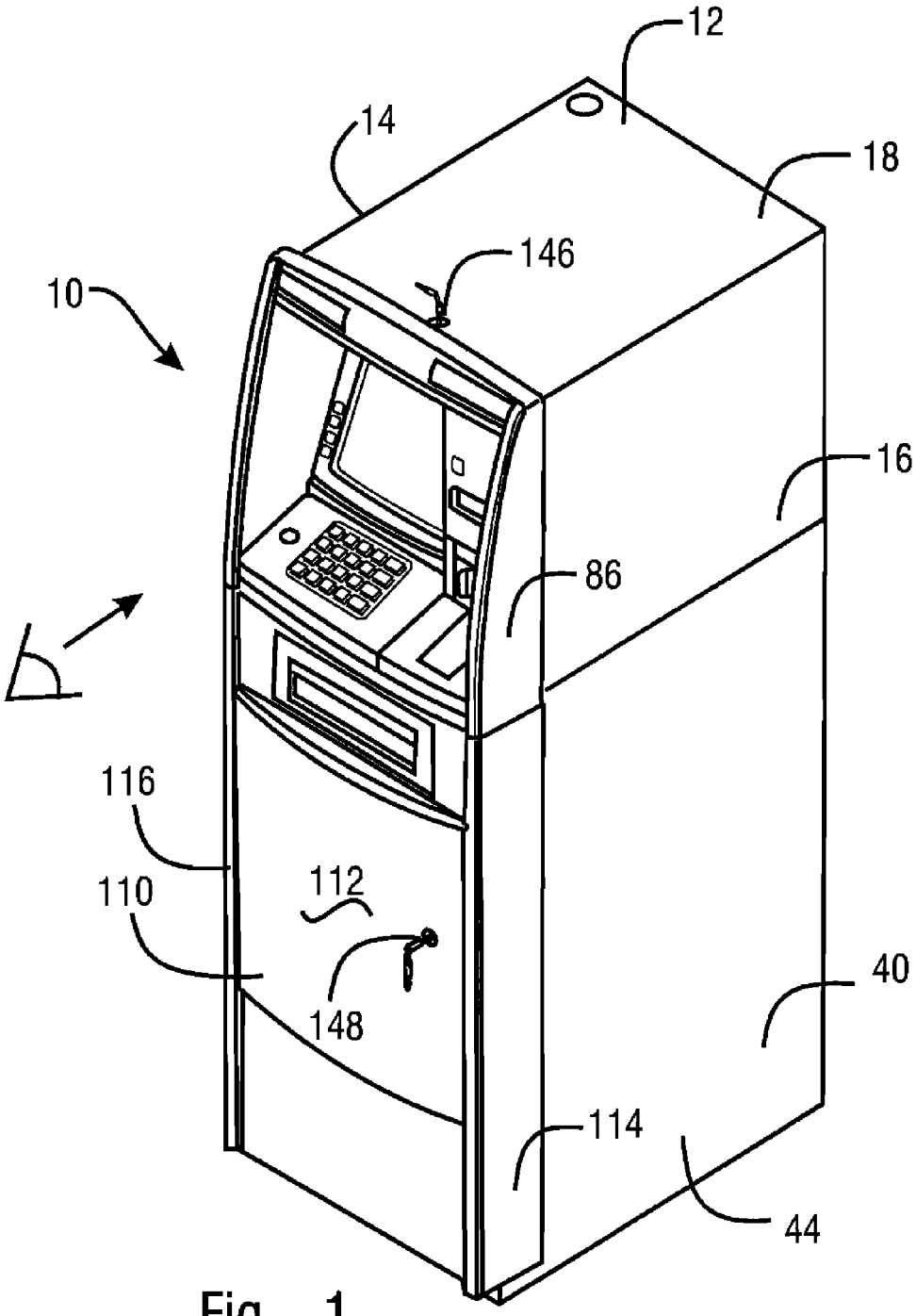
FIG. 1 is an isometric view of an automated banking machine of an exemplary embodiment.
Figure 2:
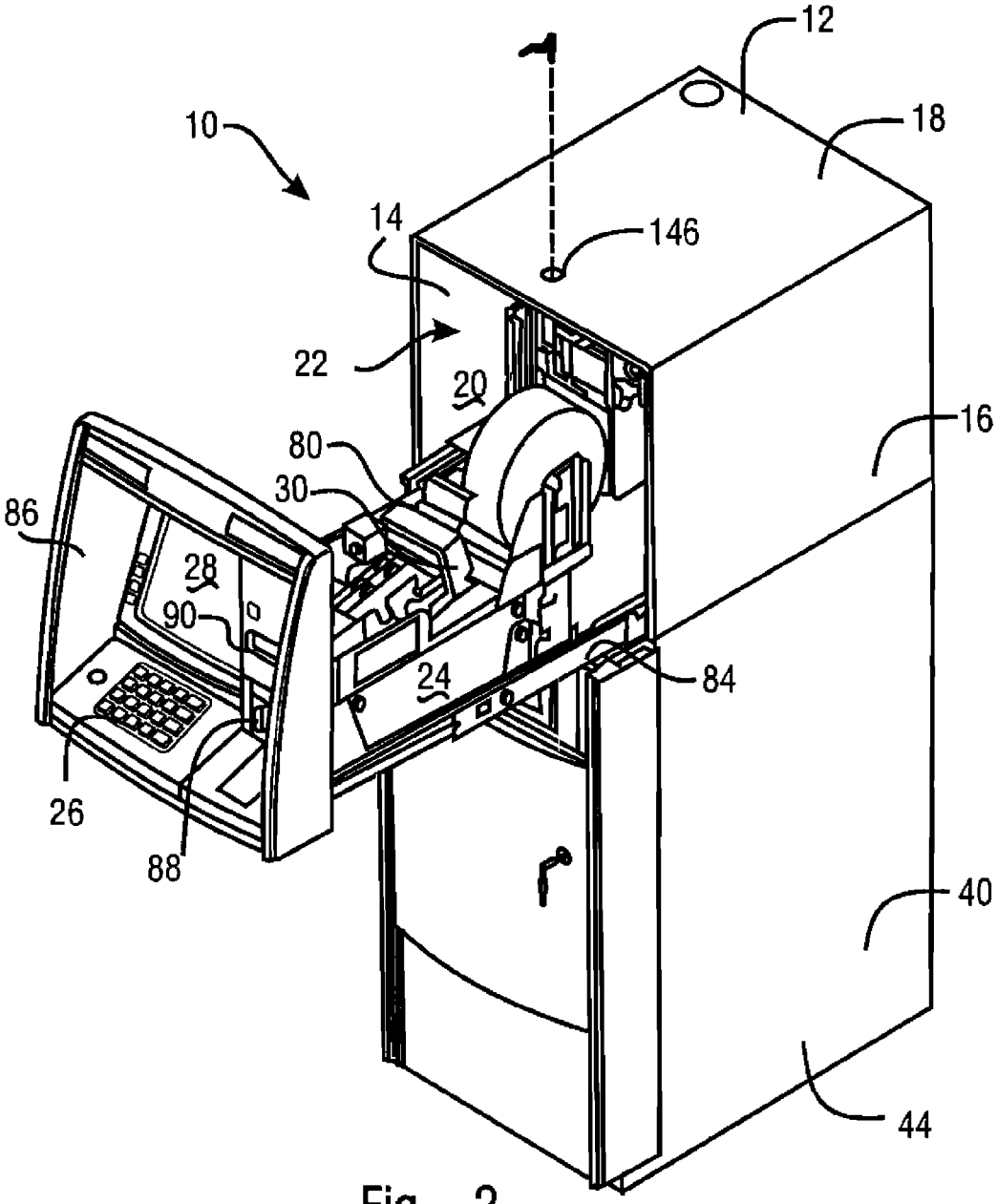
FIG. 2 is an isometric view of the automated banking machine of FIG. 1 with a rollout tray extended.

Referring now to the drawings, and particularly to FIGS. 1-2, there is shown therein an automated banking machine of a first exemplary embodiment, generally indicated 10. In this exemplary embodiment, automated banking machine 10 is an automated teller machine (machine). Machine 10 includes a top housing 12 having side walls 14 and 16, and top wall 18. Housing 12 encloses an interior area indicated 20. Housing 12 has a front opening 22. In this exemplary embodiment, the rear of housing 12 is closed by a rear wall 19, shown in FIG. 7. However, in other embodiments, the rear of housing 12 may be accessible through an access door or similar device. Top housing 12 is used to house certain banking machine components such as input and output devices.

Figure 3:
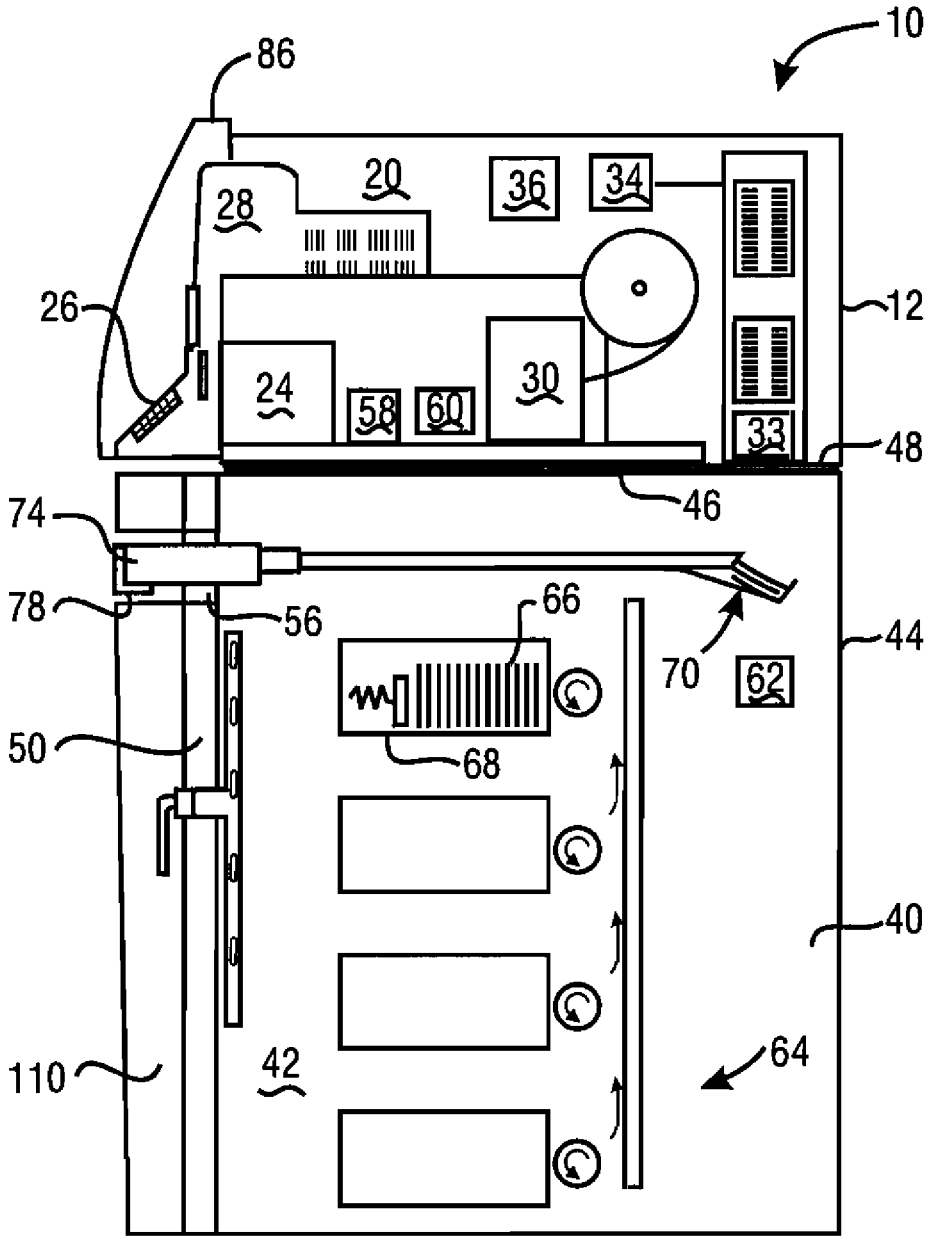
FIG. 3 is a side schematic view of an automated banking machine illustrating various banking machine components.

With reference to FIG. 3, in this exemplary embodiment the input devices include a card reader schematically indicated 24. Card reader 24 is operative to read a customer's card which includes indicia thereon. The indicia may correspond to information about the customer and/or information about a customer's financial account, such as the customer's account number. In some embodiments the card reader 24 may be a card reader adapted for reading magnetic stripe cards and/or so called "smart cards" which include a programmable memory. Other embodiments may read data from cards wirelessly such as radio frequency identification (RFID) cards. Exemplary embodiments may include features of the type discussed in U.S. Pat. No. 7,118,031 the disclosure of which is incorporated herein by reference in its entirety. Another input device in the exemplary embodiment includes input keys 26. Input keys 26 may in some embodiments, be arranged in a keypad or keyboard. Input keys 26 may alternately or in addition include function keys or other types of devices for receiving manual inputs. It should be understood that in various embodiments other types of input devices may be used such as biometric readers, speech or voice recognition devices, inductance type readers, infrared (IR) type readers, and other devices capable of communicating with a person, article or computing device, radio frequency type readers and other types of devices which are capable of receiving information that identifies a customer and/or their account.

The exemplary embodiment of machine 10 also includes output devices providing outputs to the customer. In the exemplary embodiment machine 10 includes a display 28. Display 28 may include an LCD, CRT or other type display that is capable of providing visible indicia to a customer. In other embodiments output devices may include devices such as audio speakers, radio frequency (RF) transmitters, IR transmitters or other types of devices that are capable of providing outputs which may be perceived by a user either directly or through use of a computing device, article or machine. It should be understood that embodiments may also include combined input and output devices such as a touch screen display which is capable of providing outputs to a user as well as receiving inputs.

The exemplary embodiment of the automated banking machine 10 also includes a receipt printer schematically indicated 30. The receipt printer is operative to print receipts for users reflecting transactions conducted at the machine. Embodiments may also include other types of printing mechanisms such as statement printer mechanisms, ticket printing mechanisms, check printing mechanisms and other devices that operate to apply indicia to media in the course of performing transactions carried out with the machine.

Automated banking machine 10 further includes one or more processors schematically indicated 33. Processor 33, alternately referred to as a computer or a controller, is in operative connection with at least one memory or data store which is schematically indicated 34. The processor 33 is operative to carry out programmed instructions to achieve operation of the machine in accomplishing transactions. The processor 33 is in operative connection with a plurality of the transaction function devices included in the machine.

The exemplary embodiment includes at least one communications device 36. The communications device 36 may be one or more of a plurality of types of devices that enable the machine to communicate with other systems and devices for purposes of carrying out transactions. For example, communications device 36 may include a modem for communicating messages over a data line or wireless network, with one or more other computers that operate to transfer data representative of the transfer of funds in response to transactions conducted at the machine. Alternately the communications device 36 may include various types of network interfaces, line drivers or other devices suitable to enable communication between the machine 10 and other computers and systems. Exemplary embodiments may include features like those disclosed in U.S. Pat. No. 7,266,526 the disclosure of which is incorporated herein by reference in its entirety.

Machine 10 further includes a safe or chest 40 enclosing a secure area 42. Secure area 42 is used in the exemplary embodiment to house critical components and valuable documents. Specifically in the exemplary embodiment secure area 42 is used for housing currency, currency dispensers, currency stackers, and other banking machine components. For purposes of this disclosure a cash dispenser shall include any mechanism that makes currency stored within the machine accessible from outside the machine. Cash dispensers may include features of the type disclosed in U.S. Pat. Nos. 7,261,236; 7,240,829; 7,114,006; 7,140,607 and 6,945,526 the disclosures of each of which are incorporated herein by reference in their entirety. Chest 40 includes a chest housing 44 including a top wall 46 having an upper surface 48 outside of the secure area 42. Top housing 12 is supported on the chest 40 such that the secure area 42 is generally below the interior area 20.

Chest 40 also includes a chest door 50 that is moveably mounted in supporting connection with the housing. Chest door 50, shown in the closed position in FIG. 4 and in an open condition in FIG. 5, is generally closed to secure the contents of the chest 40. In this exemplary embodiment, the chest door 50 is used to close a first opening 52 at a first end 54 of the chest housing 44. In other embodiments the chest opening and door may have other configurations. In the exemplary embodiment, chest door 50 includes a first device opening 56 therethrough and cooperates with mechanisms inside and outside the chest for passing currency or other items between a customer and devices located inside the chest 40.

Referring again to FIG. 3, machine 10 also includes a plurality of sensing devices for sensing various conditions in the machine. These various sensing devices are represented schematically by component 58 for simplicity and to facilitate understanding. It should be understood that a plurality of sensing devices is provided in the machine for sensing and indicating to the processor 33 the status of devices within the machine.

Exemplary automated banking machine 10 further includes a plurality of actuators schematically indicated 60 and 62. The actuators may comprise a plurality of devices such as motors, solenoids, cylinders, rotary actuators and other types of devices that are operated responsive to the processor 33. It should be understood that numerous components within the automated banking machine are operated by actuators positioned in operative connection therewith. Actuators 60 and 62 are shown to schematically represent such actuators in the machine and to facilitate understanding.

Machine 10 further comprises at least one currency dispenser mechanism 64 housed in secure area 42. The currency dispensing mechanism 64 is operative responsive to the processor 33 to pick currency sheets from a stack of sheets 66 housed in one or more canisters 68. The picked currency sheets may be arranged by a currency stacker mechanism 70 for presentation through a delivery mechanism 74 which operates to present a stack of note or other documents to a customer.

When chest door 50 is in the closed position, at least an end portion of a sheet delivery mechanism 74 extends through first opening 56 in the chest door 50. In response to operation of the processor 33, when a desired number of currency sheets have been collected in a stack, the stack is moved through delivery mechanism 74.

As the sheets are moved through delivery mechanism 74 toward the first opening 56, the controller 32 operates a suitable actuating device to operate a gate 78 so as to enable the stack of sheets to pass outward through the opening. As a result the user is enabled to receive the sheets from the machine. After a user is sensed as having removed the stack from the opening, the controller may operate to close the gate 78 so as to minimize the risk of tampering with the machine.

With reference to FIG. 2, in this exemplary embodiment, machine 10 further includes a rollout tray 80. Rollout tray 80 is moveably mounted in supporting connection with slides 84. The slides 84 enable movement of the rollout tray 80 between the extended position shown in FIG. 2 and a retracted position within the interior area 20 of the top housing 12. Rollout tray 80 in the exemplary embodiment may be similar to that shown in U.S. Pat. No. 6,082,616, the disclosure of which is incorporated by reference as if fully rewritten herein.

Rollout tray 80 may have several upper banking machine components supported thereon including card reader 24, input keys 26, display 28, receipt printer 30, and other components as appropriate for the particular machine 10.

This exemplary embodiment further includes an upper fascia 86 in supporting connection with rollout tray 80. The upper fascia 86 may include user interface openings such as a card opening 88 through which a customer operating the machine 10 may insert a credit, debit or other card, or a receipt delivery slot 90 through which printed transactions receipts may be delivered to the customer. Rollout tray 80 moveably supports upper fascia 86 relative to the top housing 12 so that upper fascia 86 is movable between a first position covering the front opening and a second position in which the upper fascia is disposed from the front opening 22.

As illustrated in FIG. 1, in the operative condition of machine 10, the rollout tray 80 is retracted into the interior area 20 of the housing 12. Upper fascia 86 operates to close front opening 22 and provide an attractive appearance for machine 10, while allowing a customer to input information and receive outputs from machine 10.

Figure 6:
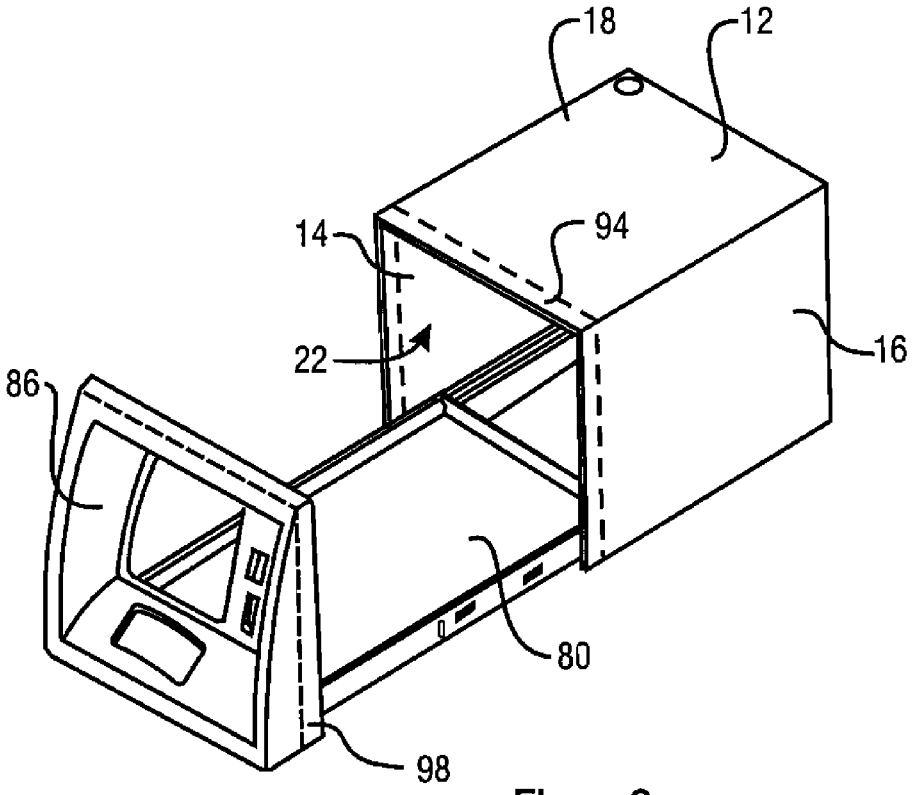
FIG. 6 is an isometric view of a top housing for an automated banking machine supporting a rollout tray in an extended position.

With reference to FIG. 6, in this exemplary embodiment, the forward-most parts of side walls 14 and 16 and top wall 18 of housing 12 define a forward region 94, shown in dashed lines, bounding the front opening 22. In this exemplary embodiment, upper fascia 86 includes a rearwardly extending portion 98, also shown in dashed lines. Rearwardly extending portion 98 is dimensioned to overlie in generally surrounding relation, the forward region 94 when rollout tray 80 is retracted and upper fascia 86 is in the first position. In some embodiments the rearwardly extending portion may be contoured or tapered so as to extend further inwardly with increasing proximity to the front of the fascia. Such tapered control may engage and help to close and/or align the fascia and the top housing 12.

Figure 7:
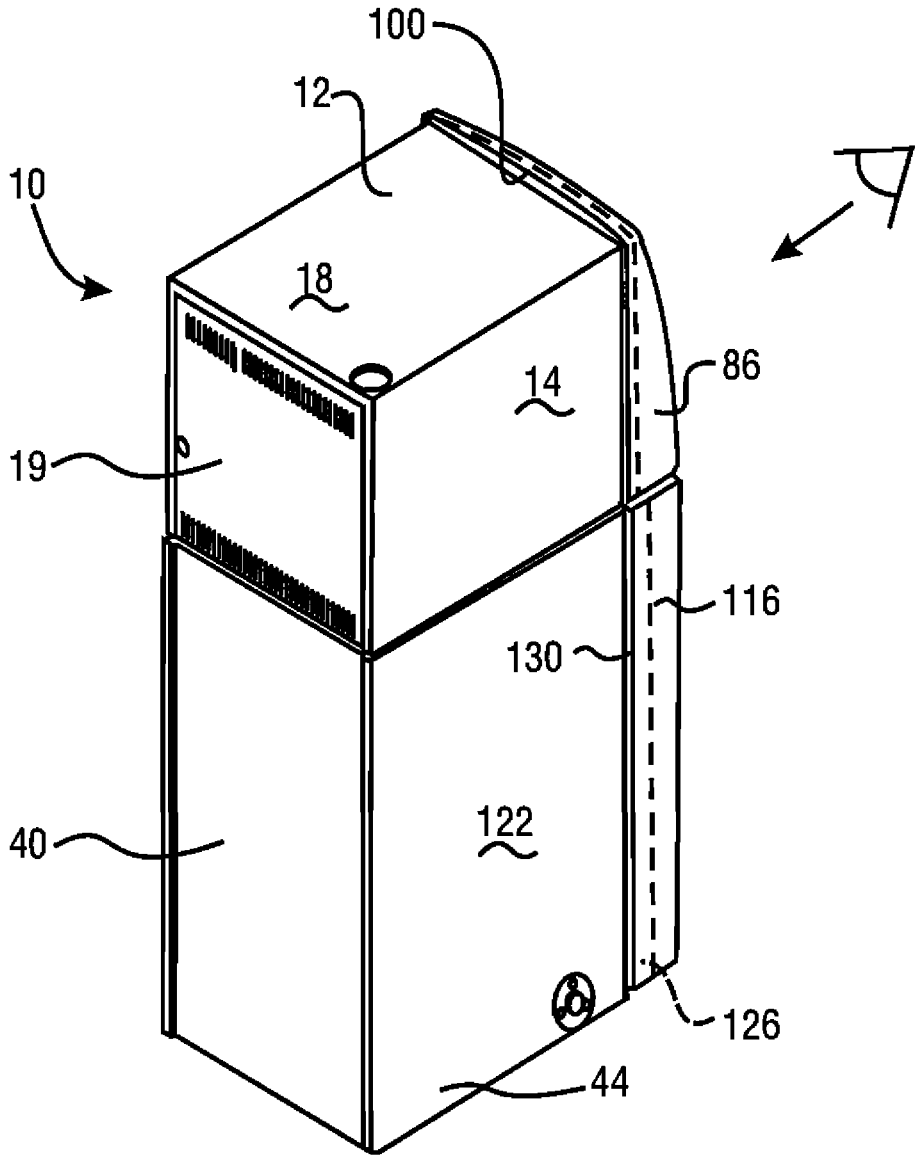
FIG. 7 is an isometric rear view of the automated banking machine of FIG. 1.

With reference to FIG. 7, when machine 10 is viewed from the rear, there may be a first gap 100 separating the rearwardly extending portion 98 of upper fascia 86 from the top housing 12. In some embodiments it may be desirable that first gap 100 be minimal to prevent unauthorized access to interior area 20. First gap 100 in the exemplary embodiment is not visible when machine 10 is viewed from the front.

In this exemplary embodiment, the upper fascia 86 is formed of a plastic material and the top housing 12 is formed of sheet metal. Alternately, the extending portion 98 or forward portion 94 shown in FIG. 6, or both, may include resilient materials to provide for engagement and sealing of the housing and the fascia in the closed position. However, other materials may be chosen, and these approaches are exemplary.

Figure 4:
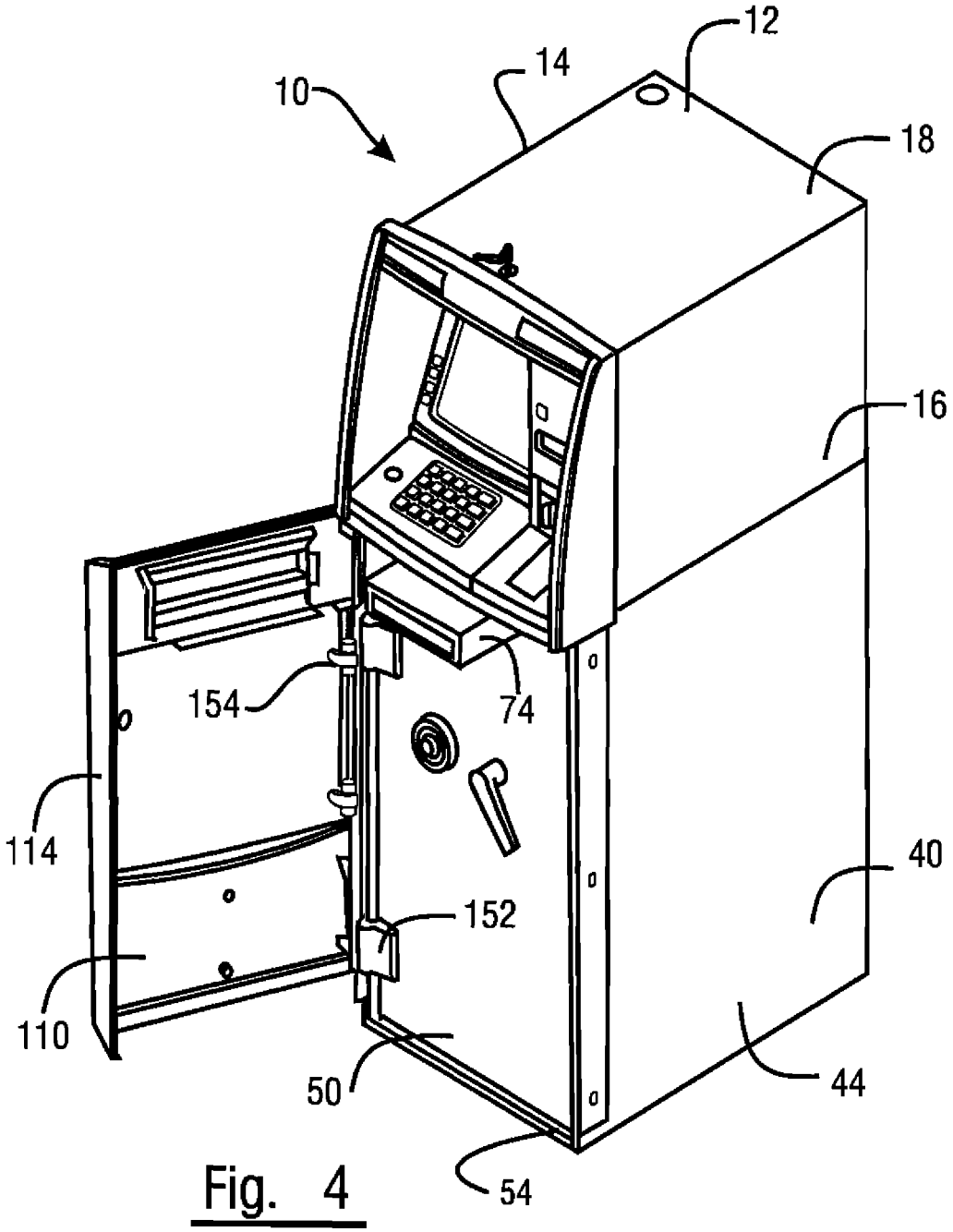
FIG. 4 is an isometric view of the automated banking machine of FIG. 1 with a lower fascia in an accessible position.
Figure 5:
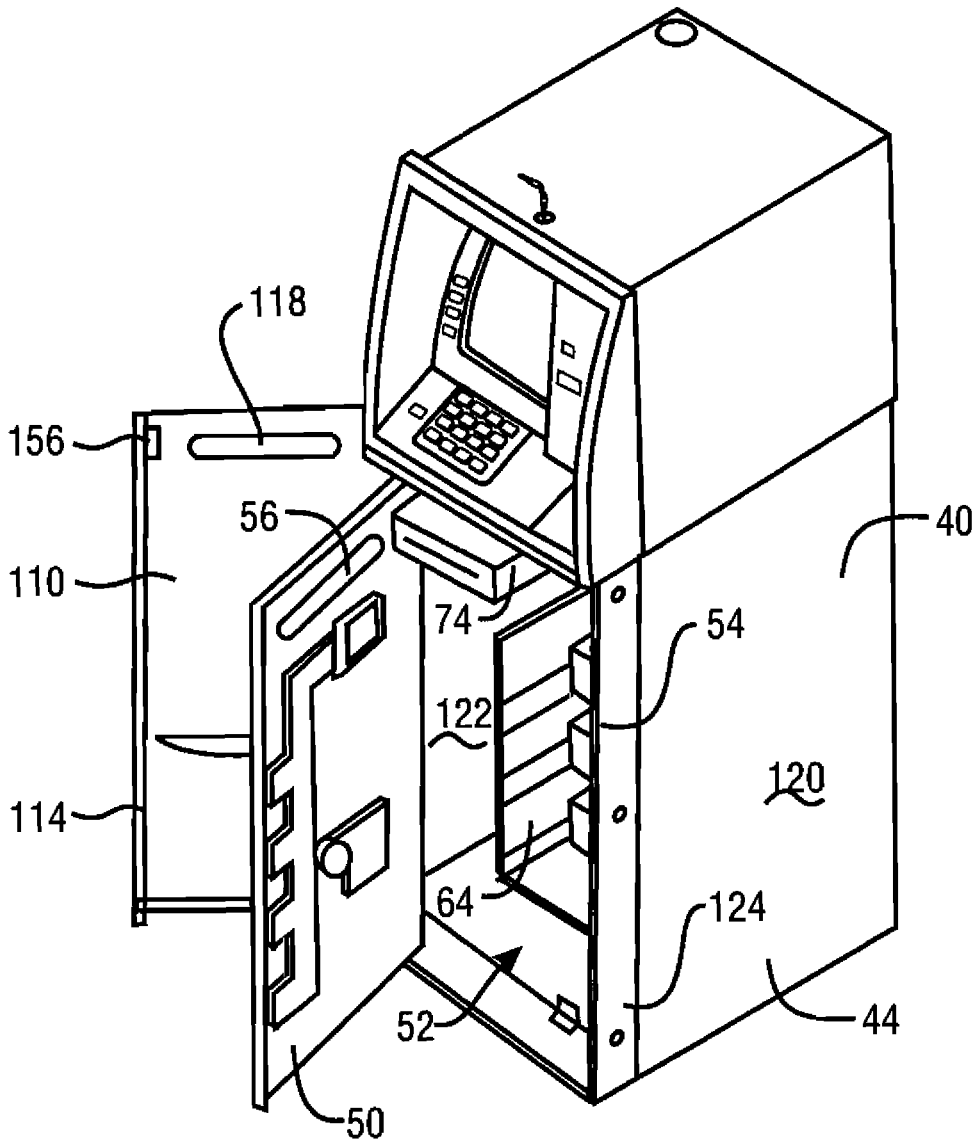
FIG. 5 is an isometric view of the automated banking machine of FIG. 1 with a lower fascia in an accessible position and a chest door in an open position.

With reference to FIGS. 1, 4 and 5, the exemplary embodiment further includes a lower fascia 110 moveably mounted on the chest housing 44. In this exemplary embodiment, lower fascia 110 is operable to move between a covering position as illustrated in FIG. 1, and an accessible position as illustrated in FIGS. 4-5. In other applications, it may be preferable to provide a selectively removable lower fascia, or other approaches to supporting the lower fascia on the chest portion.

The exemplary lower fascia 110 operates to cover the chest 40 to thereby provide a more attractive appearance to machine 10. In the exemplary embodiment, lower fascia 110 includes a front face 112 and first and second side extensions 114, 116, respectively.

In the exemplary embodiment, illustrated in FIGS. 5 and 7, chest housing 44 includes first and second side walls 120, 122, respectively. First side wall 120 includes a forward portion 124 and second side wall includes a forward portion 126 (shown in phantom in FIG. 7). When the chest door 50 is in the closed position and the lower fascia 110 is in the covering position, the first and second side extensions 114, 116, respectively, overlie forward portions 124, 126.

Thus, when machine 10 is viewed from the front (see FIG. 1), the lower fascia 110 covers the chest 40 from side to side. When machine 10 is viewed from the rear (see FIG. 7), a lower gap (not shown) between the first side extension 114 and the first side wall 120 of the chest housing 44 and a lower gap 130 between the second side extension and 116 the second side wall 122 may be visible, although such lower gaps are not viewable from the front of machine 10. In some applications, it may be desirable to minimize the lower gaps 130.

Figure 8:
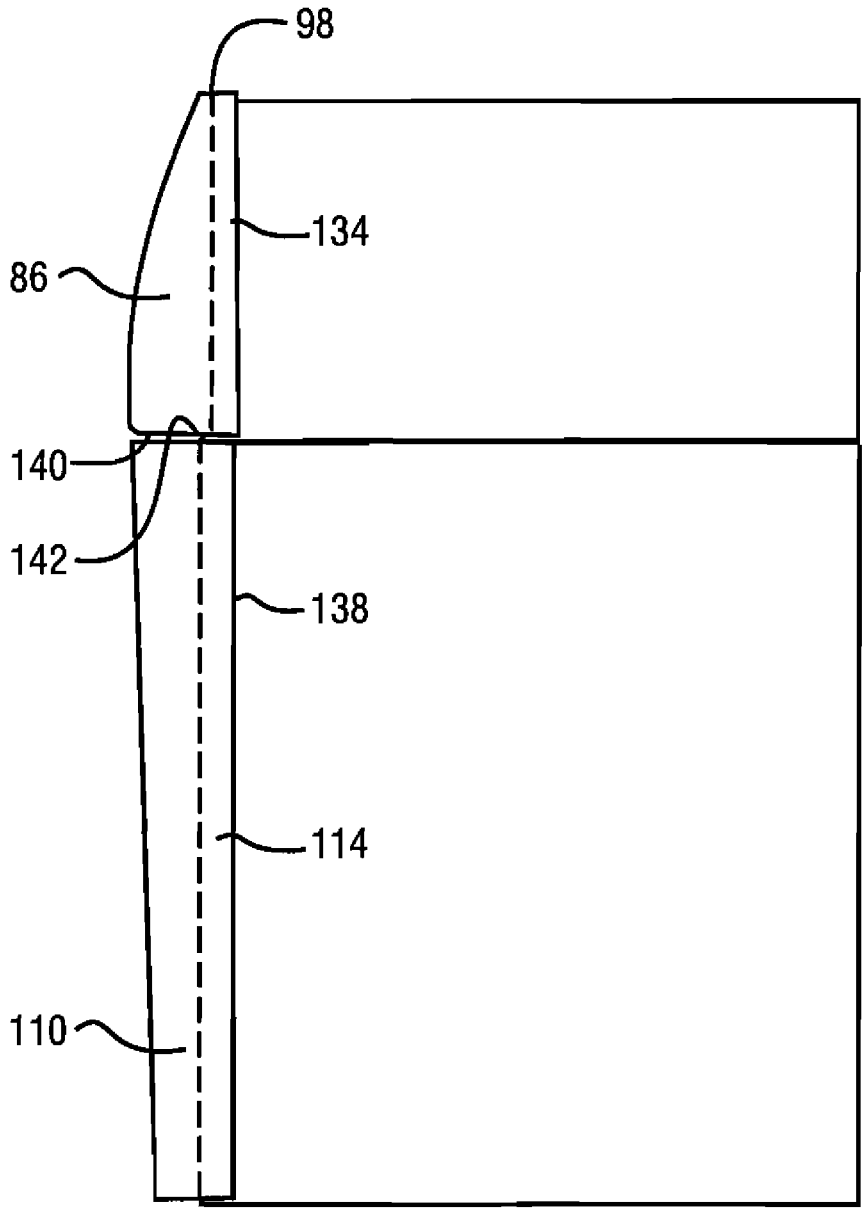
FIG. 8 is a side schematic view of an exemplary embodiment of an automated banking machine illustrating the alignment of an upper fascia and a lower fascia.

As best illustrated in FIG. 8, in the exemplary embodiment, the rearwardly extending portion 98 of upper fascia 86 includes a rearward facing end edge 134. Also, in the exemplary embodiment, first side extension 114 of lower fascia 110 includes rearward facing end edge 138. When viewed from the first side of machine 10, in the exemplary embodiment, end edge 134 of upper fascia 86 and end edge 138 of lower fascia 110 are substantially vertically aligned along a first side of machine 10 when the upper fascia 86 is in the first position and the lower fascia 110 is in the covering position.

With continued reference to FIG. 8, in the exemplary embodiment, upper fascia 86 is bounded by a lower surface 140. Lower fascia 110 is bounded by an upper surface 142. In the exemplary embodiment, lower surface 140 is adapted for substantial parallel horizontal alignment with upper surface 142 when the upper fascia 86 is in the first position and the lower fascia 110 is in the covering position. The alignment of the fascia surfaces presents an attractive appearance to machine 10.

In this exemplary embodiment, the rearwardly extending portion 98 further operates to simplify the manufacture and assembly of the machine 10. In some previous machines, it was necessary to more precisely control the alignment of the walls of the upper fascia 86 with the perimeter of the front opening. However, in this disclosed exemplary embodiment, because the rearwardly extending portion 98 overlies the forward region 94, the required precision is lessened. Further, in those embodiments which include a tapered engagement, alignment of the top housing 12 and upper fascia 86 is facilitated.

With particular reference to FIG. 5, lower fascia 110 may include an access opening 118 therein. In this exemplary embodiment, access opening 118 in the lower fascia 110 is adapted to be substantially aligned with first device opening 56 in chest door 50 when the chest door is closed and lower fascia 110 is in the covering position. In this exemplary embodiment, when the chest door 50 is closed and lower fascia 110 is in the covering position, at least an end portion of sheet delivery mechanism 74 extends in the first device opening 56 in chest door 50 and access opening 118 in lower fascia 110.

As illustrated in FIGS. 1 and 2, in this exemplary embodiment, machine 10 includes a first locking mechanism 146 for selectively retaining the rollout tray 80 in the retracted position when upper fascia 86 covers the front opening 22. The first locking mechanism may be of the type described in U.S. Pat. No. 6,082,616 the disclosure of which is incorporated herein by reference in its entirety.

In the exemplary embodiment, machine 10 also includes a second locking mechanism 148 for selectively securing lower fascia 110 in the covering position.

Figure 9:
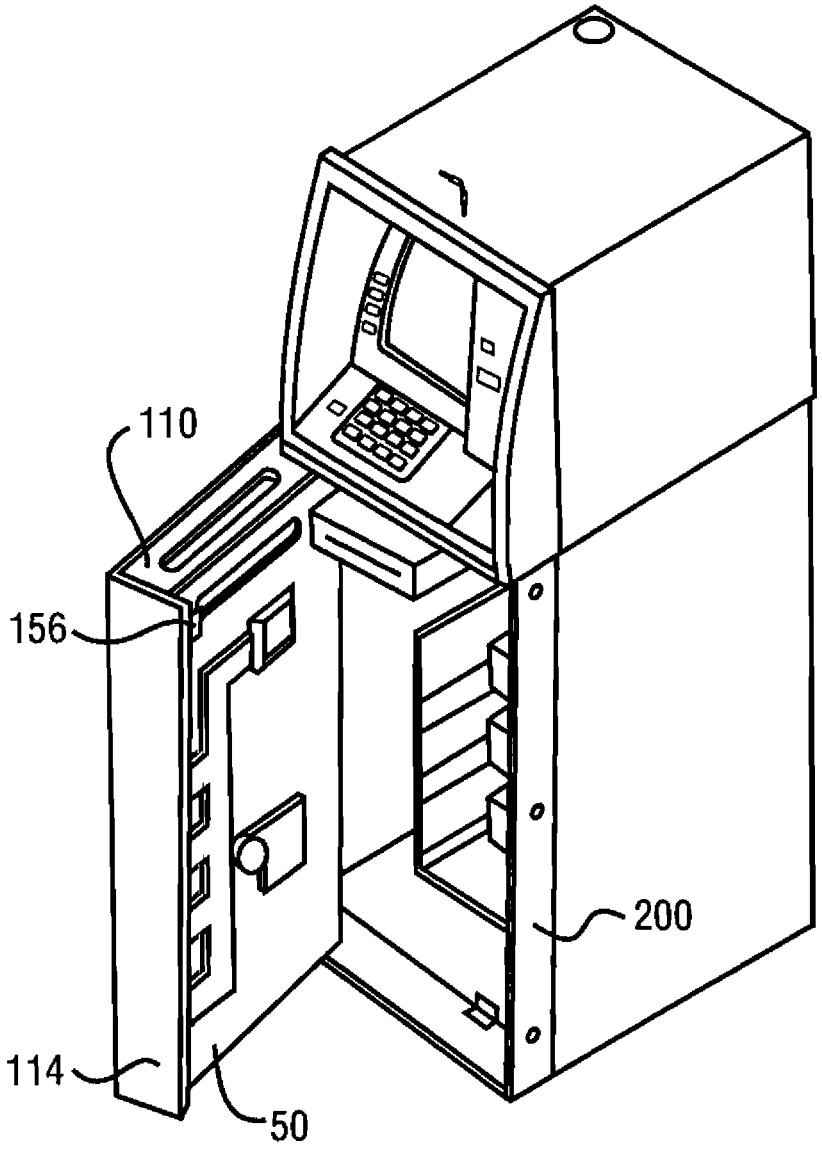
FIG. 9 is an isometric view of an automated banking machine similar to FIG. 5 showing the chest door selectively engaged with the lower fascia.

With particular reference to FIGS. 4, 5 and 9, in another exemplary embodiment machine 10 may include a top housing 12 as previously described. Machine 10 further includes chest 40 having chest door 50 mounted to the housing 44 by one or more chest door hinge assemblies 152. Lower fascia 110 is moveably mounted to chest housing 44 by one or more fascia hinges 154. In this exemplary embodiment, fascia hinge 154 and chest door hinge assembly 152 are situated on the same side of the chest housing 44 so that lower fascia 110 and chest door 50 pivot generally in the same direction relative to the chest.

From time to time, the banking machine components enclosed within secure enclosure 42 must be accessed for replenishment or other servicing activity. Thus, lower fascia 110 may be selectively moved from a covering position into an accessible position to allow access to chest door 50. Chest door 50 may then be selectively opened.

In this exemplary embodiment, as best seen in FIG. 9, lower fascia 110 is operable to engage the open chest door 50 to prevent its movement back to a closed position. In this exemplary embodiment, lower fascia 110 includes an inwardly directed flange 156 carried on an inner surface at a side opposite the fascia hinge 154. Inwardly directed flange 156 is dimensioned to engage at least a portion of chest door 50 when the lower fascia 110 is in the accessible position and the chest door 50 is in the open position. In the exemplary embodiment, lower fascia 110 is adapted to pivot away from the chest door 50 to at least an extent where the chest door may be disengaged from inwardly directed flange 156. Exemplary embodiments may include features of the type discussed in U.S. Pat. Nos. 7,159,767; 7,152,784; 7,000,830; and 6,871,602 the disclosures of each of which are incorporated herein by reference in their entirety.

An exemplary embodiment includes a method for accessing the contents of the secure area for servicing components housed therein or to replenish currency sheets. The method includes placing the lower fascia into an accessible position from a covering position to uncover the chest door; opening the chest door to provide access to the secure area through an opening in the chest housing; and engaging the chest door and the lower fascia to hold the chest door in an open condition. Thus, a currency dispenser mechanism or other components may be accessed. Servicing the currency dispenser may include adding or removing currency sheets from operative engagement with the currency dispenser mechanism.

The method may further include engaging the chest door with an inwardly directed flange that is mounted in supporting connection with the lower fascia.

To return the machine to an operational condition, the method includes moving the lower fascia outwardly relative to the engaged chest door to disengage the chest door; closing the chest door; and repositioning the lower fascia into the covering position.

Repositioning the lower fascia into the covering position includes overlying a first forward portion of the chest housing with a first side extension of the lower fascia and overlying a second forward portion of the chest housing with a second side extension of the lower fascia.

Prior to placing the lower fascia into the accessible position, the method includes unlocking a first locking mechanism operable to selectively retain the lower fascia in a covering position.

Figure 10:
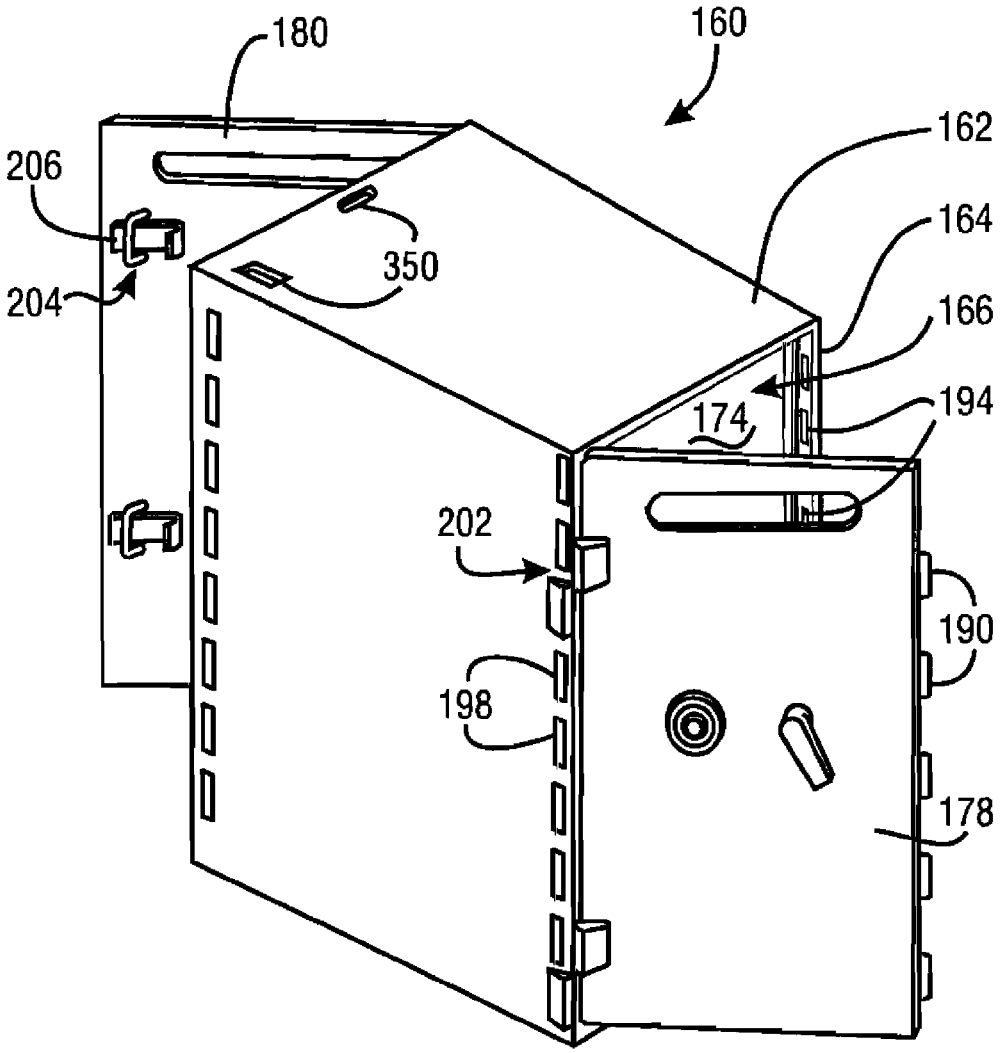
FIG. 10 is a schematic view of an alternate embodiment of a chest for an automated banking machine, as viewed from the front.
Figure 11:
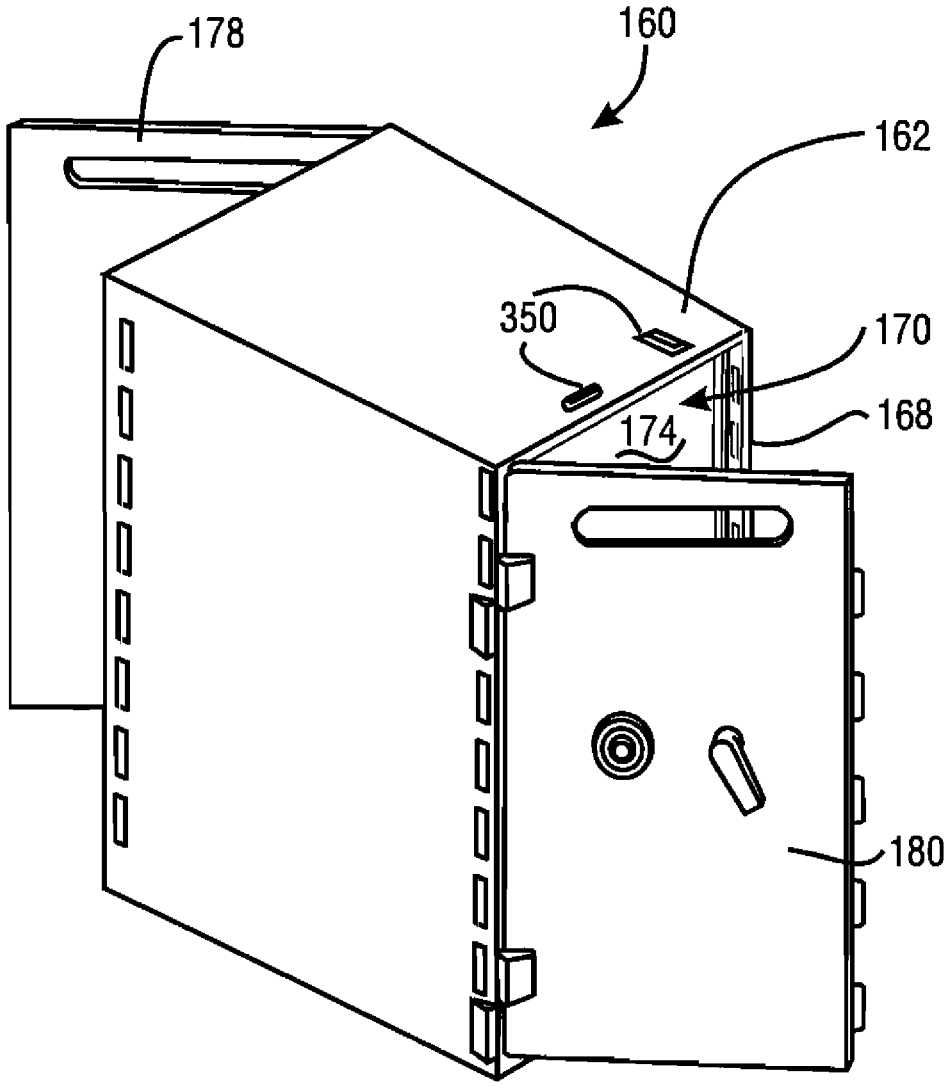
FIG. 11 is a schematic view of the alternate embodiment of the chest shown in FIG. 10, as viewed from the rear.

Some machines may be equipped with another exemplary embodiment of a chest or safe 160, as best seen in FIGS. 10-11. Chest 160 includes a chest housing 162 having a first end 164 defining a first opening 166 therein and second end 168 defining a second opening 170 therein. The chest of this exemplary embodiment is particularly adapted for applications wherein a common chest housing can be utilized in either "front-load" machines or "rear-load" machines. By "front-load" machine it is meant that access to a secure area 174 in an operable machine may be selectively attained from the front of the machine, which is the same side that customers use to provide input to the machine. By "rear-load" machine it is meant that access to the secure area 174 in an operable machine may be selectively attained from the rear of the machine, while customer inputs are provided at the front of the machine.

In this exemplary embodiment, chest 160 includes a first chest door 178 moveably mounted adjacent a first end 164 of chest housing 162 to selectively close the first opening 166. Chest 160 further includes a second chest door 180 moveably mounted adjacent the second end 168 to selectively close the second opening 170.

In the exemplary embodiment illustrated in FIG. 10, chest 160 is adapted for use in a front load machine wherein under usual operating conditions, first chest door 178 is selectively movable to open or close first opening 166 to allow access to secure area 174. In this exemplary embodiment, second chest door 180 is adapted to remain closed during usual operation of the machine, including those times when access to secure area 174 is desired. For purposes of this disclosure, the term "semi-permanently" closed is used to describe a condition of a chest door that closes an opening in the chest housing in a manner that does not readily permit access to the secure area. In this way, a "semi-permanently" closed chest door is not used as the primary means for accessing the chest interior. However, under appropriate conditions the semi-permanently closed chest door can be opened.

In this exemplary embodiment, first chest door 178 is the operable door and second chest door 180 is adapted to be semi-permanently closed. In other embodiments, for instance in rear-load machines, it may be desirable to utilize chest 160 as illustrated in FIG. 11 where the second chest door 180 is the operable door while first chest door 178 is adapted to be semi-permanently closed.

Figure 12:
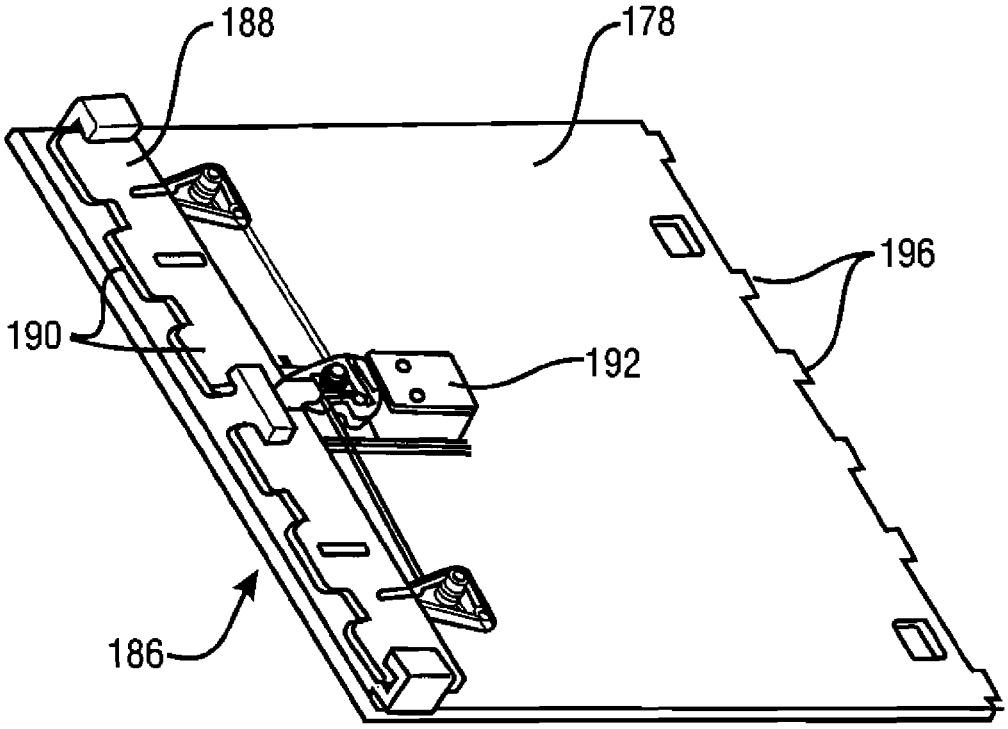
FIG. 12 is an isometric view of a chest door illustrating a locking bolt mechanism.

With particular reference to FIGS. 10 and 12, in the exemplary embodiment, the first chest door 178 is equipped with a suitable locking bolt mechanism generally denoted 186. Locking bolt mechanism 186 is operative to selectively enable securing first chest door 178 in a locked condition. Locking bolt mechanism 186 may be of the type described in U.S. Pat. No. 6,089,168 which is incorporated by reference in its entirety as if fully rewritten herein. Of course, other suitable bolt works can be utilized to accomplish the objectives.

Locking bolt mechanism 186 of the exemplary embodiment includes a locking bolt 188 which includes a plurality of locking bolt projections 190. Locking bolt 188 is mounted in operatively supported connection with an interior surface of first chest door 178 so as to be slidably movable between an extended position and a retracted position.

First chest door 178 also has a lock 192 mounted thereto. Lock 192 cooperates with locking bolt mechanism 186 so that first chest door 178 is enabled to be changed from a locked condition to an unlocked condition. As shown in FIG. 10, the chest housing 162 includes a plurality of vertically spaced locking bolt apertures 194 which are sized and positioned for accepting the locking bolt projections 190.

It will be appreciated by those skilled in the art that the locking bolt mechanism because it provides multiple places for engagement with the chest housing, achieves more secure locking of the door in the closed position than a locking bolt mechanism providing a single place for engagement with the chest housing.

In the exemplary embodiment, first chest door 178 includes a plurality of dead bolt projections 196 extending on a hinge side of the door. These dead bolt projections 196 are preferably positioned and sized to be accepted in the dead bolt apertures 198 in housing 162. As will be appreciated, the acceptance of the dead bolt projections 196 into the dead bolt apertures 198 provides enhanced security. In an exemplary embodiment, the dead bolt apertures and the locking bolt apertures are covered by trim pieces 200 (shown in FIG. 9) that extend on the outside of the housing.

With reference to FIG. 10, in the exemplary embodiment, the first chest door 178 is operably connected to the chest housing via one or more first chest hinge assemblies 202. The exemplary chest hinge assembly 202 may be of the type described in U.S. Pat. Nos. 6,089,168 and/or 7,156,297, the disclosures of which are incorporated herein in their entirety. It will be readily understood that other hinge constructions may be used in other embodiments.

In the exemplary embodiment, the second chest door 180 may be secured in a closed position by a securing mechanism that generally mirrors the locking bolt mechanism 186 and lock 192. Alternately, as illustrated in FIG. 10, second chest door 180 may be "semi-permanently" secured by an alternate securing mechanism 204. The alternate securing mechanism 204 may include a bolt member 206 or other mechanism that is less complex than the locking bolt mechanism and lock previously described. In this exemplary embodiment, routine access to the secure area 174 via second chest door 180 is not necessary during normal operation of the machine. Thus, the alternate securing mechanism 204 is operable to "semi-permanently" engage the chest door 180. This may be done, for example, by securing the bolt with fasteners or other devices that are only accessible from within the interior of the chest portion. Of course, in some alternative embodiments both chest doors may be equipped with operational locking bolt mechanisms and locks.

The manufacture of an exemplary machine may be simplified by use of chest 160. A common chest housing may be utilized in applications requiring a front-load machine or a rear-load machine. After the housing has been assembled, the positioning of a locking bolt mechanism may be chosen according to the configuration of the chest. Additionally, at a subsequent time, the operational features may be changed so that the initial operational chest door becomes the non-operational door and vice versa. Thus, the manufacturing process is simplified by the versatility of the chest housing.

Of course it will be readily appreciated that machines incorporating this exemplary embodiment of chest 160 may include any of the other features described elsewhere.

An exemplary embodiment includes a method for utilizing a machine that is equipped with a chest having two opposed openings. The chest housing includes a first opening at a first end thereof and a second opening at a second opposed end. The first door is moveably mounted in supporting connection with the chest housing so that the first chest door is operative to selectively close the first opening. A second chest door is moveably mounted in supporting connection with the chest housing so that the second door is operative to semi-permanently close the second opening. At least one lower banking machine component is mounted in supporting connection with the chest housing in the secure area.

In the exemplary method, a first locking bolt mechanism in supporting connection with the first chest door is operated to selectively securely engage the first chest door with the chest housing. A first securing mechanism in supporting connection with the second chest door is operated to semi-permanently securely engage the second chest door with the chest housing.

The method includes accessing at least one lower banking machine component of a machine through a first opening in a chest housing bounding a secure area; and preventing access to the at least one lower banking machine component through the second opening.

The method further includes replacing the first locking bolt mechanism with a second securing mechanism in supporting connection with the first chest door, wherein the second securing mechanism is operative to semi-permanently securely engage the first chest door with the chest housing; and replacing the first securing mechanism with a second locking bolt mechanism in supporting connection with the second chest door, wherein the second locking bolt mechanism is operative to selectively securely engage the second chest door with the chest housing. Thus, the door chosen as the operative door can be selected and changed.

The exemplary machine may include a lower fascia that is mounted in supporting connection with the chest housing, wherein the lower fascia is selectively movable between a covering position and an accessible position. The exemplary method may include moving the lower fascia from the covering position to the accessible position prior to accessing the lower banking machine component. Further, the method may include engaging the first chest door with the lower fascia to hold the first door in the open condition.

The at least one lower banking machine component may comprise a currency dispenser mechanism. The exemplary method includes servicing the currency dispenser mechanism after the at least one lower banking machine component is accessed. This may include for example features included in U.S. Pat. Nos. 7,195,237 and/or 7,111,776 the disclosures of each of which are incorporated herein by reference in their entirety.

The at least one lower banking machine component may comprise a currency stacker. The exemplary method includes servicing the currency stacker.

Figure 13:
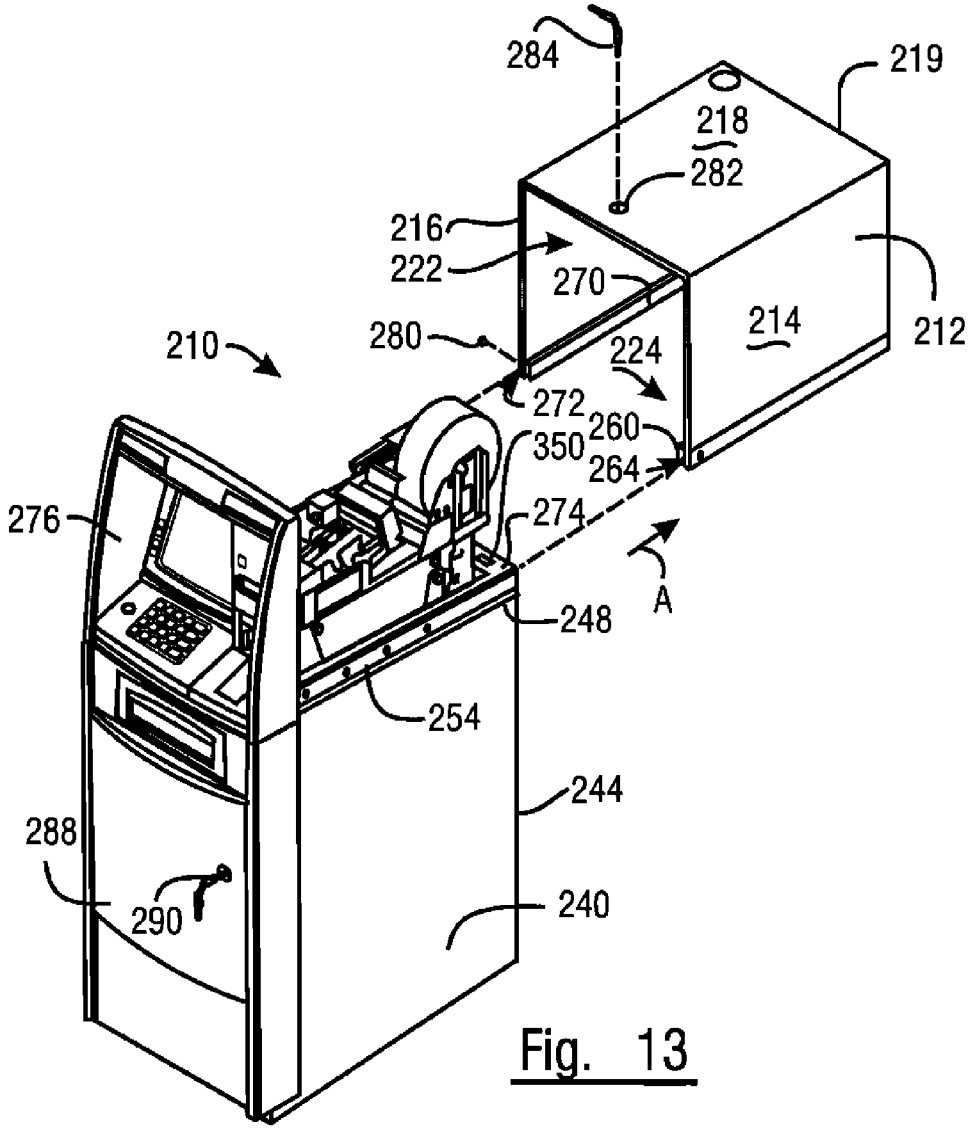
FIG. 13 is an isometric exploded view of an alternate embodiment of an automated banking machine.
Figure 14:
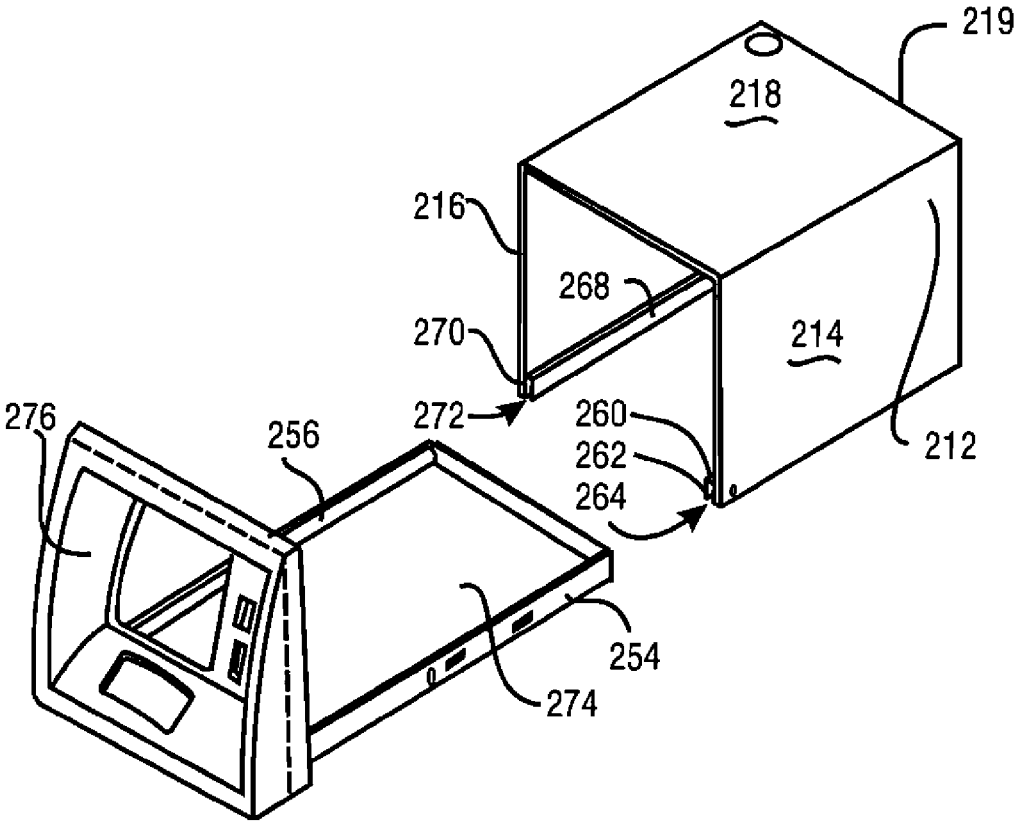
FIG. 14 is an isometric view of a top housing cover, a mounting tray and an upper fascia of an automated banking machine.
Figure 15:
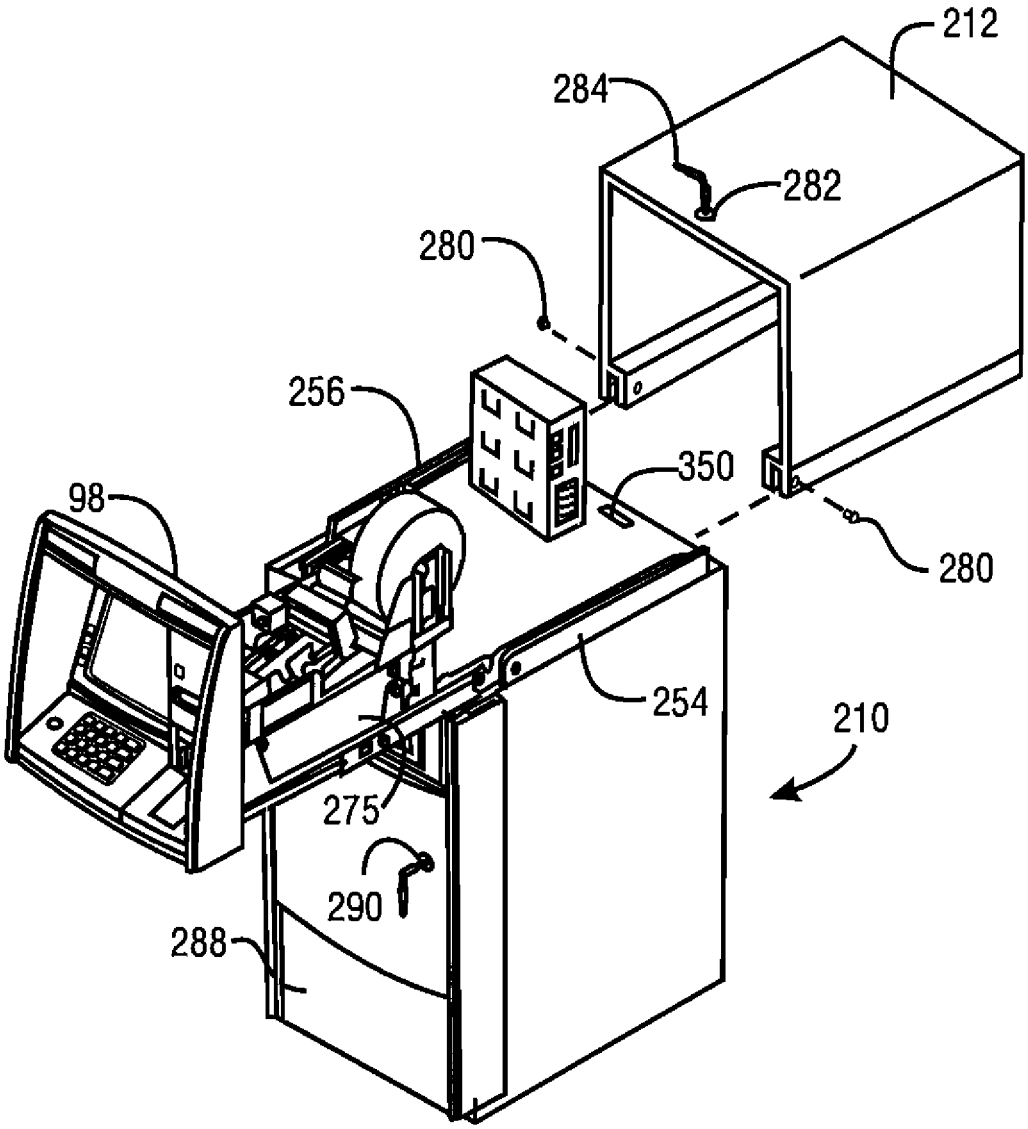
FIG. 15 is an isometric view of an alternate embodiment of an automated banking machine.

Yet another exemplary embodiment of a machine 210 is illustrated in FIGS. 13-15. machine 210 includes a top housing cover 212 including first and second side walls 214, 216, top wall 218, and rear wall 219. Top housing cover 212 defines a front opening 222 and a bottom opening 224. In a first (operable) position, top housing cover 212 covers an interior area in which various upper banking machine components such as a display, a receipt printer, a card reader, input keys, a controller, communication device, and others may be disposed.

In this exemplary embodiment, machine 210 further includes a chest 240 bounding a secure area in a manner similar to that previously described. Chest 240 includes a housing 244 having a top wall 248. Top housing cover 212 is adapted for rearward slidable movement relative to top wall 248 to a second position for service.

In this exemplary embodiment, a first upwardly extending flange member 254 is mounted in supporting connection with top wall 248 along a first side thereof. A second upwardly extending flange member 256 (not shown in this view) is mounted in supporting connection with top wall 248 along a second side thereof.

Supported on the first side wall 214 of top housing cover 212 is a first cooperating channel member 260 having a pair of spaced downwardly extending projections 262 defining a first channel 264 therebetween. Likewise, on the second side wall 216 of top housing cover 212 there is supported a second cooperating channel member 268 having a pair of spaced downwardly extending projections 270 defining a second channel 272 therebetween.

Top housing cover 212 is adapted for slidable movement relative to the top wall 248 by the slidable engagement of the first flange member 254 within first channel 264 and the slidable engagement of the second flange member 256 within second channel 272.

In this exemplary embodiment, machine 210 includes an upper fascia 276 operable to selectively cover the front opening 222. The top housing cover 212 is adapted for rearward movement relative to the top wall 248 in the direction of arrow A such that rearward displacement of the top housing cover 212 allows access to the upper banking machine components in the interior area, for example, for servicing.

It is contemplated that in exemplary embodiments the positioning of the flange members 254, 256 and the channels 264, 272 be reversed. For example, the top housing cover 212 may support flange members and the mounting tray may support cooperating channel members to accomplish a similar slidable relationship therebetween.

FIG. 14 illustrates an exemplary embodiment wherein the flange members 254, 256 are incorporated into a mounting tray 274 which is operable to receive and support one or more upper banking machine components, which for ease of illustration are not shown in this view. This embodiment allows for ease of assembly of the exemplary machine 210. The applicable upper banking machine components can be readily mounted onto mounting tray 274, which is mounted in supporting connection with top wall 248 of chest housing 244. Top housing cover 212 may thereafter be positioned by slidable movement of flange members 254, 256 in respective channels 264, 272.

In an alternate exemplary embodiment, illustrated in FIG. 15, machine 210 may include a rollout tray 275 similar to rollout tray 80 as previously described. Flange members 254, 256 may be mounted in supporting connection with rollout tray 275. Thus, upper banking machine components may be accessed by rearwardly sliding the top housing cover 212, extending the rollout tray 275, or a combination of both.

Machine 210 may further include at least one removable fastener 280 for selectively engaging the top housing cover 212 with at least one flange member 254, 256 to prevent relative slidable movement therebetween. In the exemplary embodiment, first and second fasteners 280 are used to secure the top housing cover 212.

Machine 210 may further include a first locking mechanism 282 to secure the top housing cover to upper fascia 276. In this exemplary embodiment, the locking mechanism is operable in response to a key 284. In the exemplary embodiment illustrated in FIG. 15 it is contemplated that fasteners 280 are covered by a rearwardly extending portion of the upper fascia similar to portion 98 shown in FIG. 6. Thus, fasteners 280 are not accessible from outside the machine until first locking mechanism 282 has been operated to release upper fascia 276 so that the upper fascia 276 can be moved away from top housing cover 212.

In the exemplary embodiment, machine 210 may include a lower fascia 288 with features similar to a lower fascia previously described. Lower fascia 288 may be secured in the covering position by a second locking mechanism 290.

This exemplary embodiment provides ready access to the upper banking machine components, for example, for servicing or replacing. To access the upper banking machine components, fasteners 280 are removed. It is contemplated that in an exemplary embodiment, the fasteners may not be accessible until after the first locking mechanism 282 is unlocked and the upper fascia is displaced slightly to uncover fasteners 280. In other embodiments, the fasteners may be directly accessed.

The top housing cover 212 may then be moved rearwardly, away from upper fascia 276 so that the interior area is accessible. During servicing, the top housing cover 212 may be selectively positioned so that some portion or none of the upwardly extending flanges 254, 256 remain engaged with the channel members 260, 268, respectively.

In one exemplary embodiment, a method is provided for accessing banking machine components of a machine. The exemplary method includes supporting the top housing cover in a slidable relationship with the top wall of the chest housing, wherein the top housing cover includes a front opening; selectively rearwardly sliding the top housing cover away from a first position in which an upper fascia covers the front opening; and accessing at least one upper banking machine component that is mounted in supporting connection with the top wall of the chest housing.

The exemplary method further includes removing fasteners that may be used to selectively secure the top housing cover in the first position.

The exemplary method further includes operating a locking mechanism to release the top housing cover and the upper fascia.

The exemplary method further includes accessing an upper banking machine component for servicing. The at least one upper banking machine component may be a display that is accessed for servicing.

In one embodiment the machine includes side flange members mounted in supporting connection with a top wall of a chest housing and cooperative channel members mounted in supporting connection with the top housing cover. In this exemplary embodiment, the method further includes slidably engaging a first flange member with a first channel of a first channel member.

Figure 16:
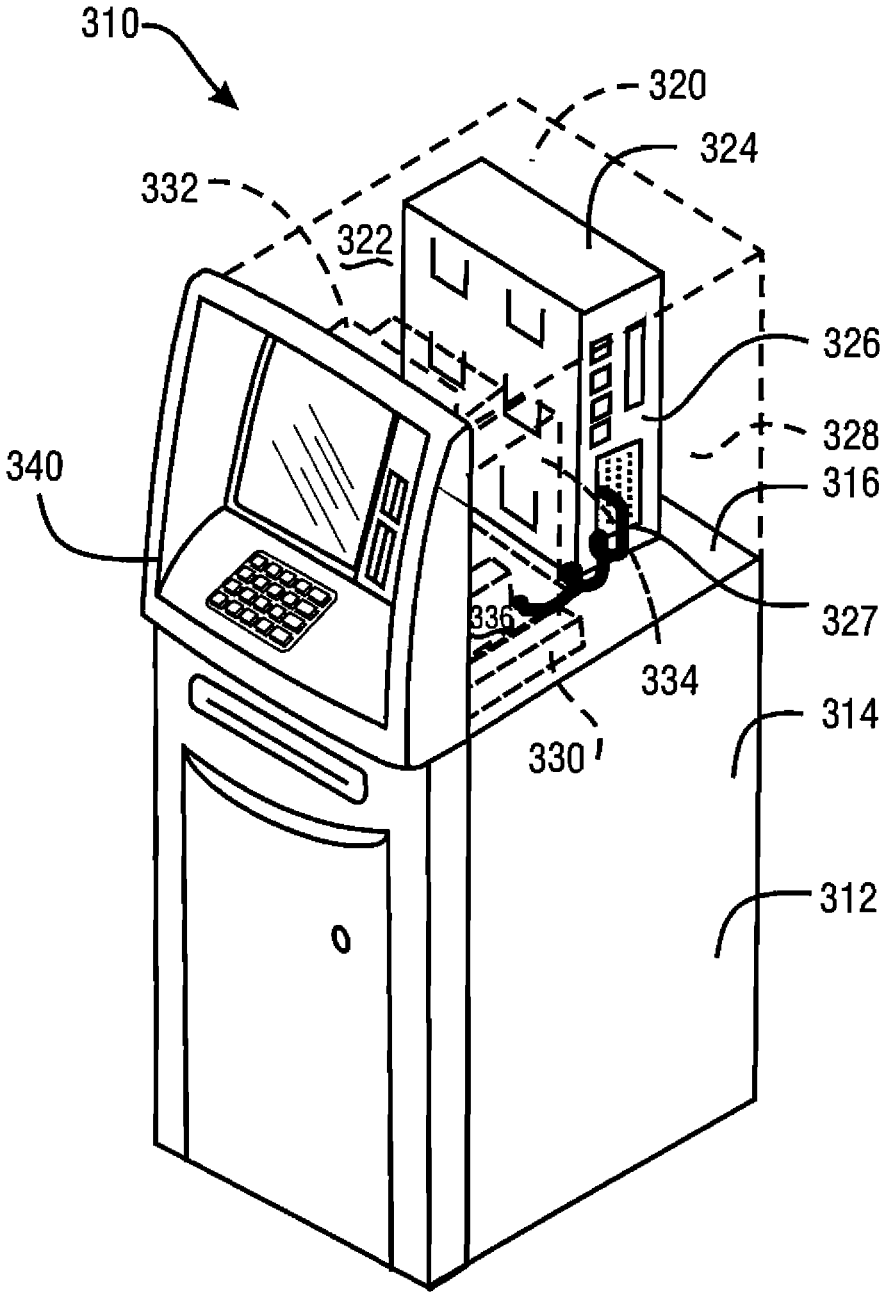
FIG. 16 is an isometric view, partly in phantom, of an alternate exemplary embodiment of an automated banking machine in an operational condition.
Figure 17:
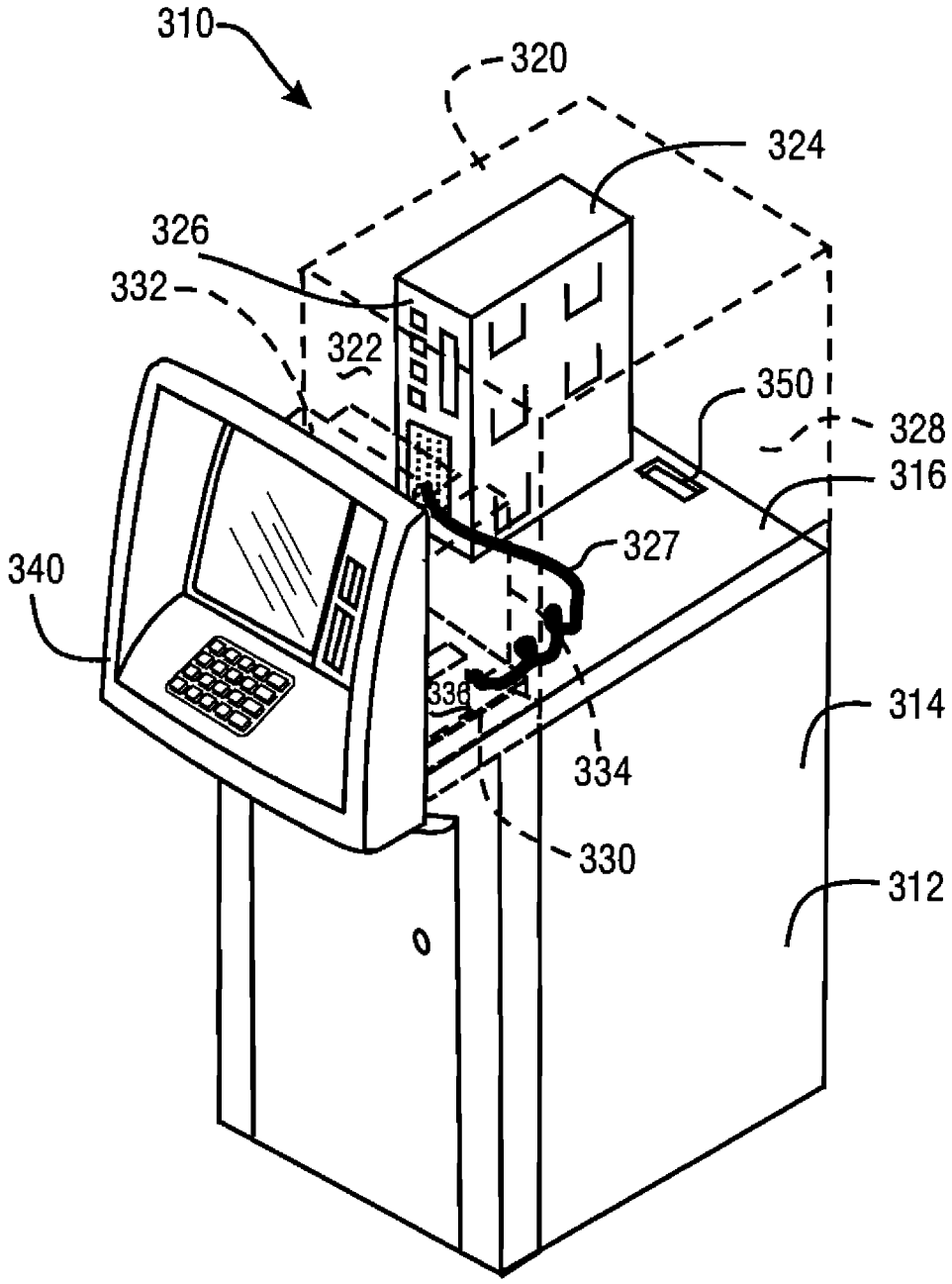
FIG. 17 is an isometric view, partly in phantom, of the automated banking machine of FIG. 16, in a serviceable condition.

In another exemplary embodiment, illustrated in FIGS. 16 and 17, machine 310 may include a chest 312 having a chest housing 314 including top wall 316. As in previously described embodiments, chest housing 314 bounds a secure area which holds lower banking machine components including a currency dispenser mechanism which may be similar to mechanism 64 shown in FIG. 3. machine 310 further includes a top housing 320 (shown in phantom) bounding an interior area 322.

In this exemplary embodiment, machine 310 includes a processor case 324 that houses the primary machine processor. The processor may be an Intel Pentium (PL type) processor. Of course, in some embodiments the case may house multiple processor or no processors at all. The machine processor causes operation of the various devices and mechanisms in the machine.

In this exemplary embodiment, processor case 324 is in supporting connection with top wall 316 of chest housing 314. Processor case 324 includes a first functional side 326 that is operable to establish connections, such as through cable 327, from the various banking machine components. Other processor components, including but not limited to circuit cards having various functions, additional processors, drives (CD, DVD, floppy), power supplies, memory, or encryption cards, may be carried on or within processor case 324. Such components may also be accessed, removed and/or replaced and routine maintenance performed through access to the functional side of the processor case.

In order to minimize the space occupied by machine 310, it is advantageous to orient processor case 324 of the exemplary embodiment so that the first functional side 326 is substantially parallel to a first side wall 328 (shown in phantom) of top housing 320. However, in order to easily access first functional side 326 for servicing or connecting cables, it is advantageous to orient processor case 324 so that the first functional side 326 is substantially perpendicular to the first side wall 328, facing the front opening of the machine. In order to accomplish both these purposes, the processor case 324 of the exemplary embodiment is rotationally supported in connection with the top wall 316 of the chest housing 314. The processor case 324 is selectively rotationally movable between an operational position, shown in FIG. 17, wherein the first functional side 326 is substantially parallel to the first side wall 328, and a service position, shown in FIG. 16, wherein the first functional side 326 is substantially perpendicular to the first side wall 328.

In this exemplary embodiment, a rollout tray 330 is supported on the top wall 316 of the chest housing 314. As in earlier described exemplary embodiments, the rollout tray 330 is selectively movable between a retracted position wherein the rollout tray 330 is within the interior area 322, and an extended position wherein the rollout tray 330 extends outwardly from the interior area through a front opening in the top housing 320. In the exemplary embodiment, various upper banking machine components such as display 332, receipt printer 334, and card reader 336 are supported on rollout tray 330. Also, an upper fascia 340 may be mounted in supporting connection with rollout tray 330. As in other described embodiments, when the rollout tray is in the retracted position, the upper fascia 340 covers the front opening in the top housing.

In the exemplary embodiment, when rollout tray 330 is in the retracted position, as illustrated in FIG. 16, the processor case 324 is prevented from rotating from the operational position to the service position. When the rollout tray 330 is in the extended position, as illustrated in FIG. 17, there is enough clearance in the interior area 322 to permit the processor case 324 to be rotated into the service position. Thus, when the rollout tray 330 is in the extended position, the upper banking machine components supported thereon are readily accessible for service. Likewise, the cable connections and any processor components carried on the processor case are accessible for service.

In a method for servicing banking machine components of a machine, a rollout tray 80 mounted in supporting connection with a top housing 320 is extended from a retracted position so that the rollout tray extends through a front opening in the top housing 320. The method includes disengaging any locking mechanisms that operate to retain the rollout tray 80 in the retracted position.

A processor case 324 disposed in an interior area 322 bounded by the top housing 320 may be rotated from an operational position to a service position. At least one processor component mounted in supporting connection with the processor case 324 may be accessed for servicing. After servicing of the processor component is complete, the processor case 324 may be rotationally returned to the operational position from the service position. Thereafter, the rollout tray 80 may be repositioned into the retracted position.

The step of servicing the processor component may include connecting or disconnecting cables or connections, adding or replacing components such as circuit cards, performing diagnostic tests and other functions to facilitate operation of the machine.

Prior to repositioning the rollout tray 80, other banking machine components may be serviced while the rollout tray is extended. For example, a display, card reader, and receipt printer assembly are readily accessible for service. The service can include routine maintenance, replacement of non-working components, addition of other banking machine components, and the like. Connections with the processor can be readily made while the rollout tray is in the extended position and the processor case is in the service position.

The machine may include a slidable top housing cover 212 as earlier described. The service method includes the step of rearwardly sliding the top housing cover 212. After the servicing of banking machine components is completed, the method includes returning the top housing cover 212 to an operational position.

During servicing of the machine, the lower banking machine components may also be accessed for servicing. The service method includes disengaging any locking mechanisms that retain the lower fascia in a covering position. The lower fascia may thereafter be moved into the accessible position. The locking bolt mechanism that securely engages the chest door with the chest housing may be disengaged so that the chest door may be placed in the open position.

An exemplary method further includes the step of engaging the chest door with the lower fascia when the chest door is in the open position and the lower fascia is in the accessible position in order to retain the door in the open position.

The lower banking machine includes components such as a currency stacker, currency dispenser mechanism, and currency delivery mechanism (as shown in FIG. 3). An exemplary service method includes performing routine maintenance, replenishing currency, removing sheets, disengaging sheets from the currency dispenser mechanism, replacing components and the like.

The machine can include connections and/or cables that extend between the processor case and lower banking machine components that are generally housed within the secure chest. The chest housing may include various openings 350 through the walls to accommodate the connections and/or cables (FIGS. 10-11 and 17). When the processor case is in the service position, the connections can be readily established, maintained and/or changed.

An exemplary method of constructing a machine apparatus is provided. The exemplary method includes mounting a top housing in supporting connection with a chest adapted for use in an automated banking machine apparatus. A first chest door is operable to selectively close a first opening in the chest housing.

The method further includes mounting an upper fascia in supporting connection with the top housing and mounting a lower fascia in movable supporting connection with the chest housing.

The upper fascia and the top housing are selectively positioned relative each other so that a front opening in the top housing is selectively covered by the upper fascia, and wherein a rearwardly extending portion of the upper fascia overlies a forward region of the top housing.

The lower fascia is selectively positioned in a covering position relative a chest door wherein a first side extension of the lower fascia overlies a first forward portion of the chest housing and wherein a second side extension of the lower fascia overlies a second forward portion of the chest housing.

In an exemplary method, a lower edge surface of the upper fascia is placed in substantially parallel alignment with an upper edge surface of the lower fascia and an end edge of a rearwardly extending portion of the upper fascia is substantially vertically aligned with an end edge of a first side extension of the lower fascia at a first side of the machine.

In an exemplary method, a second chest door is moveably mounted in supporting connection with the chest housing to operably close a second opening in the chest housing. A first locking bolt mechanism may be mounted to the first chest door and an alternate securing mechanism may be mounted to the second chest door.

In an exemplary method, a processor case is mounted in supporting rotational connection with a top wall of the chest housing wherein the processor case is selectively movable between an operational position and a service position, and wherein the processor case houses at least one processor.

In an exemplary method, at least one upper banking machine component is mounted in supporting connection with a rollout tray which is mounted in movable supporting connection with the chest housing, wherein the rollout tray is selectively movable between a retracted position wherein the rollout tray is within an interior area, and an extended position wherein the rollout tray extends outwardly from the interior area through the front opening in the top housing.

The exemplary method includes selectively placing the rollout tray in the extended position, selectively rotating the processor case into the service position, and establishing an operable connection between the at least one upper banking machine component and the at least one processor.

In an exemplary method, the lower fascia is equipped with an inwardly extending flange operative to selectively engage the chest door when the lower fascia is in the accessible position and the chest door is in the open position.

Figure 18:
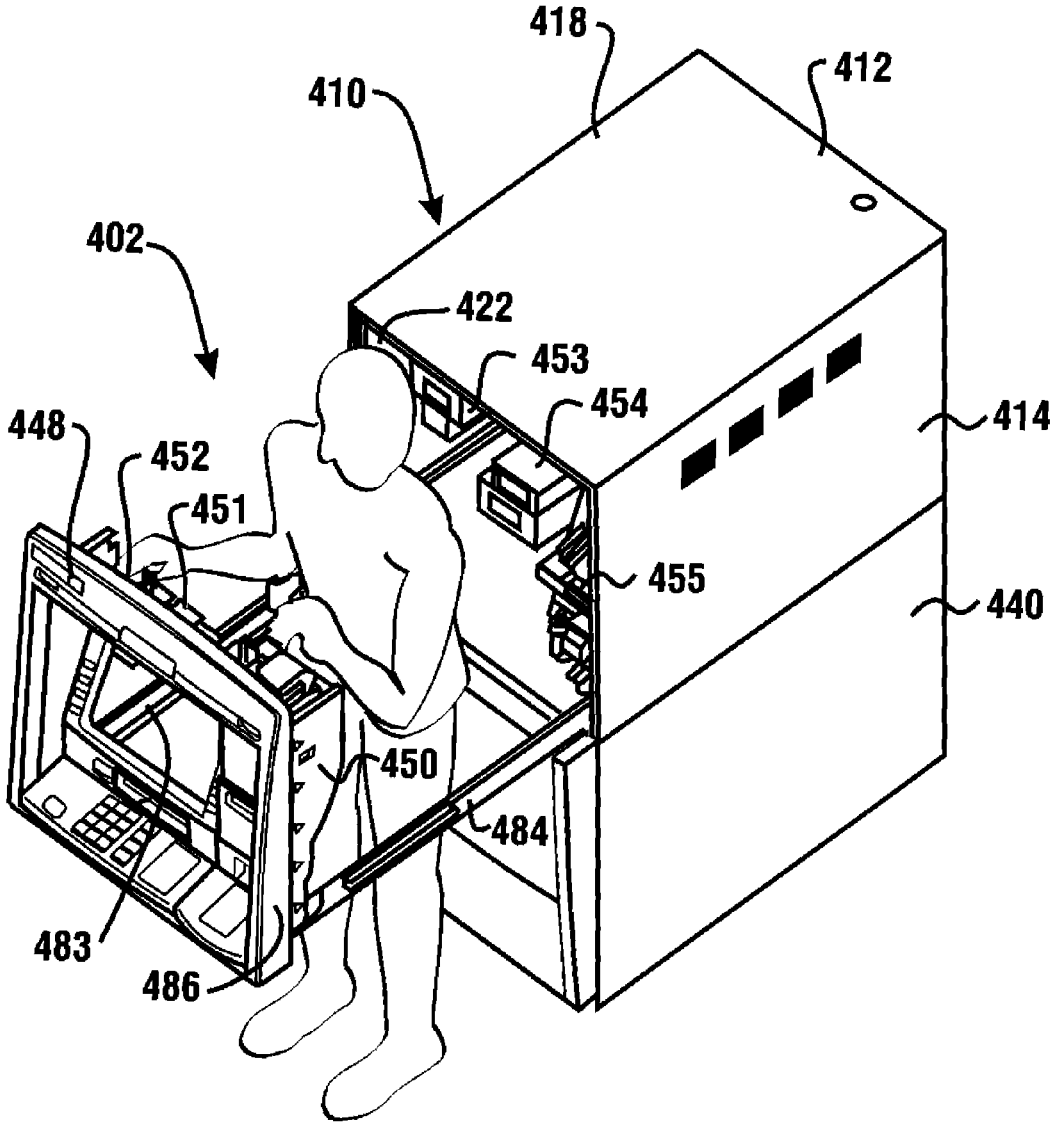
FIG. 18 is an isometric view of an automated banking machine of an exemplary embodiment.

With reference to FIG. 18, in this exemplary embodiment there is shown therein an automated banking machine, generally indicated as 410. In this exemplary embodiment, the automated banking machine 410 is an automated teller machine (machine). The machine 410 includes a housing 412 mounted atop a chest 440. The housing 412 includes a first side wall 414, a second side wall 416 (FIG. 19), a rear wall or panel 419, and a top wall 418, and defines a front opening 422. A fascia 486 is adapted to cover the front opening 422 of the housing 412 and may be secured to the housing 412 with a lock 448. The fascia 486 is in operatively supported connection with the housing 412 and is operatively supported by the housing 412 through two horizontally disposed members 483, 484. As will be appreciated by those skilled in the art, the fascia 486 may additionally or alternatively be secured to the chest 440. In an exemplary embodiment, the two horizontally disposed members 483, 484 are slidable members adapted to enable the fascia 486 to be moved away from the front opening 422 of the housing 412. Further, the fascia 486, when moved away from the front opening 422, cooperates with the housing 412 and the two horizontally disposed members 483, 484 to define a space which may be at least partially occupied by a servicer 402 while servicing the machine 410. Various serviceable components, generally identified in FIG. 18 as components 450-455, may be supported by the fascia 486, the housing 412, the chest 440, or combinations thereof.

Figure 19:
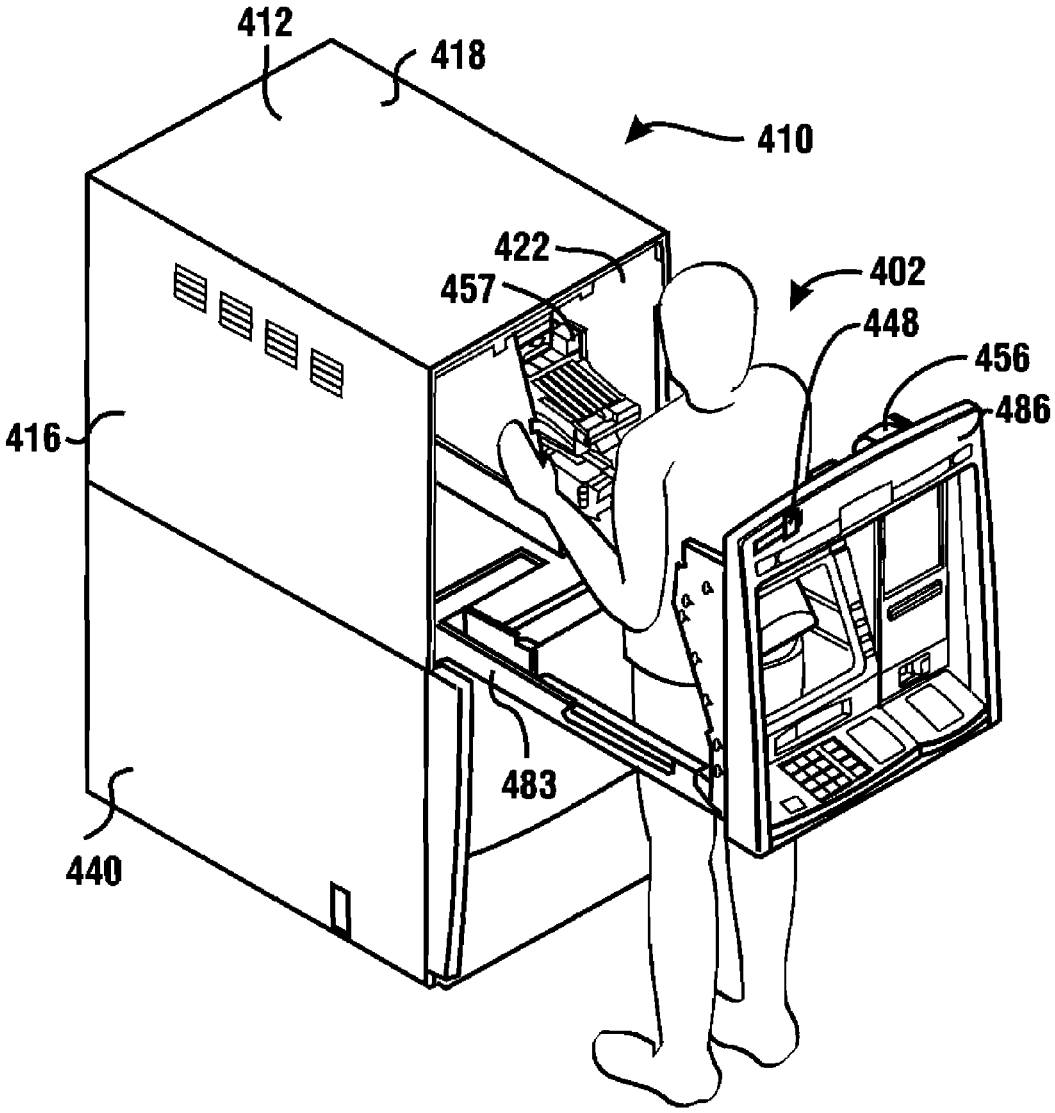
FIG. 19 is a further isometric view of the automated banking machine of the exemplary embodiment shown in FIG. 18.

With reference to FIG. 19, there is shown a further view of the exemplary embodiment of the machine 410 described under FIG. 18. Shown is the servicer 402 at least partially occupying the space defined by the fascia 486, the housing 412, and the two horizontally disposed members 483, 484.

Figure 20:
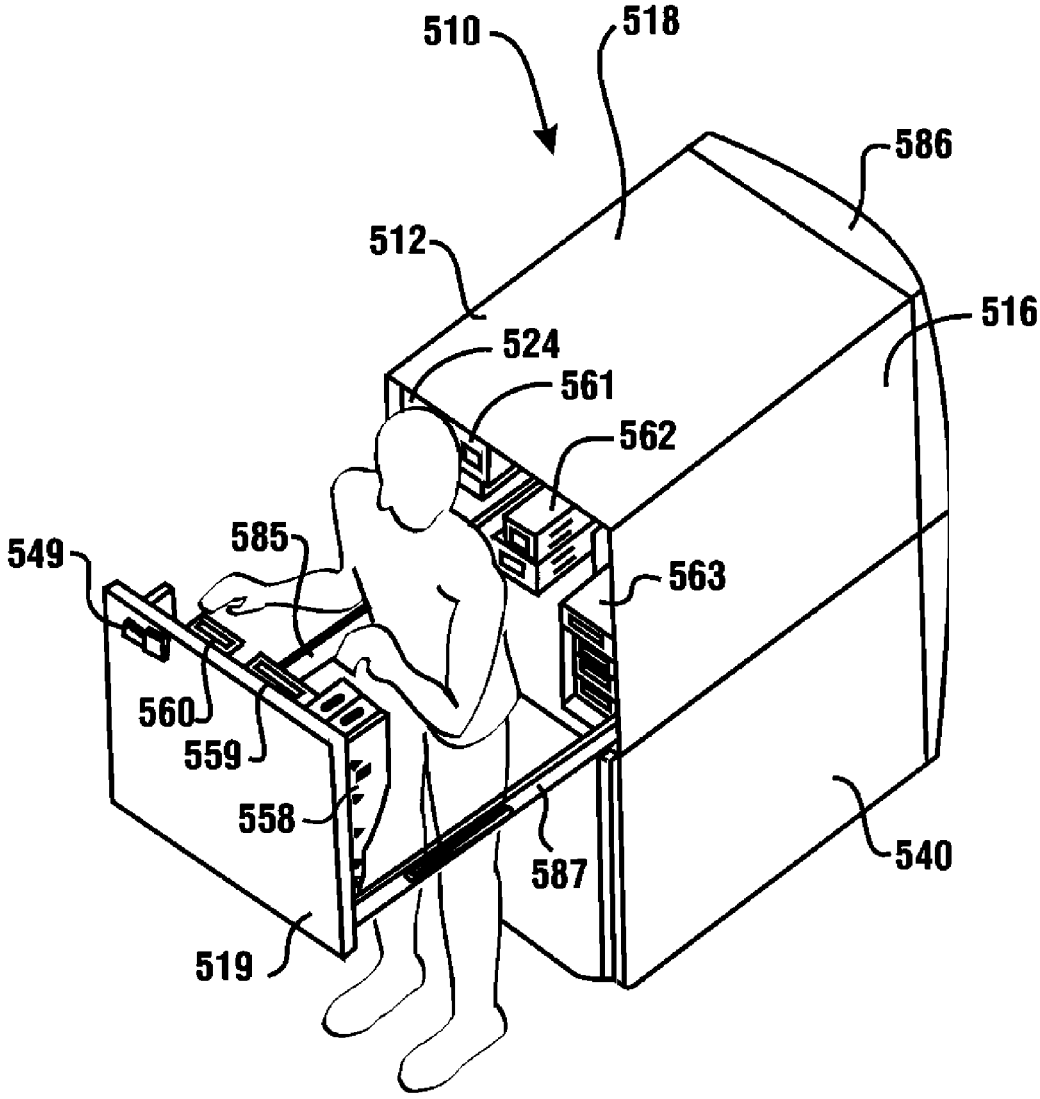
FIG. 20 is an isometric view of an automated banking machine of an exemplary embodiment.

With reference to FIG. 20, in this exemplary embodiment there is shown therein an automated banking machine, generally indicated as 510. In this exemplary embodiment, the automated banking machine 510 is an automated teller machine (machine). The machine 510 includes a housing 512 mounted atop a chest 540. The housing 512 includes a first side wall 514 (not shown), a second side wall 516, and a top wall 518, and defines a rear opening 524. A rear panel 519 is adapted to cover the rear opening 524 of the housing 512 and may be secured to the housing 512 with a lock 549. The rear panel 519 is in operatively supported connection with the housing 512 and is operatively supported by the housing 512 through two-horizontally disposed members 585, 587. In an exemplary embodiment, the two horizontally disposed members 585, 587 are slidable members adapted to enable the rear panel 519 to be moved away from the rear opening 524 of the housing 512. Further, the rear panel 519, when moved away from the rear opening 524, cooperates with the housing 512 and the two horizontally disposed members 585, 587 to define a space which may be at least partially occupied by the servicer 402 while servicing the machine 510. Various serviceable components, generally identified in FIG. 20 as components 558-563, may be supported by the rear panel 519, the housing 512, the chest 540, or combinations thereof.

Figure 21:
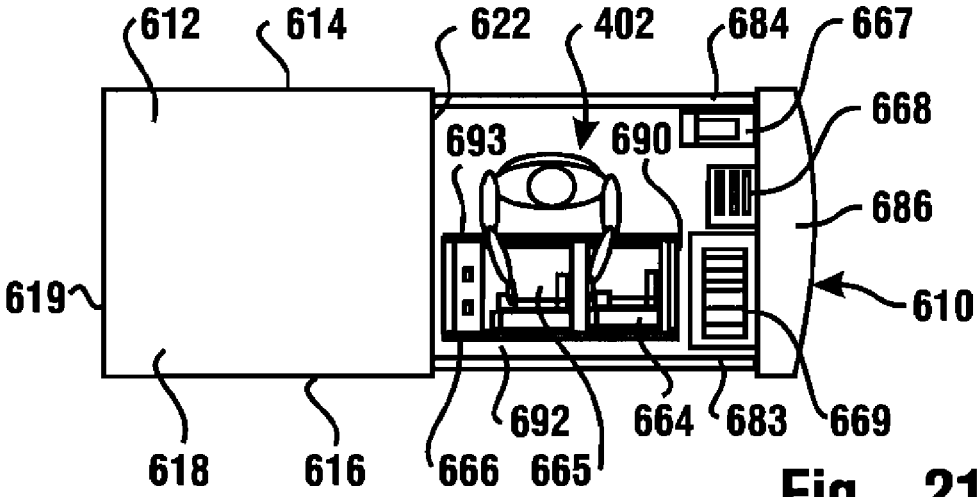
FIG. 21 is a plan view of an automated banking machine of an exemplary embodiment.

With reference to FIG. 21, in this exemplary embodiment there is shown therein an automated banking machine, generally indicated as 610. In this exemplary embodiment, the automated banking machine 610 is an automated transaction machine (machine). The machine 610 includes a housing 612 mounted atop a chest (not shown). The housing 612 includes a first side wall 614, a second side wall 616, a rear wall 619, and a top wall 618, and defines a front opening 622. A fascia 686 is adapted to cover the front opening 622 of the housing 612 and may be secured to the housing 612 with a lock (not shown). The fascia 686 is in operatively supported connection with the housing 612 and is operatively supported by the housing 612 through two horizontally disposed members 683, 684. In an exemplary embodiment, the two horizontally disposed members 683, 684 are slidable members adapted to enable the fascia 686 to be moved away from the front opening 622 of the housing 612. Further, the fascia 686, when moved away from the front opening, 622, cooperates with the housing 612 and the two horizontally disposed members 683, 684 to define a space which may be at least partially occupied by the servicer 402 while servicing the machine 610. Various serviceable components, generally identified in FIG. 21 as components 664-669, may be supported by the fascia 686, the housing 612, the chest (not shown), or combinations thereof.

Also shown in FIG. 21, is an exemplary embodiment of a moveable component tray 690. The moveable component tray 690 may support one or more components, generally 664-666. The tray 690 is in operatively supported connection with the housing 612 and is operatively supported by the housing 612 through two horizontally disposed members 692, 693. In an exemplary embodiment, the two horizontally disposed members 692, 693 are slidable members adapted to enable the one or more components, generally 664-669, and their support tray 690 to be moved away from the housing 612 for servicing by the servicer 402. Even when the support tray 690 is moved away from the housing 612, the housing 612, the tray 690, one of the horizontally disposed members 684, for example, and the fascia 686 cooperate to define a space which may be at least partially occupied by the servicer 402. As will be appreciated by those skilled in the relevant art, the moveable tray 690 described herein and illustrated in FIG. 21 may also or additionally be included in a rear-access housing as illustrated in exemplary fashion in FIG. 20. As will also be appreciated by those skilled in the art, the support tray 690 may be disposed in a vertical orientation.

Figure 22:
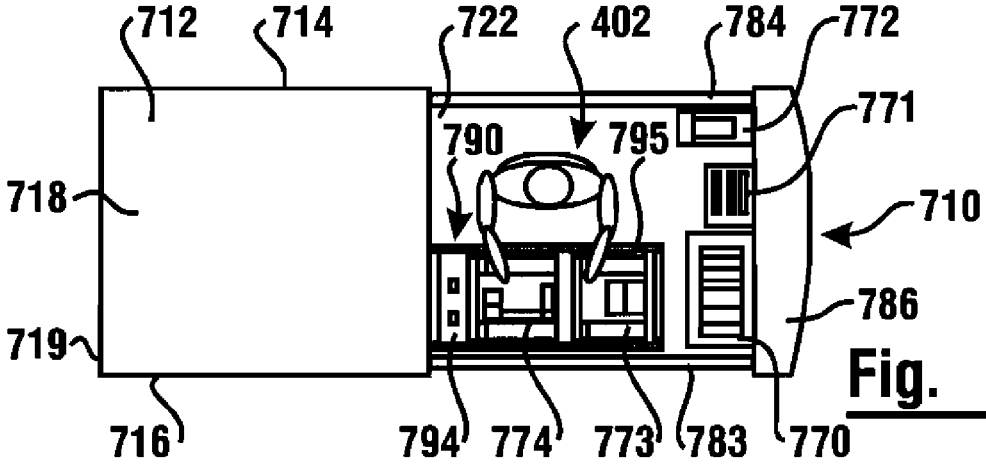
FIG. 22 is a plan view of an automated banking machine of an exemplary embodiment.

With reference to FIG. 22, in this exemplary embodiment there is shown therein an automated banking machine, generally indicated as 710. In this exemplary embodiment, the automated banking machine 710 is an automated teller machine (machine). The machine 710 includes a housing 712 mounted atop a chest (not shown). The housing 712 includes a first side wall 714, a second side wall 716, a rear wall 719, and a top wall 718, and defines a front opening 722. A fascia 786 is adapted to cover the front opening 722 of the housing 712 and may be secured to the housing 712 with a lock (not shown). The fascia 786 is in operatively supported connection with the housing 712 and is operatively supported by the housing 712 through two horizontally disposed members 783, 784. In an exemplary embodiment, the two horizontally disposed members 783, 784 are slidable members adapted to enable the fascia 786 to be moved away from the front opening 722 of the housing 712. Further, the fascia 786, when moved away from the front opening 722, cooperates with the housing 712 and the two horizontally disposed members 783, 784 to define a space which may be at least partially occupied by the servicer 402 while servicing the machine 710. Various serviceable components, generally identified in FIG. 22 as components 770-775, may be supported by the fascia 786, the housing 712, the chest (not shown), or combinations thereof.

Also shown in FIG. 22, is an exemplary embodiment of a moveable component rack 790. The moveable component rack 790 may support one or more serviceable components, generally 773-775. The rack 790 is in operatively supported connection with the housing 712 and is operatively supported by the housing 712 through two horizontally disposed members 794, 795. In an exemplary embodiment, the two horizontally disposed members 794, 795 are slidable members adapted to enable the one or more components, generally 773-775, and their supporting rack 790 to be moved away from the housing 712 for servicing by the servicer 402. Even when the supporting rack 790 is moved away from the housing 712, the housing 712, the rack 790, one of the horizontally disposed members 784, for example, and the fascia 786 cooperate to define a space which may be at least partially occupied by the servicer 402. As will be appreciated by those skilled in the relevant art, the moveable rack 790 described herein and illustrated in FIG. 22 may also or additionally be included in a rear-access housing as illustrated in exemplary fashion in FIG. 20. As will also be appreciated by those skilled in the art, the supporting rack 790 may be disposed in a vertical direction.

Figure 23:
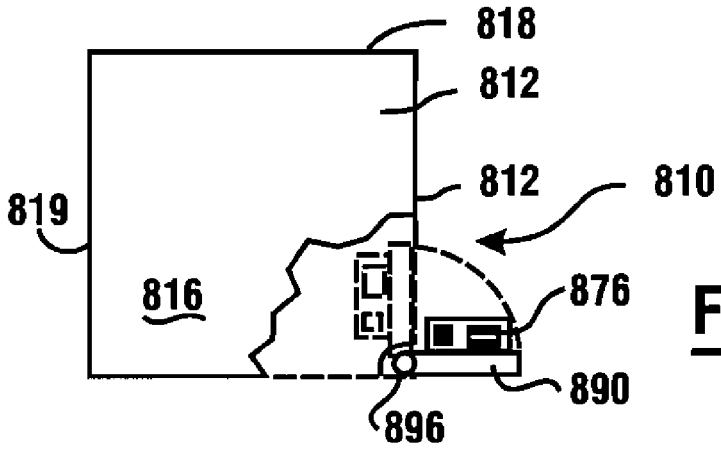
FIG. 23 is an elevation view, partly in phantom, of a portion of an automated banking machine of an exemplary embodiment.

With reference to FIG. 23, in this exemplary embodiment there is shown therein a portion of an automated banking machine, generally indicated as 810. In this exemplary embodiment, the automated banking machine 810 is an automated teller machine (machine). The machine 810 includes a housing 812 mounted atop a chest (not shown). The housing includes a first side wall (not shown), a second side wall 816, a rear wall 819, and a top wall 818, and defines a front opening 822. Also shown in FIG. 23, is an exemplary embodiment of a pivotable component rack 890. The pivotable component rack 890 is in operatively supported connection with the housing 812 and is operatively supported by the housing 812 through a pivot 896. The pivotable component rack 890 may support one or more serviceable components, generally 876. The pivot 896 is adapted to enable the one or more components, generally 876, and their pivotable component rack 890 to be moved away from the housing 812 for servicing by the servicer 402. As will be appreciated by those skilled in the art, the pivot 896 may alternatively be disposed in a vertical orientation.

An exemplary embodiment includes a method for accessing and servicing the contents, and particularly the serviceable components, of the housing to, but not limited to, clean, repair, or replace parts, make adjustments, replenish consumables such as paper, print materials, and lubricants, or exchange components. The method includes releasing the lock holding the cover adjacent to the opening of the housing of the automated banking machine and moving the cover away from the housing, wherein the cover remains in operatively supported connection with the housing, and wherein the cover is operatively supported by the housing through two horizontally disposed members. In an exemplary embodiment, the members are slidable horizontally disposed members and the method includes the step of sliding the cover away from the housing. The method further includes standing between the two horizontally disposed members and servicing at least one serviceable component of the automated banking machine. In a further exemplary embodiment, the method includes moving out from between the two horizontally disposed members, moving the cover back toward the housing, whereby the cover is positioned adjacent the housing opening, and securing the lock.

In a further exemplary embodiment, the method further includes moving the at least one component away from the housing for servicing. In a further exemplary embodiment, the step of moving the at least one component away from the housing includes sliding the at least one component away from the housing, pivoting at least a portion of the at least one component away from the housing, sliding a tray supporting the at least one component away from the housing, and sliding a rack supporting the at least one component away from the housing while standing between the two horizontally disposed members.

In a further exemplary embodiment, the method further includes moving the at least one component back into the housing after servicing. In a further exemplary embodiment, the step of moving the at least one component back into the housing includes sliding the at least one component back into the housing, pivoting the at least one portion of the at least one component back into the housing, sliding the tray supporting the at least one component back into the housing, and sliding the rack supporting the at least one component back into the housing while standing between the two horizontally disposed members.

As will be appreciated by those skilled in the art, the at least one component may alternatively be in operatively supported connection with the cover and the method include moving the at least one component moved away from the cover for servicing, servicing the at least one component, and subsequently moving the at least one component back to the cover. As will also be appreciated by those skilled in the art, the cover may comprise a fascia or a rear panel.

Exemplary embodiments may also include features described in U.S. Pat. Nos. 7,255,266; 7,251,626; 7,249,761; 7,246,082; 7,240,829; 7,240,827; 7,234,636; 7,229,009; 7,229,012; 7,229,008; 7,222,782; 7,216,801; 7,216,800; 7,216,083; 7,207,478; 7,204,411; 7,195,153; and 7,195,237 the disclosures of each of which are incorporated herein by reference in their entirety.

Figure 24:
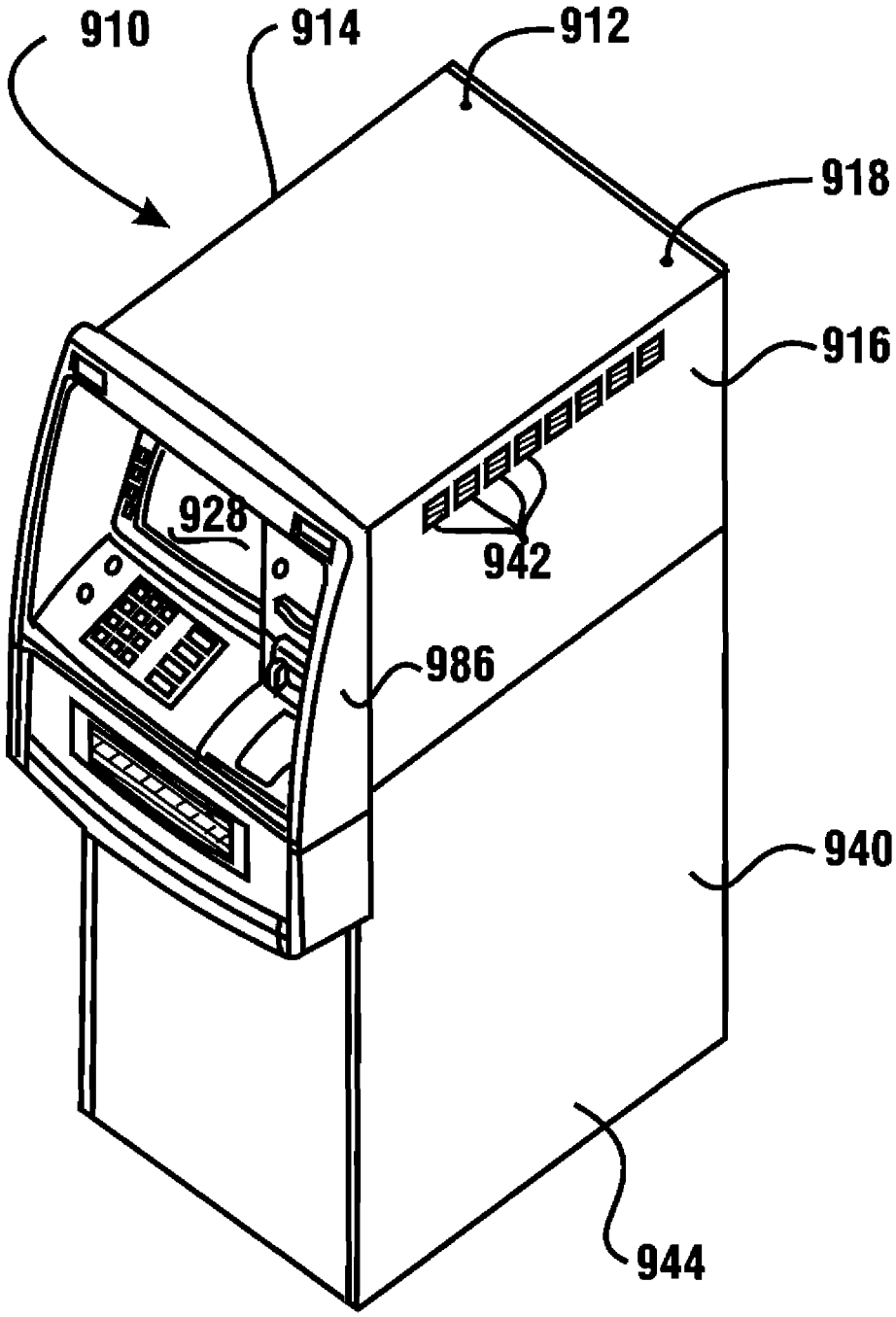
FIG. 24 is an isometric view of an automated banking machine of an exemplary embodiment.
Figure 25:
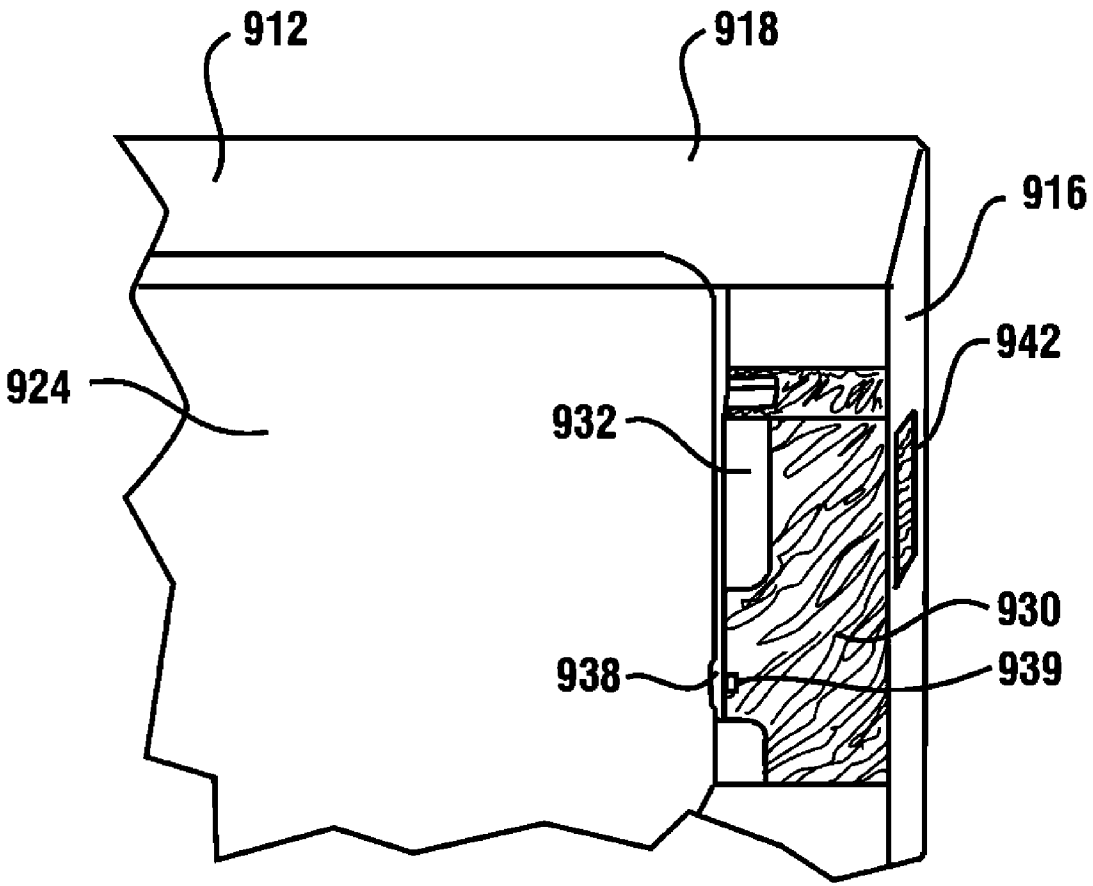
FIG. 25 is a view of a portion of an automated banking machine of an exemplary embodiment illustrating a component case assembled into a top housing.
Figure 26:
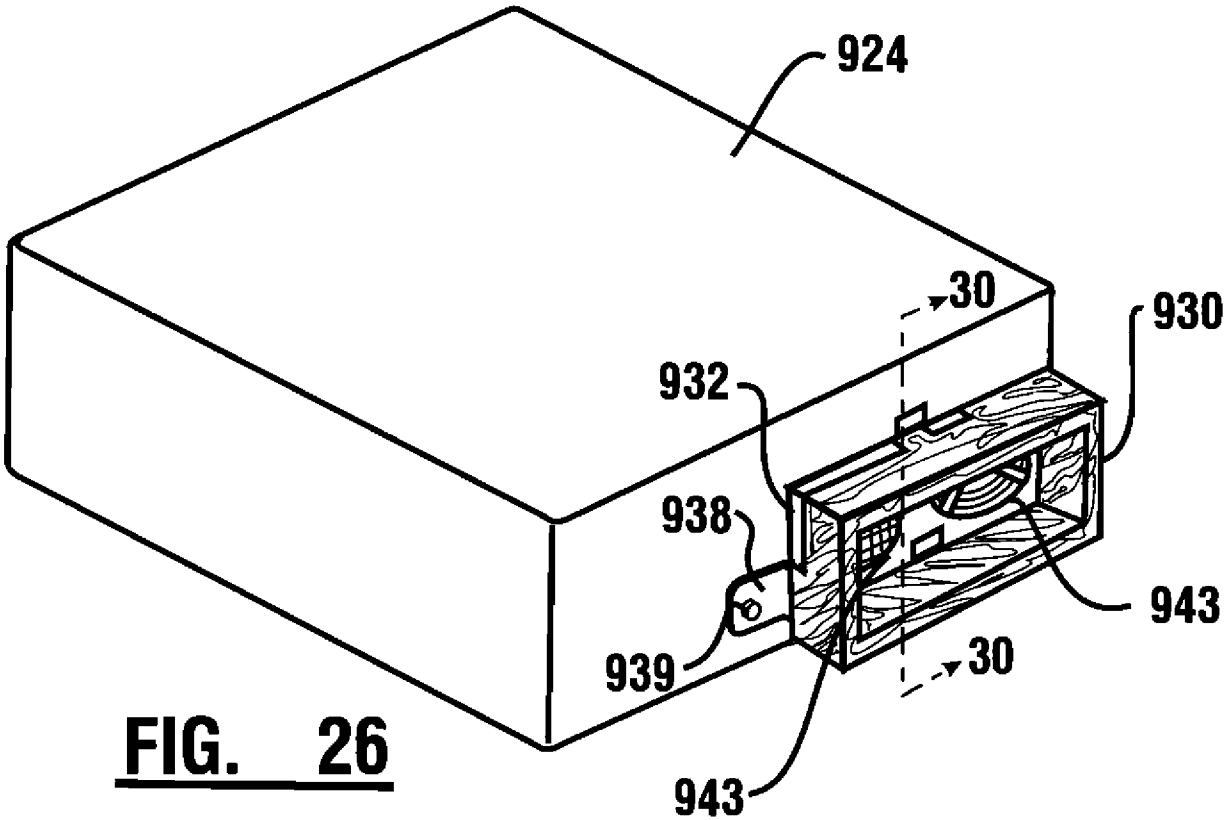
FIG. 26 is an isometric view of a portion of an automated banking machine of an exemplary embodiment illustrating a component case in combination with a duct assembly.

With reference to FIG. 24, in this exemplary embodiment there is shown therein an automated banking machine, generally indicated as 910. In this exemplary embodiment, the automated banking machine 910 is an automated teller machine (machine). The machine 910 includes a housing 912 mounted atop a chest 940. The chest 940 may be enclosed in a chest housing 944. The housing 912 includes a first sidewall 914, a second sidewall 916, and a top wall 918, and defines an opening 22 (shown in exemplary fashion in FIG. 2) to an interior area 20 (shown in exemplary fashion in FIG. 2). The housing 912 further includes housing vents 942 formed in the sidewalls 914, 916 which provide ventilation and enable the movement of air from within the housing 912, in particular to help cool electronic parts contained, for example, in a component case 924 (FIG. 25). An upper fascia 986 provides an attractive appearance as well as security. The fascia 986 is in operatively supported connection with the housing 912 and moveable between a secure closed position adjacent to the housing opening 22 and a released away position. (FIGS. 1 and 2.) In the exemplary embodiment, a card reader 24 (shown in exemplary fashion in FIG. 3) is in operatively supported connection with the housing 912 and is operative to read indicia on user cards corresponding to financial accounts. Also in the exemplary embodiment, a display 928 and a cash dispenser 64 (shown in exemplary fashion in FIG. 3) are in operatively supported connection with the housing 912. The component case 924 (FIG. 25), which may be a processor case, is in operatively supported connection with the housing 912 and may contain computer processors and related electronic components (not shown). As shown in FIG. 26, but best seen in FIG. 27, the component case 924 further includes one or more component case vents 943 which may cooperate with one or more fans or other air movement devices (not shown) to help ventilate the interior of the component case 924.

As will be understood from FIGS. 24 and 25, ventilation air from the interior of the component case 924 may not easily circulate outside the housing 912 which encloses the case 924 as well as other components of the machine 910. As shown in exemplary fashion in FIG. 25, a duct 930 is disposed between the component case 924 at the component case vents 943 (FIGS. 26 and 27) and the housing sidewall 916 at the at least one housing vent 942 (FIGS. 24 and 25). Air from the interior of the component case 924, by way of example only, warm air heated by the operation of processors or other components within the case 924, may then be guided to outside the housing 912. Likewise, depending upon the direction of air flow, cooler air from outside the housing 912 may be guided to the interior of the component case 924. In an exemplary embodiment, the duct 930 is adhered to the component case 924 with an adhesive 936 (shown in exemplary fashion in FIG. 30). In a further exemplary embodiment, the duct 930 may be adhered to the housing 912. In a further exemplary embodiment, the adhesive 936 is releasable. In a further exemplary embodiment, the adhesive is resealable. Thus, the duct 930 may be released from its position and later resealed.

Figure 27:
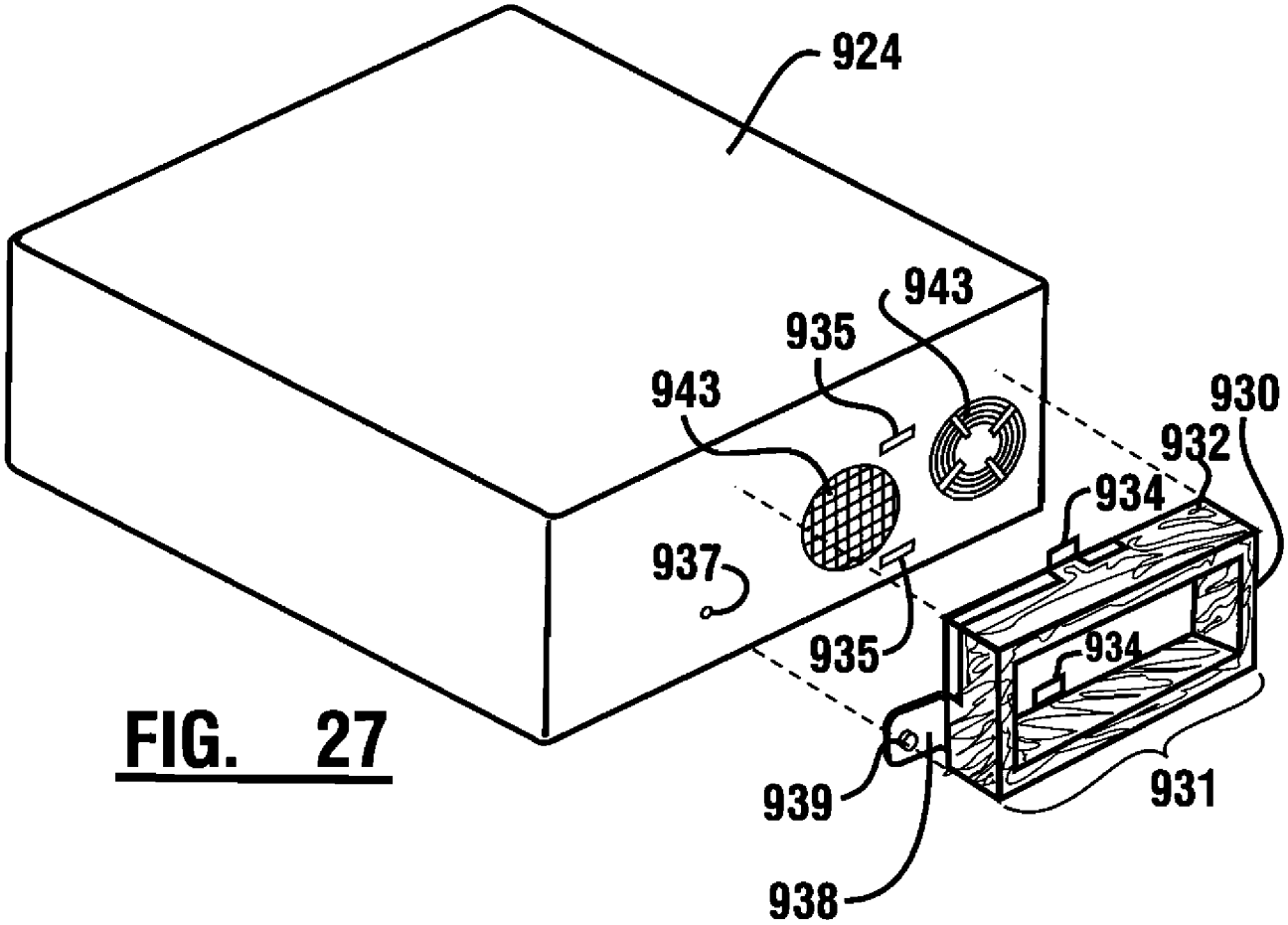
FIG. 27 is an exploded isometric view of the automated banking machine of the exemplary embodiment of FIG. 26.
Figure 28:
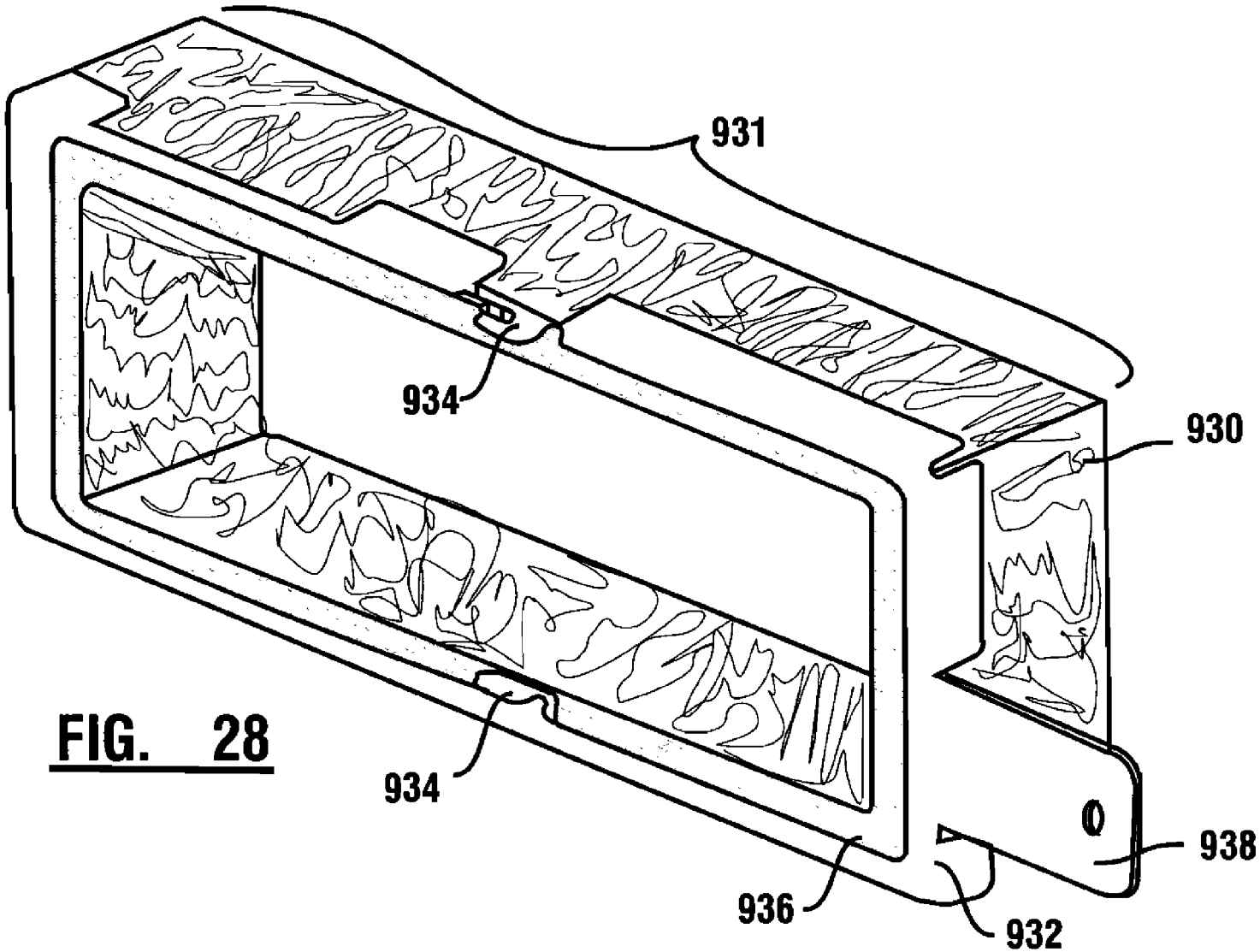
FIG. 28 is an isometric view of a duct assembly portion of an automated banking machine of an exemplary embodiment illustrating the details of the duct assembly.
Figure 29:
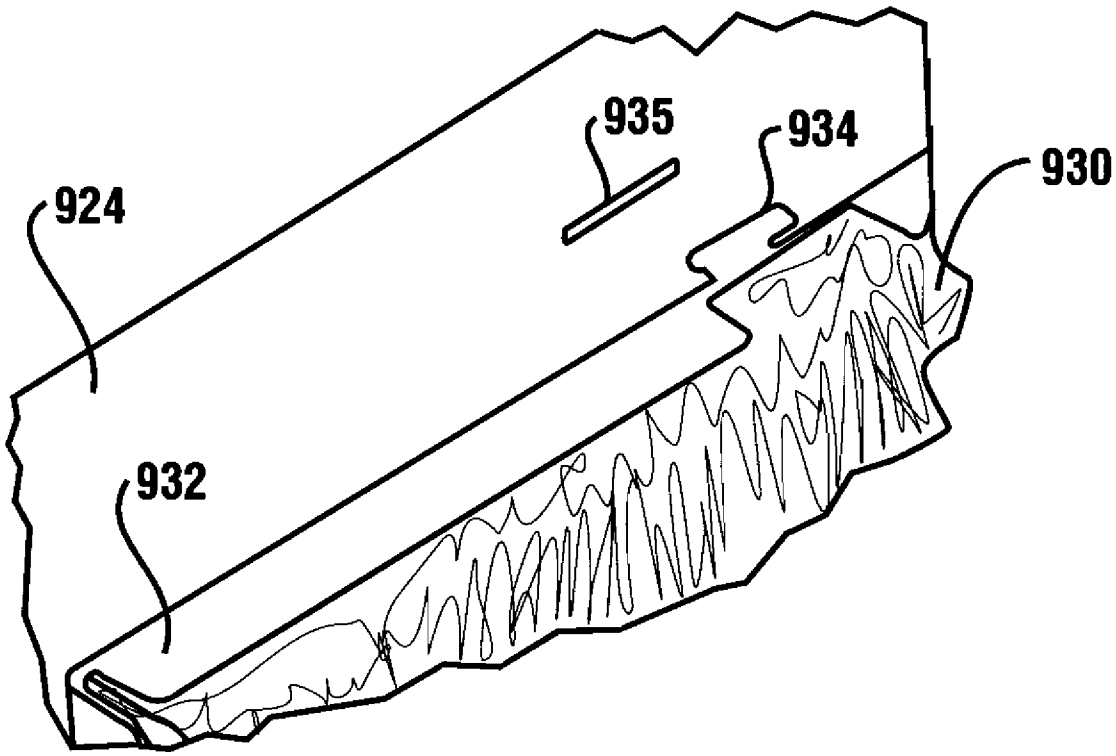
FIG. 29 is an isometric view of a portion of a duct assembly portion and a portion of a component case portion of an automated banking machine of an exemplary embodiment illustrating the details of the duct assembly and component case.
Figure 30:
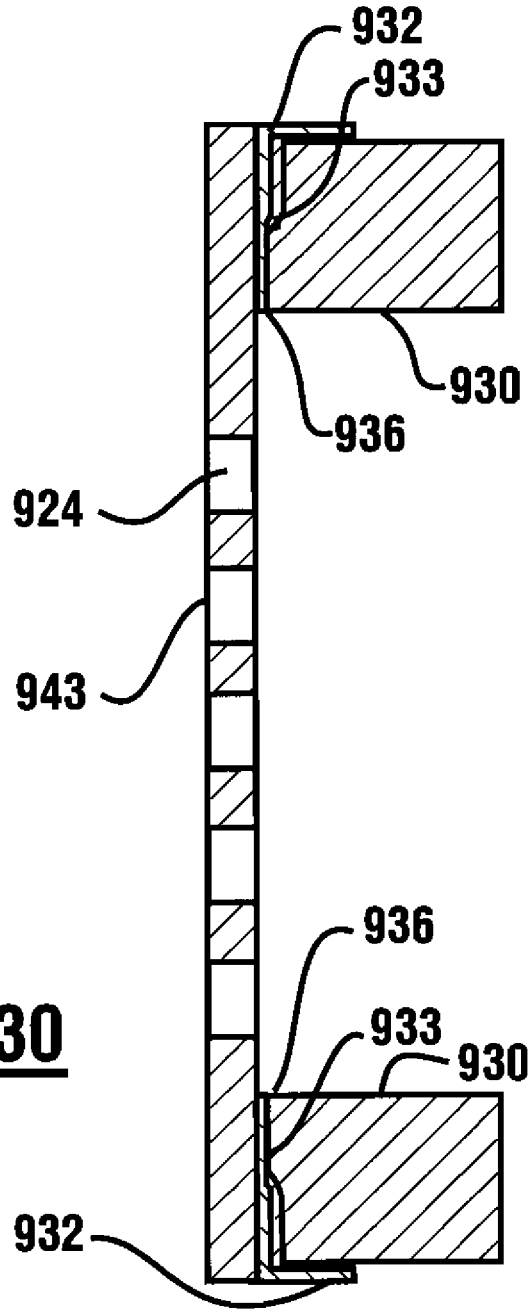
FIG. 30 is a partial section view taken along the line 30-30 of FIG. 26.

A further exemplary embodiment is shown in FIGS. 27 and 28 which generally illustrate a duct assembly 931. The duct assembly 931 may comprise a duct 930 to which a frame 932 has been secured. In a further exemplary embodiment, the frame 932 may include one or more tabs 938, one or more hooks 934, or combinations of tabs 938 and hooks 934. In an exemplary embodiment, the frame 932 is adhered to the duct 930 with an adhesive 936 (FIGS. 28 and 30). In a further exemplary embodiment, the one or more tabs 938 cooperate with, for example, one or more fasteners 939 (FIGS. 25 and 27) and one or more apertures 937 in the component case 924 to secure the duct 930 to the component case 924. While the fastener 939 is shown as a screw, it is to be understood that other fasteners may be employed. In an exemplary embodiment, the one or more hooks 934 cooperate with one or more component case slots 935 to secure the duct 930 to the component case 924. While the duct assembly 931 is shown in exemplary fashion as secured to the component case 924, the duct assembly 931 may be secured to the housing 912, for example, the housing sidewall 916, or to other cases or elements of the machine 910.

In a further exemplary embodiment, as shown in FIG. 30, the duct assembly 931 is adhered to the component case 924 with adhesive 936. The adhesive 936 is secured to an edge 933, proximate the component case 924, and the duct assembly 931 adhered to the component case 924. As shown in FIG. 30, the adhesive 936 may secure the frame 932 to the duct 930 and the adhesive 936 may secure the duct assembly 931 to the component case 924. It is to be understood that the adhesive material used to secure the frame 932 to the duct 930 may not be the same adhesive material used to secure the duct assembly 931 to the component case 924. In a further exemplary embodiment, the frame 932 is secured to the duct 930 by other means. As can be seen from FIG. 30, forming the duct 930 from deformable material, such as foam, enables the duct 930 to deform around the frame 932 thickness and contact the component case 924.

In an exemplary embodiment, a method is provided. The fascia 986 is moved from a position adjacent the opening 22 (FIG. 2) to the interior 20 of the housing 912 of the automated banking machine 910 to a position away from the opening 22. The component case 924 is moved from a position within the interior 20 of the housing 912 to a position at least partially extending through the opening 22. The duct assembly 931, at least partially secured to the component case 924 with the releasable resealable adhesive 936, is released from the component case 924. A component (not shown), at least partially contained within the component case 924 is serviced, the duct assembly 931 adhered to the component case 924, and the component case 924 moved from the position at least partially extending through the opening 22 to the position within the interior 20 of the housing 912. The fascia 986 is moved from the position away from the opening 22 of the housing 912 to the position adjacent the opening. In a further embodiment, the duct assembly 931, comprising the deformable duct 930 with releasable resealable adhesive 936 secured thereto, the duct 930 is deformed to adhere to the component case 924. The duct 930 may also be comprised of resilient material. In a further embodiment, the duct assembly 931, further comprising the duct frame 932 having at least one hook 934 and the component case 924, further comprising the at least one slot 935, the at least one hook 934 is mated with the at least one slot 935. In a further embodiment, the duct assembly 931 further comprises the frame 932 having at least one tab 938 and at least one fastener 939 in operative connection with the at least one tab 938 and the component case 924 further includes at least one fastener hole 937. The at least one fastener 939 is mated with the at least one fastener hole 937.

In a further exemplary embodiment, a method is provided. The housing 912 is mounted in supporting connection with the chest 44 (FIG. 2). The card reader 24 (FIG. 3) is installed in operatively supported connection with the housing 912, the display 928 is installed in operatively supported connection with the housing 912, and a cash dispenser 64 (FIG. 3) is installed in operatively supported connection with the housing 912. The component case 924, having at least one component case vent 943, is installed in operatively supported connection with the housing 912. The duct assembly 931, including a duct 930 is adhered to the component case 924. In a further exemplary embodiment, the duct assembly 931 further includes a frame 932 and the method further includes securing the frame 932 to the duct 930. In a further exemplary embodiment, the frame 932 is adhered to the duct 930. In a further exemplary embodiment, the frame includes at least one hook 934 and the component case 924 further includes at least one slot 935, the slot 935 adapted to accept the at least one hook 934, the method further comprising mating the at least one hook 934 and the at least one slot 935. In a further exemplary embodiment, the frame 932 includes at least one tab 938, the duct assembly 931 further includes at least one fastener 939, and the component case 924 further includes at least one fastener hole 937. The method further comprises mating the at least one fastener 939 and the at least one fastener hole 937.

The machine may be installed in a location such as a pedestrian walkway or parking garage where the machine may be subject to wear and tear from vandals, as well as exposure to the weather or other elements of the outside environment. FIGS. 31-34 show an exemplary arrangement of apparatus that helps protect an automated banking machine from the outside environment. The exemplary arrangement includes an outer housing or enclosure 1000 that encloses a machine such as the machine 910 shown in FIGS. 24-30. The enclosure 1000 is generally box shaped and includes a base portion 1002 at a lower end of the enclosure 1000. The enclosure 1000 further includes a front wall 1004 and left and right sidewalls 1006, 1008 (as viewed from the rear in FIG. 33) that all extend upwardly from the enclosure base portion 1002. The exemplary enclosure 1000 also includes a top wall 1010 interconnecting the front wall 1004 and sidewalls at the top end of the enclosure 1000. The enclosure 1000 includes a rear access opening 1012 that allows access to an interior area. The access opening 1012 is opened and closed by a door 1014 which is movable between open and closed positions. Alternatively, the rear access opening may be opened and closed by an access panel. The door and/or access panel may be held in the closed position by a lock. As shown in FIG. 33, a doorstop 1016 is provided inwardly adjacent the right sidewall 1008 of the enclosure. A first seal portion 1018 is mounted to the doorstop at its upper portion. The enclosure 1000 includes an opening 1020 in the front wall for user access to the fascia of the machine 910. The enclosure 1000 may be made of metal or other suitable material that helps protect the housing and the machine 910 from the outside environment and other hazards. The base portion of the enclosure 1000 may be anchored to a mounting structure 1001 such as a cement pad or other base surface via suitable anchors or mounting fasteners.

The housing 912 of the machine may be removably positioned in the enclosure 1000. As previously mentioned, the component case 924 of the machine 910 is in operatively supported connection with the machine housing 912 and may contain computer processors and related electronic equipment. The component case further includes component case vents 943 which may cooperate with one of more fans or other air movement devices to help ventilate the interior of the component case. However, the exemplary enclosure 1000 that encloses the machine housing facilitates the flow of air into and out of the component case via the housing vents 942 in the housing 912. Hence, the heat generated by the processor will be able to readily escape from the enclosure 1000 or otherwise managed to maintain a suitable operating environment.

Figure 33:
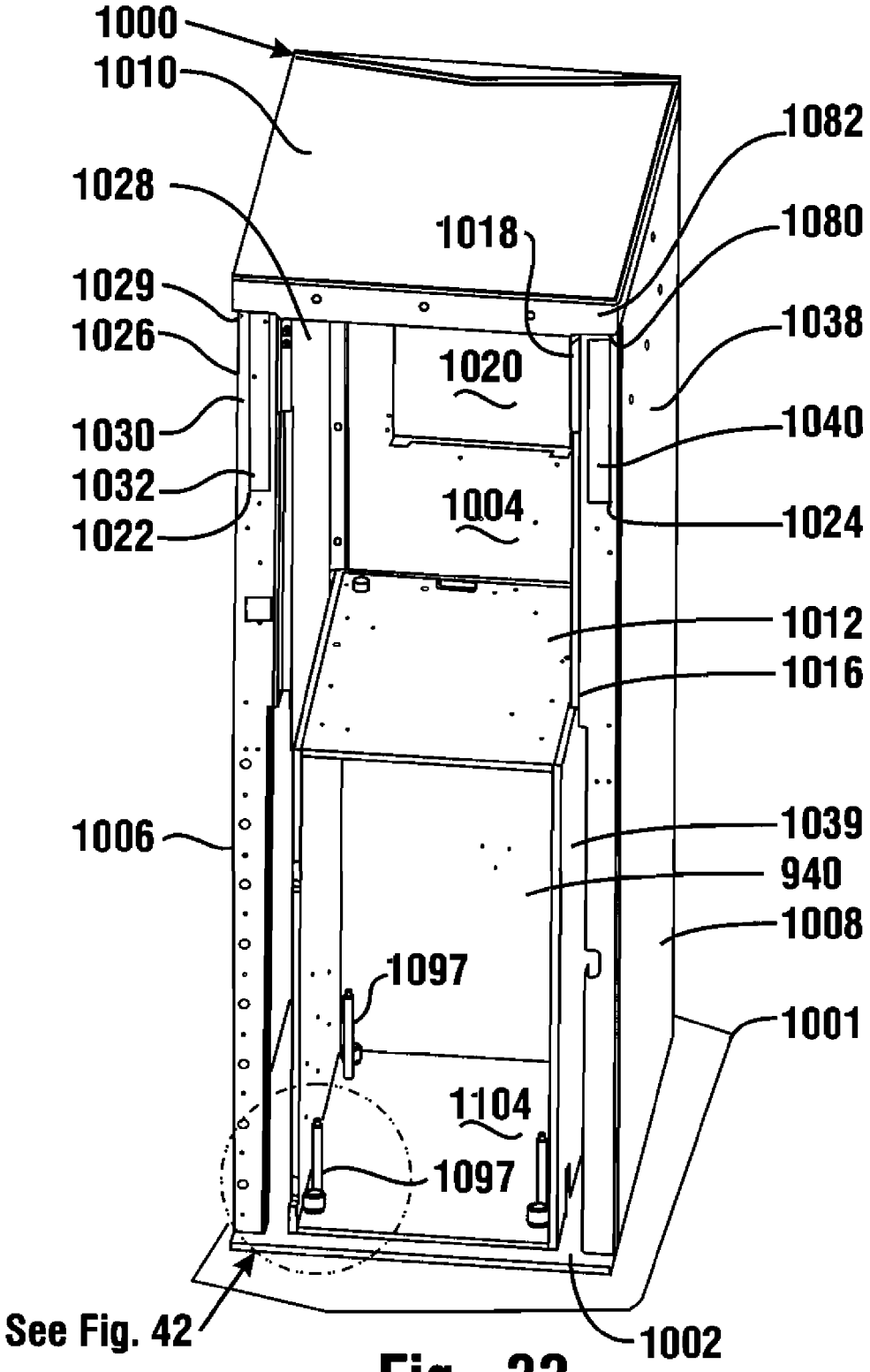
FIG. 33 is a rear isometric view of the enclosure of FIG. 31 enclosing elements of an automated banking machine.
Figure 34:
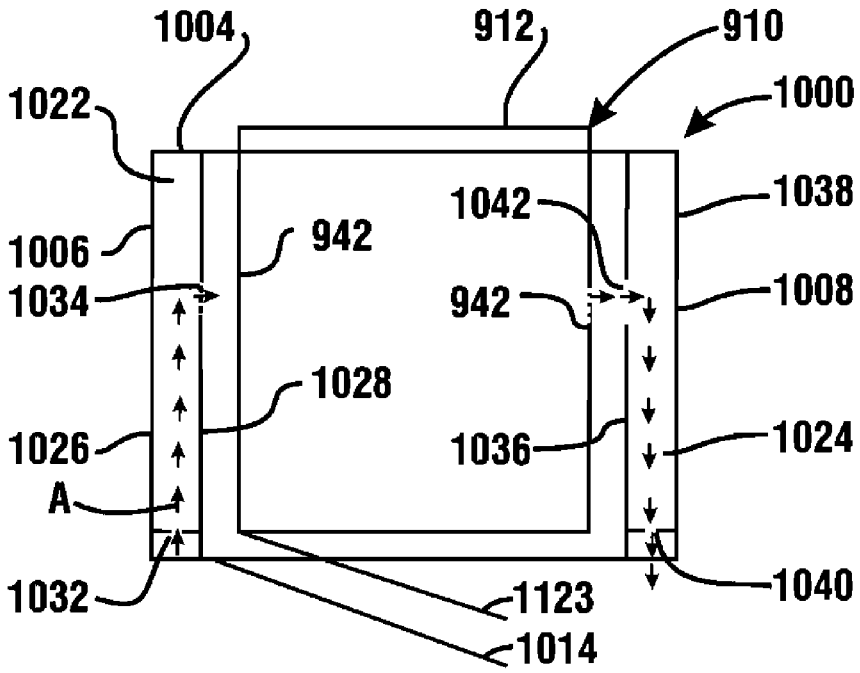
FIG. 34 is a top schematic plan view of the enclosure of FIG. 31 with an automated banking inside the enclosure of FIG. 31 with the top wall removed for illustration purposes.

The exemplary enclosure includes a duct system that helps provide air flow into and out of the machine housing component case to cool the processor and other components in the component case. In particular, the exemplary enclosure includes disposed left and right duct portions 1022, 1024 as shown in FIG. 33. The example left duct portion 1022 is provided within the left sidewall 1006. Specifically, the left sidewall 1006 includes outer and inner faces or panels 1026, 1028 interconnected by a rear face 1030 of the left sidewall 1006 and the front wall 1004. The left duct portion 1022 is generally rectangular in cross section and defined by the front and top walls 1004, 1010 and the outer and inner faces 1026, 1028 of the left sidewall 1006. The example left duct portion 1022 includes an air intake opening 1032 that is formed in the rear face 1030 of the left sidewall 1006 near the top of the left sidewall 1006. The example left duct portion 1022 includes an outlet opening 1034 formed in the inner face 1028 of the left sidewall 1006. In the example arrangement, when the machine housing is positioned in the enclosure, the outlet opening 1034 of the air intake duct may be aligned with housing vents 942 of the housing 912 as seen in FIG. 34.

The example right duct portion 1024 is provided within the right sidewall 1008. Specifically, the right sidewall 1008 includes inner and outer faces or panels 1036, 1038 interconnected by the front wall 1004 and a rear face 1039. The right duct portion 1024 is generally rectangular in shape and defined by the front and top walls 1004, 1010 and inner and outer faces 1036, 1038 of the right sidewall 1008. The right duct portion 1024 includes an air exhaust opening 1040 that is formed in the rear face 1039 of the right sidewall 1008 near the top of the right sidewall 1008. The example right duct portion 1024 includes an inlet opening 1042 formed in the inner face 1036 of the right sidewall 1006. In the example embodiment when the machine housing is positioned in the enclosure, the inlet opening 1042 may be generally aligned with outlet housing vents 942 of the machine housing 912. Optionally, in some embodiments the right and left duct portions may each be further defined by a respective bottom panel that is located at a height that is approximately the height of the bottom end of their associated intake and exhaust openings 1032, 1040. In other embodiments other air passage arrangements may be used.

Figure 31:
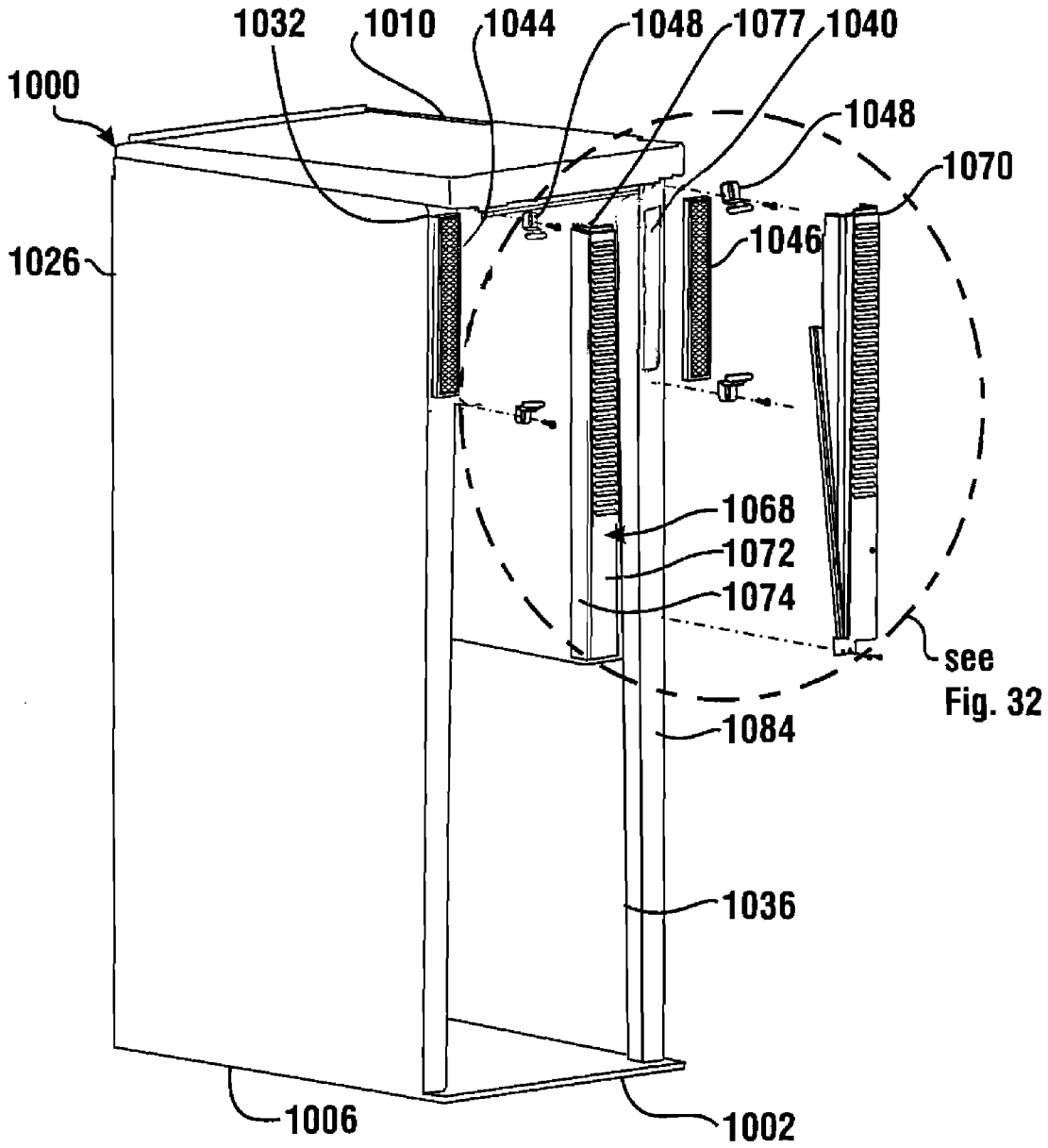
FIG. 31 is an exploded isometric view of an apparatus that includes an enclosure and related elements according to an exemplary embodiment.
Figure 32:
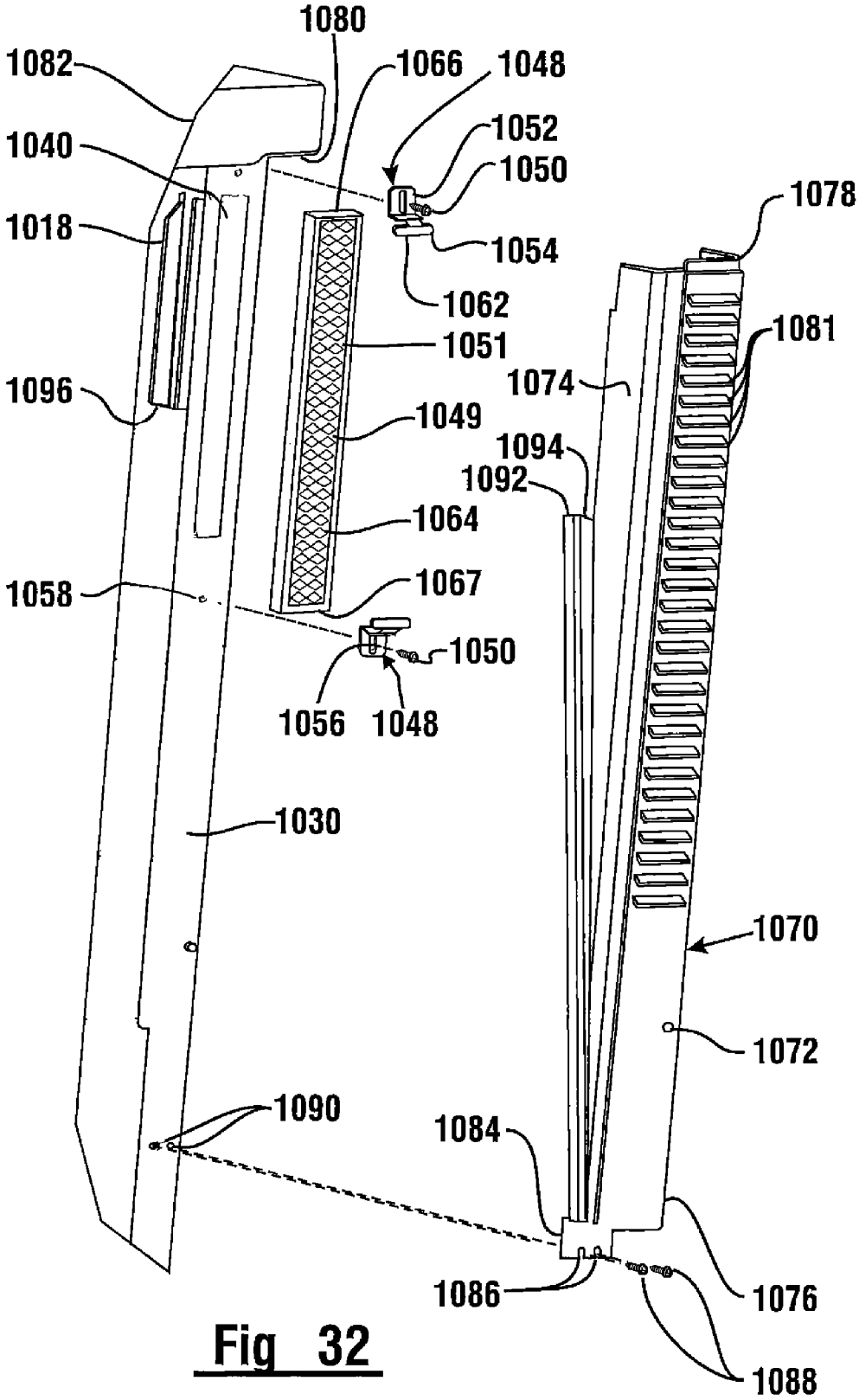
FIG. 32 is an enlarged view of a portion of the apparatus as indicated in FIG. 31.

Referring to FIGS. 31 and 32, a first air filter 1044 is removably mounted to the enclosure 1000 and generally covers the air intake opening 1032. A second air filter 1046 is removably mounted to the enclosure 1000 and generally covers the air exhaust opening 1040. Filter clips 1048 and fasteners 1050 are used to removably mount and releasibly hold the filters 1044, 1046 to the rear faces 1030, 1039 of their corresponding left and right sidewalls 1006, 1008. Each filter, filter clip, and fastener is of similar construction function and thus only one will be described in detail. Referring to FIG. 32, each of the filters includes a rectangular frame 1049 that surrounds meshed fibers or wires 1051 made of suitable filter material. Alternatively, the filter may be a pleated paper plastic foam, plastic screen or combinations of suitable filter materials. Each example clip 1048 is formed in one piece and includes a base plate 1052 and a retainer 1054. The base plate 1052 of the clip includes a mounting aperture 1056 for allowing the fastener 1050 such as a screw to threadily engage into an aperture 1058 of the rear face to mount and hold the clip 1048 to the rear face. This mounting aperture 1056 is elongated and is sized larger than the aperture to allow adjustment of the mounting position of the filter. The retainer 1054 is T-shaped and includes a stop 1060 that extends rearwardly away from the base plate 1052 when the clip 1048 is mounted to the rear face. The retainer 1054 further includes a rectangular flange 1062 that extends radially outwardly relative to the stop 1060 from the rear end of the stop 1060.

When the exemplary filter is mounted to the rear face, the flange 1062 of one clip engages a rear surface 1064 of the filter at its upper end 1066 and the flange 1062 of another clip 1048 engages the rear surface of the filter at its lower end 1067 to retain the filter to the rear face. Also, the stops 1060 engage or are in close proximity to the upper and lower ends 1066, 1067 of the filter to prevent the filter when fastened in position from moving relative to the rear face and out of covering relation of its associated opening.

To mount the filter to the enclosure 1000, the filter is first aligned over its respective opening. Then the lower filter clip is positioned on the rear face such that the mounting aperture 1056 is aligned over the aperture 1058 in the rear face, the flange 1062 of the lower filter clip engages the rear surface 1064 of the filter and the stop 1060 engages the lower end 1067 of the filter. The fastener 1050 is screwed into the aperture 1058 of the rear face to hold the filter in position. Then, the upper filter clip is positioned on the rear face such that the mounting aperture 1056 is aligned over the aperture 1058 in the rear face, the flange 1062 of the upper filter clip engages the rear surface 1064 of the filter and the stop 1060 engages or is positioned adjacent to the upper end 1066 of the filter. The fastener is then screwed into the aperture of the rear face. Alternatively, the lower filter clip could mount the filter first or the filter could be mounted by both clips at the same time. Of course alternative structures and mounting methods may be used.

In the exemplary arrangement first and second filter covers 1068, 1070 are removably mounted to the enclosure and cover their respective first and second filters 1044, 1046 in an overlying relationship with the filters as depicted in FIGS. 31 and 32. Referring to FIG. 32, each exemplary cover is made of sheet metal or other suitable material and includes a rear wall 1072 that is interconnected by left and right sidewalls 1074, 1076. Louvers 1081 which serve as air passages are spaced along the rear wall 1072 of the cover to allow the air to the flow through the cover. As depicted in FIG. 31, the example first filter cover 1068 includes a tab 1077 that extends upwardly from the upper ends of the rear wall 1072 and left side wall 1074 of the first filter cover 1068. When the first filter cover 1068 is mounted to the enclosure, the tab 1077 extends into a slot 1079 (FIG. 33) formed between a lip 1082 of the top wall 1010 and the left sidewall 1006. As best depicted in FIG. 32, the example second filter cover 1070 includes a tab 1078 that extends upwardly from the upper ends of the rear wall 1072 and right sidewall 1076 of the second filter cover 1070. When the second filter cover is mounted to the rear face, the tab 1078 extends into a slot 1080 formed between a lip 1082 of the top wall 1010 and the right sidewall 1008. In the example embodiment, each cover also includes a mounting flange 1084 that extends downwardly from the lower end of the cover. The mounting flange 1084 also spans the respective left and right sidewalls 1074, 1076 of the louver at their front ends. The example mounting flange 1084 includes a pair of mounting apertures 1086 for allowing fasteners 1088 such as screws to threadily engage corresponding apertures 1090 of the rear face to mount the lower end of the cover to the rear face. Each mounting aperture 1086 is elongated and sized larger than its respective fastener accepting aperture 1090 of the rear face to allow adjustment of the mounting position of the filter cover.

The example second filter cover 1070 further includes a second seal portion 1092 that is attached to the front end of the left side wall 1074 and extends radially outwardly therefrom. The second seal portion 1092 also extends upwardly from the lower end of the second filter cover 1070 a distance such that an upper end 1094 of the second seal portion 1092 is axially aligned and adjacent the lower end 1096 of the first seal portion 1018 when the second filter cover 1070 is mounted to the rear face 1030. Thus, when the second filter cover 1070 is mounted to the rear face 1030 of the right sidewall 1008, the first and second seal portions 1018, 1092 in combination extend along the door stop 1016 between the upper and lower end of the outer housing 912 of the machine 910 that houses the component case. In the example arrangement, the first and second seal portions 1018, 1092 are engaged by the door 1014 when the door 1014 is closed.

Each filter cover is mounted to the rear face of its associated sidewall by first inserting the tabs 1077, 1078 into their respective slots 1079, 1080 and then aligning the mounting apertures 1086 of the mounting flange 1084 with the apertures 1090 of the rear face. For the second filter cover 1070, the second seal portion 1092 is also aligned with the first seal portion 1018 as previously mentioned. The screws 1088 are then tightened into the apertures 1090 of the rear face and tightened to hold the filter with the enclosure. In the example embodiment the door or removable panel for closing the access opening may be configured to cover the heads of the screws 1088 in the closed position. Of course this approach is exemplary.

To remove the example filter from the rear face, the door or panel is moved to the open position and the filter cover is removed by loosening the screws 1088 from the mounting flange 1084. Optionally the screws 1088 may be removed. Then the filter cover is moved downwardly to disengage the tab from the slot and then outwardly to move the filter cover away from the filter. The screw 1050 for the upper filter clip 1048 is then loosened and optionally removed. Then, the screw 1050 for the lower filter clip 1048 is loosened to enable disengagement of the filter from the enclosure 1000. Optionally, the screws 1050 and filter clips 1048 may be unfastened and removed from the enclosure to detach the filter from the rear face. It should be noted that the door 1014 or closure panel when opened is disposed from the seal portions 1018, 1092 which enables removing the filter covers. After the filter is removed from the enclosure, another filter may then be installed according the previously mentioned steps. Of course these structures and approaches are exemplary.

The operation of the exemplary arrangement is as follows. Referring to FIGS. 31 and 34, fan 913 in the component case operates to draw air in through louvers 1081 of the first filter cover 1068 and then through the first filter 1044 to filter out dirt, dust and particulates. As shown by the arrows A of FIG. 34, the filtered air is then directed into intake opening 1032 of the left duct portion 1022 and out of the outlet opening 1034 and into the vents 942 located on the right side wall of the housing 912. The filtered air flows in the housing into the vents of the component case to cool the processor and other components. The filtered air then exits the component case through the vents and flows out of the vents 942 located in the left side wall of the housing 912. The air then flows into the inlet opening 1042 of the right duct portion 1024 and then out of the exhaust opening 1040. The air passes through by the second filter 1046 and then exits through the louvers 1081 of the second filter cover 1070. The duct system allows filtered air to flow readily into and out of the component case and thus provides greater heat dissipation. Also, the air is additionally filtered by the second filter 1046 on the exhaust opening 1040. Of course it should be understood that the enclosure is suitable for housing other types of machines where the internal components may cause air to flow in the opposite direction from that described.

Some example embodiments may include additional structures and features to facilitate operation of the automated banking machine within the enclosure. As can be appreciated in some external environments, the ambient temperature may be below that which is necessary to provide suitable cooling for the processor and other components within the interior area of the housing. In such environments if the temperature of components within the housing becomes too low, this could adversely affect the operation of such components. This may include, for example, rollers, belts, printers or other items that must have a suitable internal housing temperature to effectively operate. In order to facilitate maintaining a suitable ambient temperature, the housing of the machine and/or the enclosure may include one or more temperature sensing elements which are operative to sense temperature of the incoming outside air or alternatively or in addition within the housing of the machine. The suitable temperature sensors may include, for example, thermistors, thermocouples, resistance temperature detectors or other suitable temperature sensing devices. Such temperature sensors may be in operative connection with one or more processors with suitable interfaces. The one or more processors may include the processor within the machine that operates the transaction function devices. Alternatively such processors may be in a circuit board or other controller that is associated with the temperature control function. Of course these approaches are exemplary and in other embodiments other approaches may be used.

In some example embodiments, the ductwork may include features such as additional fans which can be selectively turned on and off responsive to operation of one or more processors that are in operative connection with the temperature sensors. For example in some embodiments if the temperature sensors indicate that the interior area of the housing is reaching an elevated temperature that may be undesirable for the processor and other components therein, the at least one processor responsive to the elevation in temperature may cause the one or more supplemental fans located in operative connection with the ductwork to move additional air through the housing and provide additional cooling. Likewise in some example embodiments in situations where the temperature within the interior of the machine housing reaches a level that is unacceptably low for the operation of certain components, the at least one processor may operate responsive to sensing of such conditions by the temperature sensors to cause one or more supplemental fans to operate so as to resist the air flow of the cooling fans in the machine housing will generally cause the temperature within the interior area of the housing to increase due to less cooling air flow therethrough. Such opposing air flow will then generally cause the area within the machine housing to increase.

In other example embodiments air flow valves and suitable drives may be provided within the air ducts or other air flow passages of the machine. These valves may include flap valves, slide valves or other suitable devices for controlling the level of air flow through the duct or passage. Such valves may be in operative connection with one or more drives so as to facilitate the opening and closing of the air flow passage that controls the level of air flow through the duct or passage. Drives for controlling the air flow valves may be in operative connection with one or more processors through suitable interfaces. In response to temperature sensing via the one or more temperature sensors, drives may operate to control the opening and closing of such air flow valves. Thus, for example, in a situation where the one or more sensors detect that the temperature within the interior area of the machine housing is becoming unduly low. The at least one processor may operate to cause closing of one or more valves in the ducts so as to restrict air flow either into and/or out of the machine housing. This will generally cause the temperature within the interior area of the housing to rise due to the inability of heat generated by the processor to escape. Similarly in some example embodiments, an unduly high temperature within the housing when detected may operate to have at least one processor cause the flow valve to open or open further so as to provide greater cooling air flow. Of course these approaches are exemplary.

In still other example arrangements, other sensors may be provided for detecting environmental conditions either within the machine housing or the enclosure so as to facilitate machine operation. For example, in some weather conditions, there may be such high humidity that drawing moist air within the machine housing may cause condensation and damage to machine components. This may be detected through one or more humidity sensors. This can be either within the machine housing, within ductwork or in other locations. The processor may operate responsive to the humidity sensors and/or the temperature sensors in accordance with its programming to control the flow of humid air into the machine housing. This may be done, for example, by changing the air flow into and/or out of the machine housing through valves, fans, etc. Alternatively and/or in addition, heaters and/or cooling devices may be positioned in the air flow path. Such heaters or cooling devices may include piezoelectric heaters and/or cooling devices which are in operative connection with structures such as baffles and/or screens through which air will flow before entering the machine housing. At least one processor may operate in accordance with its programming to heat the air so as to avoid condensation based on sensing appropriate environmental circumstances. Alternatively and/or in addition, the at least one processor may operate to cool the air so as to condense moisture out of the air before it can enter the machine housing. Other example embodiments may provide other features such as flow paths that include items such as filters, desiccant materials or other suitable structures that facilitate conditioning of the air prior to entering the housing. Of course these approaches are exemplary and in other embodiments, other approaches may be used.

Figure 38:
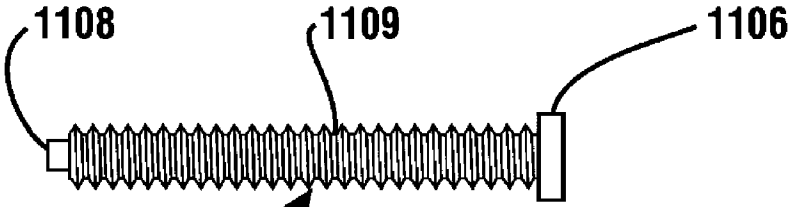
FIGS. 36-38 show exemplary embodiments of leveling legs for the automated banking of FIG. 33.
Figure 37:
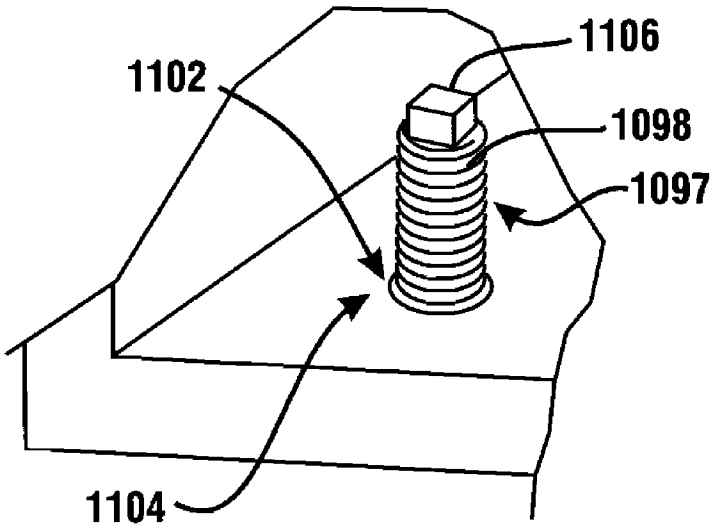
Figure 36:
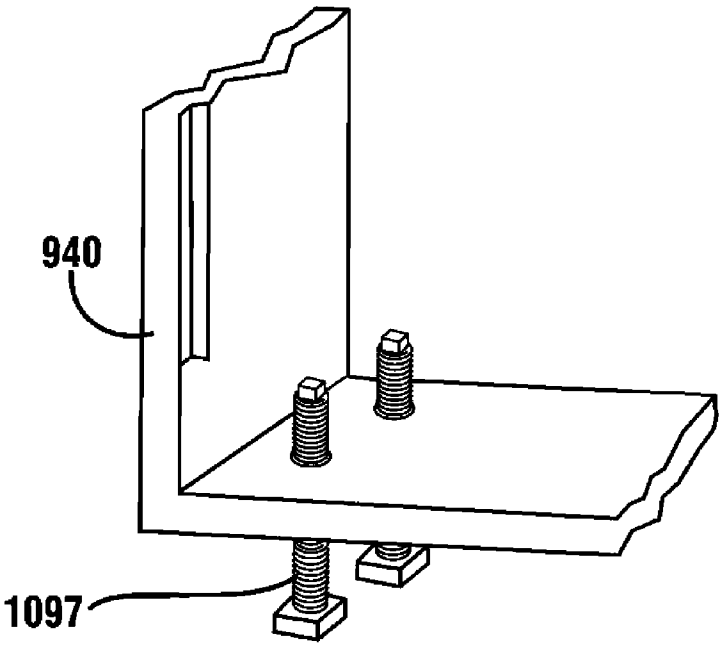

Exemplary embodiments of the automated banking machine may include a plurality of legs that extend downwardly below the automated banking machine chest which are operative to support the machine above the enclosure base portion, a floor or other surface. In an exemplary embodiment such legs may be adjustable in height to account for surfaces which are not level or are uneven. In addition in exemplary embodiments the legs may be adjustable in height from within the interior area of the chest. FIG. 36 shows an exemplary embodiment of a leveling leg 1097 in operative connection with the base portion of the chest 940 of the machine. As shown in FIGS. 37 and 38 the leveling leg 1097 may include a threaded shaft 1098 that is operative to screw up or down within a threaded hole 1102 through the bottom or base portion 1104 of the chest 940. The leg 1097 may include a base or foot end 1106 that is operative to engage and rest on a floor or other support surface. The foot 1106 can comprise a flange or foot portion extending in a radial direction perpendicular to the axis of the shaft 1098. The flange can have a diameter greater than the diameter of the threaded portion of the shaft. The flange can have a circular, square, slotted, or other known shape or configuration. The foot end 1106 can be of a size to ensure a sufficient contact area with the supporting surface. The support strength and the diameter of the threaded shaft and the flange is suitable to support the weight of the machine.

As shown in FIG. 38, the leg 1097 may include a tool engaging end 1108 which has a size that is adapted to be turned by a wrench or other suitable tool. In the exemplary embodiment the tool receiving end may include a square projection which is relatively narrower than the diameter of the threaded shaft 1098. When the automated banking machine is being assembled, the tool receiving end of the leveling leg may be inserted into the hole 1102 from underneath the chest. The leveling leg 1097 may then be rotated to screw the leveling leg further upward into the chest.

To make an automated banking machine level on an uneven surface, one or more of the leveling legs may be rotated to increase or decrease the length of the leveling legs that extend below the base portion of the chest. In an exemplary embodiment, the leveling process may include opening the chest door and turning one or more of the square tool receiving ends of the leveling legs with a wrench. For automated banking machines which include hardware devices in the chest such as currency cassettes, the hardware device may be either removed from the chest or the hardware device may be moved outward from the chest into a service position to provide access to the leveling legs. Examples of leveling legs are disclosed in U.S. Pat. No. 7,793,828, the disclosure of which is incorporated by reference in its entirety.

Figure 39:
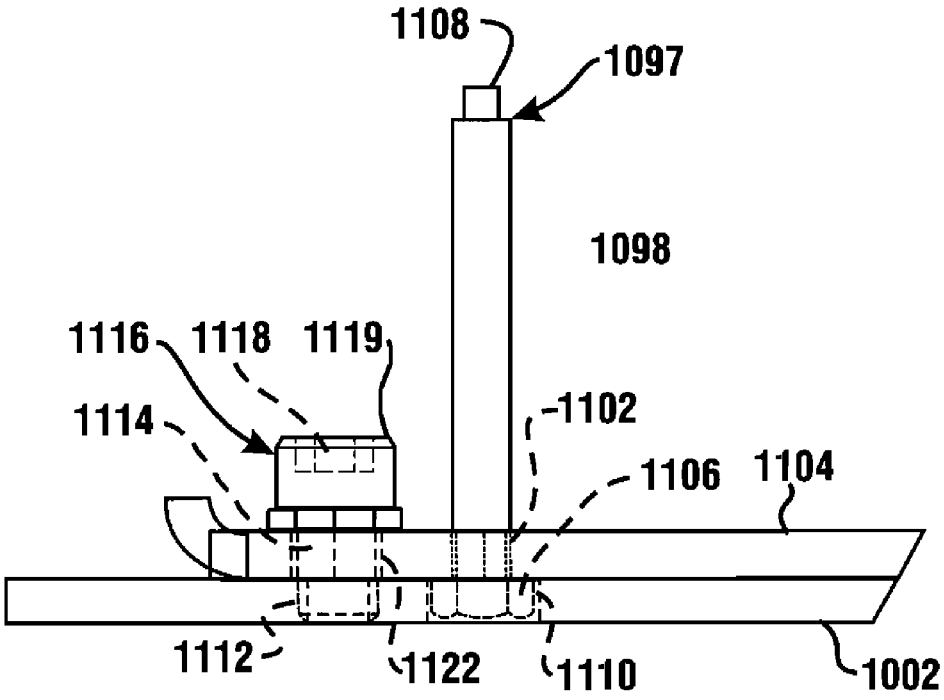
FIG. 39 is an enlarged view of a portion of the apparatus as indicated in FIG. 35.
Figure 41:
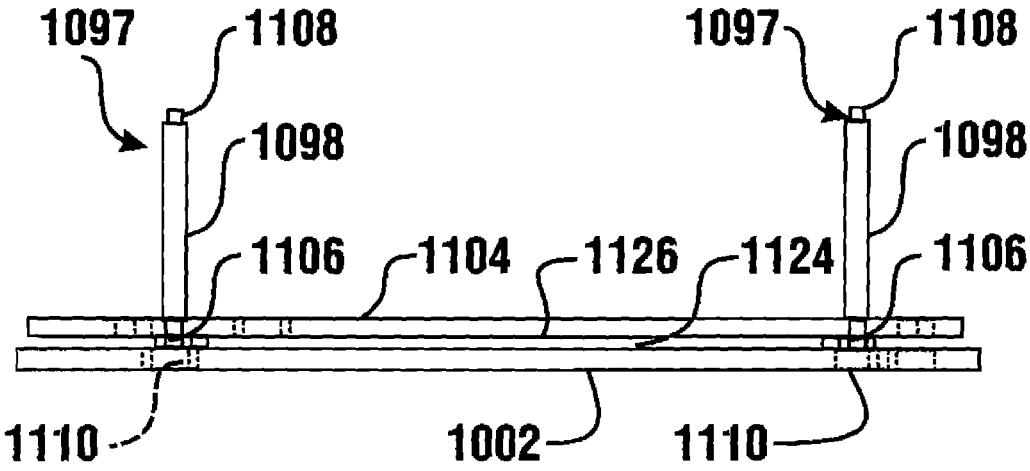
FIG. 41 a rear plan view of the chest base portion of the automated banking machine and the enclosure base portion shown in FIG. 33 with a skid member placed between them and the leveling legs positioned out of their apertures.
Figure 42:
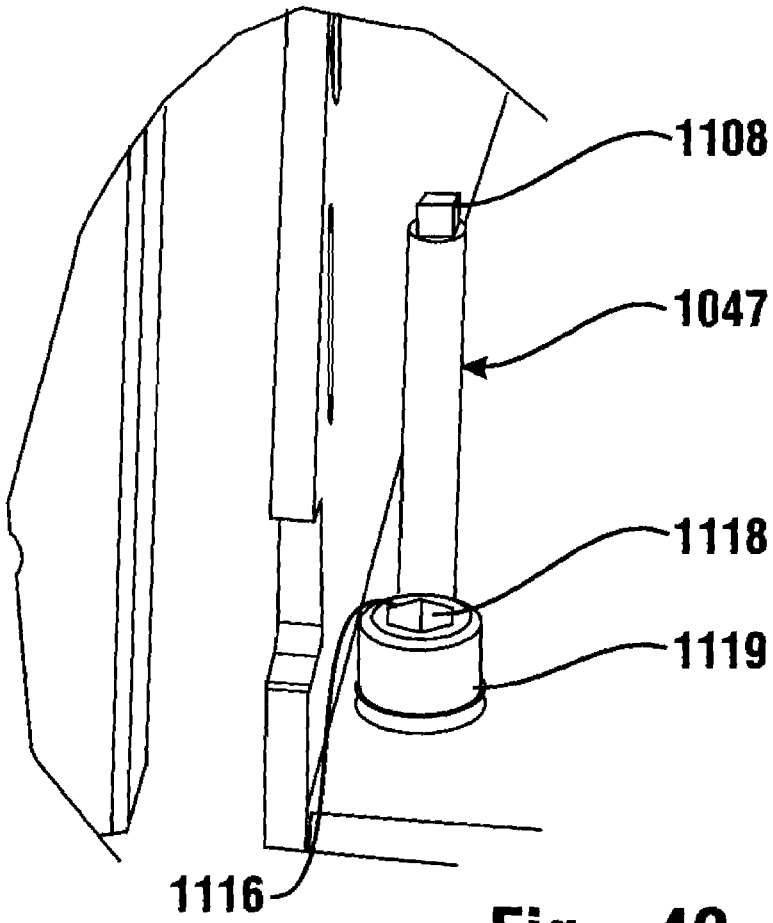
FIG. 42 is an enlarged view of a portion of the apparatus as indicated in FIG. 33.

The machine 910 may be installed in the exemplary enclosure for user operation. Also at times the machine may need to be removed from the enclosure for servicing, replacement or other reasons. Since the machine may be relatively heavy, this may require additional labor to do so. An exemplary arrangement and method of installing and removing a machine in the enclosure that reduces the labor involved will now be discussed. In this arrangement, the base portion 1002 of the enclosure includes apertures 1110 as best seen in FIGS. 39 and 41. Referring to FIG. 39, each of the apertures 1110 is configured to receive a foot 1106 of the leveling leg 1097. The example aperture 1110 has a cross section that is sized slightly larger than the perimeter of the foot 1106 to allow the foot 1106 to slide or move freely downwardly into and upwardly out of the aperture. In an example embodiment the aperture may be a circular recess. Alternatively, a recess of another configuration may be provided. The exemplary enclosure base portion 1002 further includes threaded holes 1112. Each of the threaded holes 1112 may be configured to receive a corresponding threaded shank 1114 of a bolt 1116. As seen in FIG. 42, the example bolt 1116 includes a hexagonal socket 1118 in the head 1119 that can receive a corresponding hexagonal shaped projection of a tool such as an Allen wrench to screw the bolt into engagement with the threaded hole 1112.

Figure 35:
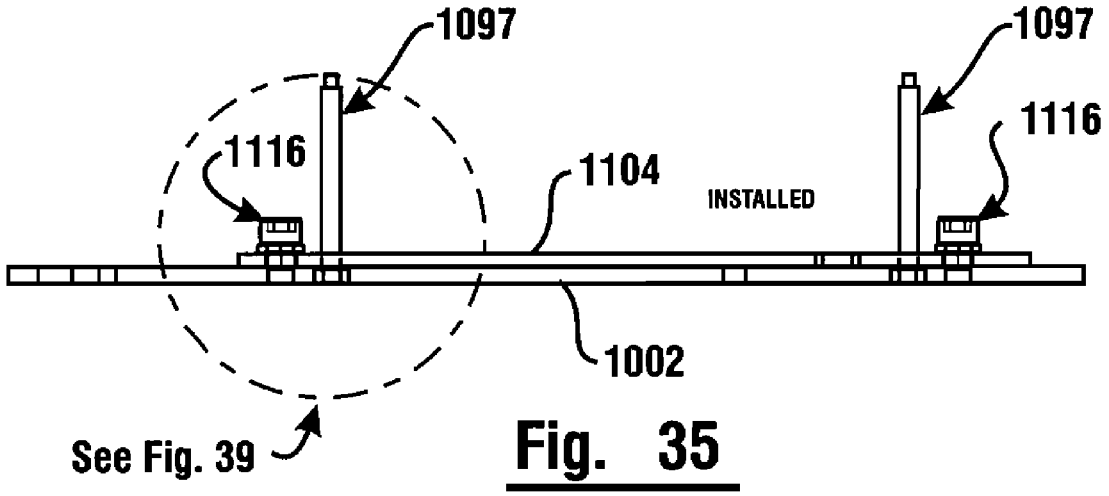
FIG. 35 is a rear plan view of the chest base portion of the automated banking machine installed on the enclosure base portion according to the exemplary embodiment shown in FIG. 33.
Figure 40:
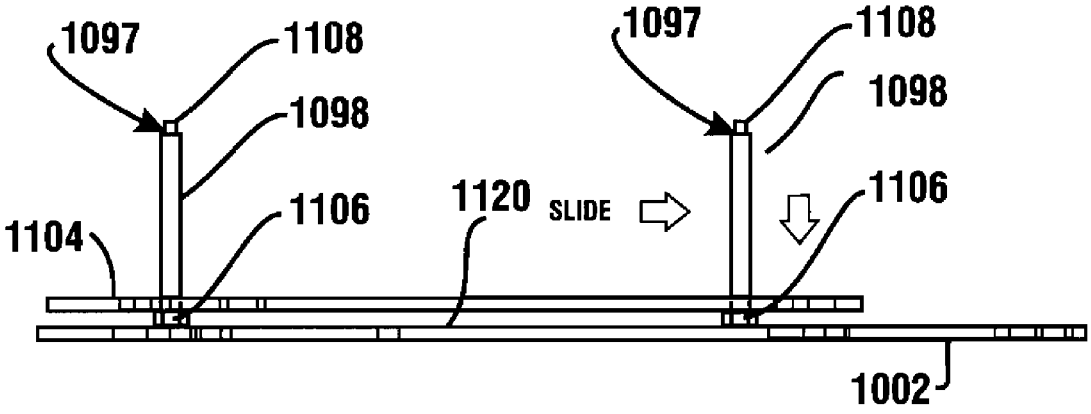
FIG. 40 is a view similar to FIG. 35 but with the leveling legs on the top surface of enclosure base portion prior to being placed in the apertures of the enclosure base portion.

To install the machine into the enclosure 1000, the machine is first positioned in the enclosure 1000 such that the foot portions 1106 of the leveling legs 1097 are on the interior surface 1120 of the enclosure base portion 1002 as shown in FIG. 40. Then, the machine is slid in supported connection along the interior surface of the base portion of the enclosure until the foot portions 1106 of the leveling legs 1097 drop into the apertures 1110 of the enclosure base portion 1002 as seen in FIGS. 35 and 39. In this position, bolt accepting apertures 1122 formed in the chest base portion 1104 align with the threaded holes 1112 of the enclosure base portion. This assures that the machine housing is moved to the proper position in the enclosure. The bolts 1116 are then inserted through the apertures 1122 and screwed into engagement with their corresponding threaded holes 1112 by an Allen wrench to hold the machine to the enclosure 1000. Door 1123 (FIG. 34) of the machine chest 940 is closed and locked and then the door 1014 or closure panel of the enclosure 1000 is then closed 1014 and locked.

In the example arrangement, to remove the machine 910 from the enclosure 1000, the door 1014 or panel of the enclosure is first unlocked and opened to gain access to the machine. Then the chest door 1123 of the machine chest 940 is opened to gain access to the heads of bolts 1116 and the tops of leveling legs 1097 in the interior area of the chest 940. This is done by unlocking the associated locking mechanisms on the enclosure door and chest. The bolts 1116 are then unfastened and removed from the threaded holes 1112 and apertures 1122 using an Allen wrench. The wrench for the leveling legs 1097 is then used to engage the tool receiving end 1108 of each of the leveling legs 1097. Each of the leveling legs 1097 is then rotated by the wrench in a clockwise direction (as viewed from the top of the chest base portion 1104), which rotation causes the chest base portion 1104 to move up and away from the enclosure base portion 1002 at least a predetermined distance. Then, as depicted in FIG. 41, one or more skid members 1124, which have a thickness that is less than the predetermined distance between the bottom surface of chest base portion 1104 and the upper surface of enclosure base portion 1002, is inserted between the chest base portion and the enclosure base portion. The example skid member 1124 also has a width that is less than the distance between adjacent left and right leveling legs 1097 to allow the skid member 1124 to be inserted between the left and right leveling legs. The top surface 1126 of the skid member may comprise metal, wood or other suitable relatively low friction material that allows the chest base portion to slide along the skid member 1124.

In the exemplary method, one or more skid members 1124 are inserted between the chest and enclosure base portions, each of the leveling legs 1097 are rotated in the counterclockwise direction (as viewed from the top of the chest base portion) to move the foot 1106 up and out of the associated aperture 1110 in the enclosure base portion as seen in FIG. 41 to allow the chest base portion 1104 to slide in engagement with the top surface 1126 of the skid member 1124. Then, the chest door 1123 is closed and the machine is slid in engagement with the skid member 1124 and out of the enclosure 1000.

It should be understood that the exemplary enclosure shown and described houses a machine that has a rear chest door. Alternatively, an enclosure may have a front door for accommodating machines with a chest door that opens from the front of the chest. This will enable removal of the machine from the front of the enclosure rather than the rear. Of course, various configurations may be provided using the teachings herein.

In some exemplary embodiments, the enclosure may further include features for securing and environmentally sealing the machine may include for example suitable gasketing material, frame structures or other members that are in operative supported connection with enclosure so as to isolate the machine from the elements to protect the machine from vandals or other risks. This may include, for example, in some embodiments suitable gasketing material in the area of the opening of the enclosure. Such gasketing material may provide for a generally fluid tight interface between the machine housing in the area of the fascia and the enclosure. Alternatively and/or in addition, close fitting trim pieces, frames or other suitable materials may be used to bridge any gaps between the enclosure structure and the machine housing that might be utilized by vandals to try to gain access to the interior area of the machine. In some example embodiments, such areas between the machine housing and the enclosure may be reinforced or otherwise secured so as to avoid unauthorized access through the enclosure and machine housing. Further, exemplary enclosures may include additional structures or elements such as signage, lighting, providing alarm indications or other features that may be desirable in particular circumstances.

Thus the automated banking machines and systems of the exemplary embodiments may achieve one or more of the above stated objectives, eliminate difficulties encountered in the use of prior devices and systems, solve problems and attain the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations herein are by way of examples and the invention is not limited to the details shown and described.

In the following claims any feature described as a means for performing a function shall be construed as encompassing any means capable of performing the recited function, and shall not be deemed limited to the particular means shown in the foregoing description or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods, processes and relationships are set forth in the appended claims.

We claim:

1. Apparatus comprising:

an automated banking machine, wherein the automated banking machine is operative to cause financial transfers responsive at least in part to data read from data bearing records, wherein at least one computer is associated with the machine, wherein the automated banking machine includes:

a card reader, wherein the card reader is operative to read card data usable to identify at least one of a user of the machine and a financial account, at least one user input device, wherein the at least one user input device is operative to receive inputs from machine users, a housing, wherein the card reader and the at least one user input device are in operatively supported connection with the housing, and wherein the housing includes an interior area and wherein the housing includes at least one vent that is operative to enable air to pass at least one of into and out of the interior area, wherein the at least one computer is in operative connection with the card reader and the at least one user input device, wherein the at least one computer is operative to cause card data to be read through operation of the card reader and to cause receipt of at least one input through the at least one user input device, wherein the at least one computer is operative to cause a determination to be made that the card data corresponds to a financial account that is authorized to conduct a financial transaction having an associated value with the machine, wherein the at least one computer is operative to cause a financial account to be assessed the value associated with the financial transaction, an enclosure, wherein the enclosure is configured to at least partially enclose the housing, wherein the enclosure includes at least one air duct, wherein the air duct is operative to enable air flow at least one of into and out of the enclosure, and a filter, wherein the filter is in operative connection with the air duct, wherein the filter is operative to filter the air flow, wherein the air duct has an interior opening within the enclosure and an outer opening, wherein the air duct is configured to enable air flow between the internal opening and the outer opening, and wherein the filter is removably mounted to the enclosure in generally covering relation of the outer opening.

2. The apparatus according to claim 1 and further comprising:

a cover, wherein the cover is removably mounted to the enclosure, wherein the cover in the mounted position is operative to generally cover the filter, wherein the cover includes at least one louver that is operative to enable the air flow through the cover.

3. The apparatus according to claim 2 wherein one of the cover and the enclosure includes a tab, and the other of the tab and the enclosure includes a slot configured to accept the tab, wherein in the mounted condition of the cover, the tab and slot are in engaged relation.

4. The apparatus according to claim 3 wherein the cover includes at least one cover aperture, wherein the at least one cover aperture is disposed on the cover from the tab or slot of the cover, and further comprising at least one fastener, wherein in the mounted position of the cover, the at least one fastener is operative to hold the cover in engagement with the enclosure.

5. The apparatus according to claim 2 and further comprising:

a pair of selectively releasible clips, wherein the pair of releasible clips is operative to selectively hold a filter in operatively engaged relation with the enclosure.

6. The apparatus according to claim 5 wherein the enclosure includes an enclosure base portion wherein the machine includes a leg, wherein the leg includes a foot portion, and wherein the foot portion extends below the machine housing, wherein the enclosure base portion includes a leg accepting aperture therein and wherein the foot portion is releasibly engageable in the leg accepting aperture.

7. The apparatus according to claim 6 wherein the housing includes a plurality of legs wherein the enclosure base portion includes a plurality of leg accepting apertures, wherein a foot portion of each respective leg is releasibly engageable in a respective leg accepting aperture.

8. The apparatus according to claim 7 wherein the enclosure base portion includes a supporting surface, wherein the leg accepting apertures extend downward from the supporting surface, wherein the housing is movable into the enclosure through slidable engagement of the foot portions and the supporting surface.

9. The apparatus according to claim 8 wherein the machine housing includes a chest portion, wherein the chest portion includes a chest interior area and a chest door, wherein the chest portion is bounded at a lower end by a chest base portion, wherein each of the plurality of legs extend through the chest base portion.

10. The apparatus according to claim 9 wherein the chest base portion includes at least one chest fastener accepting aperture, and wherein the enclosure base portion includes at least one enclosure base fastener accepting aperture, wherein with the plurality of foot portions engaged in the leg accepting aperture, the at least one chest fastener accepting aperture and at least one enclosure base fastener accepting aperture are configured to releasibly accept housing fasteners, wherein the housing fasteners are operative to releasibly hold the chest base portion and the enclosure base portion in operatively engaged relation.

11. The apparatus according to claim 10 wherein the holding fasteners are configured to be inaccessible when the chest door is in a closed position.

12. The apparatus according to claim 9 wherein each leg is in threaded movable engagement with the chest base portion, and wherein each leg includes a tool engagement portion engageable with a tool within the chest interior area, wherein the corresponding foot portion of each leg is movable vertically responsive to rotational movement of the tool engagement portion, wherein the plurality of apertures in the enclosure base portion are configured so that the plurality of foot portions are movable to position a lower surface of the chest base portion above the supporting surface of the enclosure base portion.

13. The apparatus according to claim 12 wherein the plurality of legs are configured to position the lower surface of the chest base portion above the supporting surface a sufficient distance to position at least one skid between the lower surface and the supporting surface and to position the foot portions above the apertures in the enclosure base portion when the at least one skid is positioned between the lower surface and the supporting surface, whereby the housing is movable relative to the enclosure in supporting connection with the at least one skid.

14. The apparatus according to claim 13 wherein the at least one air duct of the enclosure includes at least one of a fan, a valve, an air heater and an air cooler.

15. The apparatus according to claim 13 wherein the machine includes a printer, wherein the printer is in operative connection with the at least one computer, and wherein the at least one printer is operative to print a record of the financial transaction.

16. The apparatus according to claim 15 wherein the machine includes a cash dispenser, wherein the cash dispenser is in operative connection with the at least one computer, wherein during the transaction the at least one computer is operative to cause the cash dispenser to dispense cash from the machine corresponding to the value.

17. Apparatus comprising:

an automated banking machine including:

a card reader operative to read identification information from data bearing user cards, wherein the identification information is usable to identify at least one of a respective user and a respective user's financial account, at least one output device wherein the at least one output device is operative to provide outputs including instructions concerning machine usage, a cash dispenser, wherein the cash dispenser is operative to cause cash stored in the housing to be dispensed from the machine, at least one input device, wherein the at least one input device is operative to receive inputs from machine users, at least one computer, wherein the at least one computer is in operative connection with the card reader, the at least one input device, the at least one output device and the cash dispenser, wherein the at least one computer is operative to cause a determination that card data read from a user card corresponds to at least one of an authorized user and an authorized financial account authorized to carry out a transaction with the machine, and wherein responsive at least in part to the determination, the at least one computer is operative to cause cash having a value to be dispensed from the machine and to cause the financial account to be assessed a value corresponding to the dispensed cash, a machine housing, wherein the card reader, the at least one output device, the at least one input device and the cash dispenser are all in operatively supported connection with the machine housing, wherein the machine housing includes at least one air flow vent wherein the at least one air flow vent enables air flow at least one of into and out of the machine housing, an enclosure, wherein the enclosure is in at least partial surrounding relation of the machine housing, wherein the machine housing is removably positionable within an interior area of the enclosure, at least one air duct extending in the enclosure, wherein the at least one air duct is in operative communication with the at least one air flow vent, at least one filter, wherein the at least one filter is in removably mounted connection with the at least one air duct.

18. The apparatus according to claim 17 wherein the enclosure includes a plurality of air ducts wherein each air duct is operative to at least one of supply air to and exhaust air from an interior area of the enclosure, wherein each of the plurality of air ducts has a respective filter removably mounted in operative connection therewith.

19. The apparatus according to claim 18 wherein the enclosure includes a base portion, wherein the enclosure base portion includes a plurality of apertures therein, wherein the machine housing includes a plurality of legs wherein the legs extend downward from a housing base portion, wherein each respective leg is configured to releasibly engage a respective aperture in the enclosure base portion.

20. The apparatus according to claim 19 wherein each leg is selectively movable vertically, wherein the plurality of legs are configured to extend downward and dispose the housing above the enclosure base portion a sufficient distance to allow at least one skid to be positioned intermediate of the housing and the enclosure base portion, and wherein with the at least one skid positioned intermediate of the housing and the enclosure base portion, the plurality of legs are configured to be vertically movable upward such that the legs are disengaged from the apertures and the housing may be moved relative to the enclosure base portion in supporting connection with the at least one skid.

* * * * *